US007063122B2

(12) United States Patent
Colson et al.

(10) Patent No.: US 7,063,122 B2
(45) Date of Patent: Jun. 20, 2006

(54) BOTTOM-UP/TOP-DOWN RETRACTABLE CELLULAR SHADE

(75) Inventors: Wendell B. Colson, Weston, MA (US); Michael S. Goldberg, Longmont, CO (US); Terrence M. Drew, Superior, CO (US); Paul F. Josephson, Longmont, CO (US); Ralph G. Jelic, Boulder, CO (US)

(73) Assignee: Hunter Douglas Inc., Upper Saddle River, NJ (US)

( * ) Notice: Subject to any disclaimer, the term of this patent is extended or adjusted under 35 U.S.C. 154(b) by 157 days.

(21) Appl. No.: 10/642,017

(22) Filed: Aug. 14, 2003

(65) Prior Publication Data

US 2004/0074611 A1 Apr. 22, 2004

Related U.S. Application Data

(63) Continuation-in-part of application No. 10/393,698, filed on Mar. 18, 2003, now Pat. No. 6,834,701.

(60) Provisional application No. 60/366,286, filed on Mar. 20, 2002.

(51) Int. Cl.
*E06B 9/08* (2006.01)

(52) U.S. Cl. ..... 160/84.03; 160/121.1; 160/245

(58) Field of Classification Search ..... 160/84.03, 160/167 R, 115, 171, 170, 121.1, 89, 245, 160/191, 192
See application file for complete search history.

(56) References Cited

U.S. PATENT DOCUMENTS

| | | | | |
|---|---|---|---|---|
| 13,482 A | | 8/1855 | Crooke | 160/256 |
| 81,258 A | | 8/1868 | Jacob | 160/121.1 |
| 362,706 A | | 5/1887 | Bell | 160/121.1 |
| 674,854 A | | 5/1901 | Crocker | 160/265 |
| 703,378 A | | 7/1902 | Blaustein | 160/256 |
| 810,278 A | | 1/1906 | Hopkins | 160/277 |
| 1,003,045 A | | 9/1911 | Hartsough | 160/121.1 |
| 1,439,540 A | | 12/1922 | Forster | 160/265 |
| 2,110,938 A | | 3/1938 | Nutt | 118/211 |
| 2,250,106 A | * | 7/1941 | Lorentzen | 160/170 |
| 3,093,186 A | * | 6/1963 | Castanedo | 160/167 R |
| 3,192,991 A | * | 7/1965 | Anderle | 160/167 R |
| 3,465,806 A | * | 9/1969 | Sulkes | 160/84.06 |

(Continued)

FOREIGN PATENT DOCUMENTS

| | | |
|---|---|---|
| DE | 201 17 865 U | 2/2002 |
| EP | 0 529 591 | 3/1993 |

*Primary Examiner*—David Purol
(74) *Attorney, Agent, or Firm*—Dorsey & Whitney LLP

(57) ABSTRACT

A covering for an architectural opening includes a head rail, a bottom rail with a take-up roller therein and an intermediate rail with both the intermediate rail and bottom rail suspended from the head rail, a fabric material interconnecting the intermediate rail with the bottom rail and being adapted to be wrapped around the roller in the bottom rail, said fabric including a pair of vertically oriented sheets that are horizontally spaced by a plurality of vertically spaced horizontal vanes with the vanes being movable between open and closed positions by opposite vertical movement of the sheets of material. In a first embodiment a first control system is provided for raising and lowering the bottom rail and a second control system for raising and lowering the intermediate rail as well as tilting the intermediate rail to effect an opening or closing of the vanes. In alternative embodiment, the bottom rail is controlled with a spring balanced system so that it remains in any position in which it is normally set.

17 Claims, 55 Drawing Sheets

U.S. PATENT DOCUMENTS 3,552,473 A * 1/1971 Persson ..... 160/172 R
4,733,711 A * 3/1988 Schon ..... 160/84.03
5,419,385 A 5/1995 Vogel et al. ..... 160/121.1
5,443,108 A * 8/1995 LeVert et al. ..... 160/167 R
5,482,100 A * 1/1996 Kuhar ..... 160/170
6,135,189 A * 10/2000 Weinreich ..... 160/191
6,662,850 B1 * 12/2003 Chung et al. ..... 160/171

* cited by examiner 104
196
274

274
286
270
196
286

196
274
286

196
274
286
286

280
270
282
282
278
276
278

BOTTOM-UP/TOP-DOWN RETRACTABLE CELLULAR SHADE

CROSS REFERENCE TO RELATED APPLICATIONS

This application is a continuation-in-part of U.S. application Ser. No. 10/393,698, filed 18 Mar. 2003 now U.S. Pat. No. 6,834,701, which application claims the benefit of U.S. provisional application No. 60/366,286, filed 20 Mar. 2002. Each of the above-identified applications is hereby incorporated by reference as if fully disclosed herein.

BACKGROUND OF THE INVENTION

1. Field of the Invention

This invention relates generally to retractable coverings for architectural openings or the like that include a pair of vertically oriented sheets horizontally spaced by a plurality of vertically spaced horizontally extending vanes. Oppositely directed vertical movement of the sheets causes the vanes to pivot about horizontal longitudinal axes between open and closed positions. In the open position, the vanes are horizontally disposed defining a gap therebetween permitting the passage of vision and light, and in a closed position, the vanes are substantially vertically oriented and overlap slightly to block the passage of vision and light therethrough. The coverings are retractable by lifting a bottom rail or lowering an intermediate rail causing the sheets of material and interconnected vanes to wrap around a horizontal roller. More specifically the present invention relates to a covering of the above-noted type wherein the top of the covering can be lowered or the bottom raised and the vanes opened or closed at any relative position of the bottom rail with respect to the top of the covering.

2. Description of the Relevant Art

Coverings for architectural openings such as windows, doors, archways and the like, have taken numerous forms over many years. Early simple forms of such coverings amounted to fabric draped or otherwise suspended across an opening while in recent years more sophisticated coverings have been developed.

By way of example, venetian blinds have become a popular form of coverings for architectural openings wherein a plurality of vertically spaced, horizontally extending slats are pivotally supported by cord ladders so that the slats can be pivoted or tilted about horizontal longitudinal axes to move the covering between open and closed positions or the slats can be gathered into a vertical stack adjacent the top of the architectural opening in a retracted condition of the covering.

More recently such venetian blinds have been designed so as to not only retract vertically by lifting a bottom rail toward the headrail of the covering but by also dropping a top rail toward the bottom rail and such coverings are commonly referred to as bottom-up/top-down coverings. As will be appreciated, in a bottom-up/top-down covering, the slats can be gathered adjacent to the top of the opening or the bottom of the opening and can further be tilted at intermediate locations to permit or prevent the passage of vision and light therethrough.

More modern coverings for architectural openings have been referred to as cellular coverings wherein a plurality of horizontally extending, vertically stacked cells can be extended across an opening or gathered adjacent an edge of the opening in a stacked condition with the cells collapsed adjacent to each other. One disadvantage with this type of cellular covering resides in the fact that when the covering is extended across an opening, vision and light are blocked.

To overcome the shortcomings in the afore-noted cellular-type coverings, a new version of a cellular covering includes a pair of parallel vertically disposed sheets of sheer-type fabric which are normally suspended in horizontally-spaced relationship and include a plurality of vertically spaced horizontally extending vanes, which may be flexible, extending therebetween. By moving the sheets in opposite vertical directions, the vanes can be moved between open and closed positions so that in an open position, the vanes are disposed substantially horizontally to permit the passage of vision and light therebetween, and in a closed position, are disposed substantially vertically and overlap to block the passage of vision and light. Of course, in the closed position, the sheets of sheer material are disposed closely adjacent to each other with only the vanes separating the sheets. This type of cellular shade is moved from an extended position, wherein it extends across the architectural opening, to a retracted position by rolling the two sheets with the vanes therebetween about a roller disposed in the headrail at the top of the opening. Of course, to extend the covering across the opening, the roller is simply rotated in the opposite direction and a weighted bottom rail pulls the sheet material with the vanes secured thereto downwardly by gravity. Such coverings to date have only been operable by drawing the bottom rail upwardly and rolling the fabric material, comprised of the sheets and vanes, about a roller within the head rail.

More versatility in cellular coverings of this latter type would be desirable and it is to that end that the present invention has been developed.

SUMMARY OF THE INVENTION

A cellular covering for architectural openings in accordance with the present invention includes a head rail, a bottom rail, and an intermediate or midrail with a fabric structure secured to and extending between the intermediate rail and the bottom rail. The fabric structure includes front and rear sheet materials adapted to be suspended vertically and with a plurality of vertically spaced horizontally extending vanes interconnecting the two sheets. The vanes are preferably flexible, even though this is not a requirement, and are of a width and spacing such that when vertically oriented, will overlap each other. When horizontally oriented, the vanes define spaces therebetween through which light and vision can pass.

The bottom rail includes a roller about which the fabric material can be selectively wrapped or unwrapped. The bottom rail is suspended from the headrail by a first control system that may be referred to as a lift system, which is manually operated so that the bottom rail can be selectively raised toward the top rail and positioned at any location between its lowermost position, which it assumes when the covering is fully extended, and a retracted position adjacent the headrail when the covering is fully retracted. The roller in the bottom rail around which the fabric structure can be wrapped and unwrapped is spring biased. The bias is in a direction so as to encourage wrapping of the fabric structure about the roller when the fabric structure is fed into the bottom rail as when the bottom rail is raised or the intermediate rail is lowered. In one embodiment of the invention when the bottom rail is lowered or moved by gravity away from the headrail causing the fabric structure to unroll from the roller, the weight of the bottom rail is sufficient to allow the fabric to unwind from the roller against the bias of the spring in the roller. In other embodiments of the invention, the bottom rail is spring balanced to retain any position in which it is manually positioned.

The intermediate rail is also suspended from the headrail and is adapted to be manipulated by a second control system which allows the intermediate rail, to which the upper edge of the fabric structure is secured, to move upwardly or downwardly. When moving the intermediate rail downwardly from the head rail, the fabric structure is shifted downwardly away from the head rail and fed into the bottom rail where it is wrapped around the roller within the bottom rail due to the bias of the roller encouraging the fabric to be wrapped therearound. The intermediate rail can be positioned at any location between the head rail and the bottom rail so as to define a gap between the intermediate rail and the head rail where there would be no fabric material.

The intermediate rail can also be pivoted about a horizontal longitudinal axis by the second control system such that the front and rear sheets of material are shifted in opposite vertical directions thereby causing the horizontal vanes to shift between an open substantially horizontal position, permitting the passage of vision and light therebetween, and a closed substantially vertical position, wherein the vanes overlap and block vision and light therethrough.

It will be appreciated that the covering of the present invention is a bottom-up/top-down covering with the bottom rail and intermediate rail being movably positionable anywhere in between their extreme lower and upper positions so that the fabric structure between the bottom rail and the intermediate rail can be extended to any desirable degree and positioned at any location across the opening.

Other aspects, features, and details of the present invention can be more completely understood by reference to the following detailed description of a preferred embodiment, taken in conjunction with the drawings and from the appended claims.

DETAILED DESCRIPTION OF THE INVENTION

Figure 1:
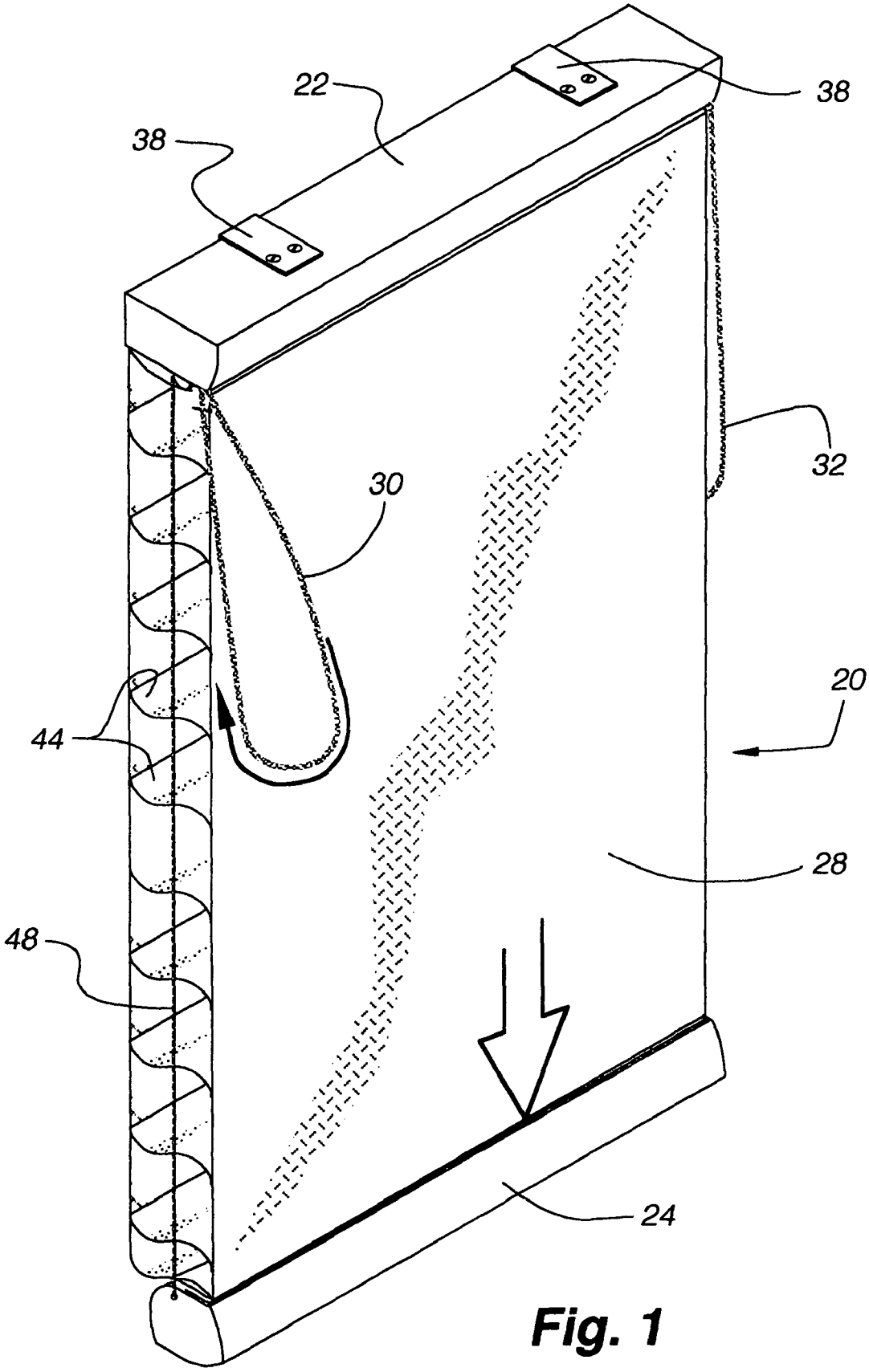
FIG. 1 is an isometric view of the covering of the present invention in a fully extended condition with the vanes open.
Figure 2:
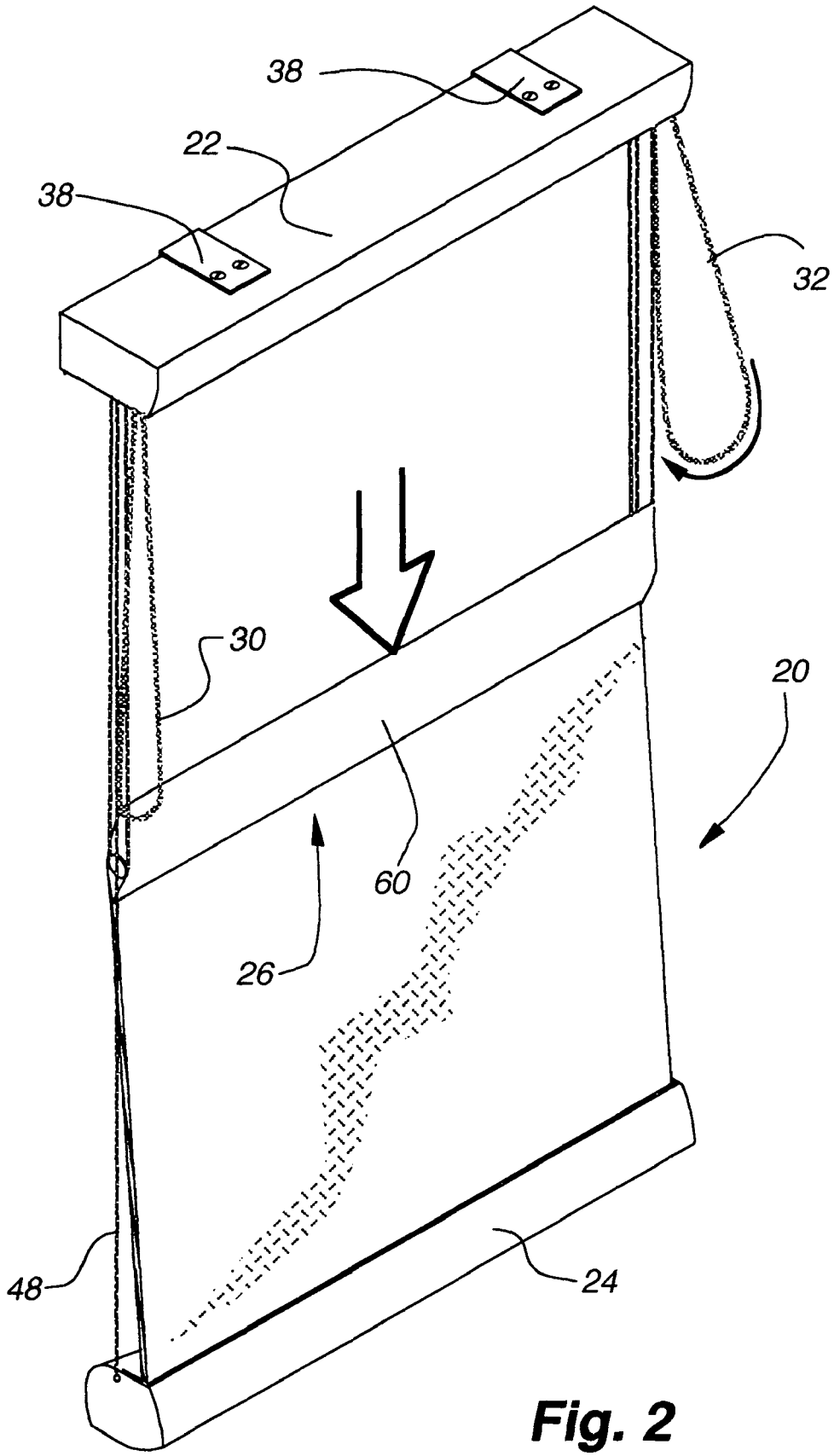
FIG. 2 is an isometric view of the covering of the present invention with the intermediate rail partially lowered and the vanes in a closed position.
Figure 3:
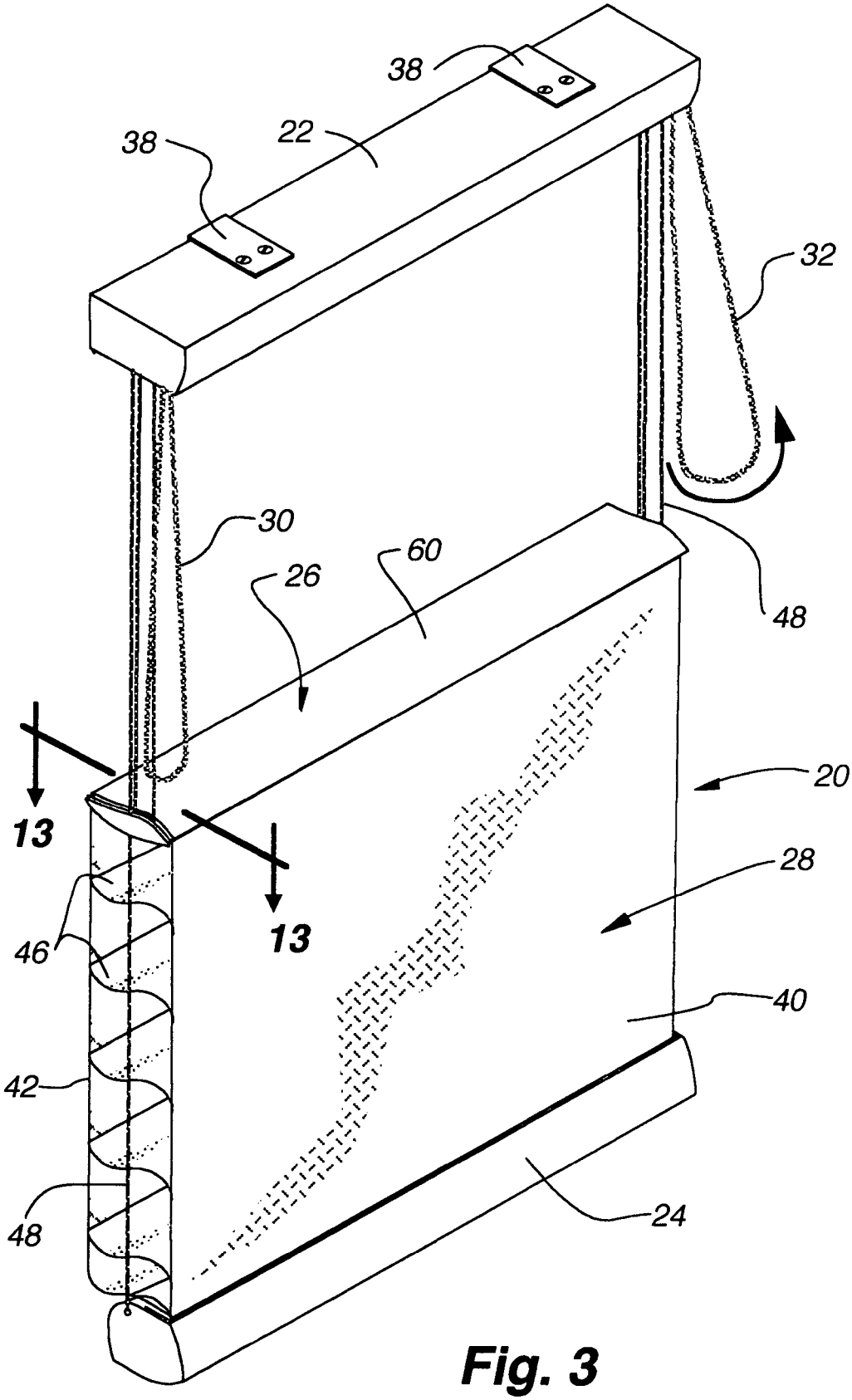
FIG. 3 is an isometric view of the covering of the present invention with the intermediate rail lowered and the vanes in an open position.
Figure 4:
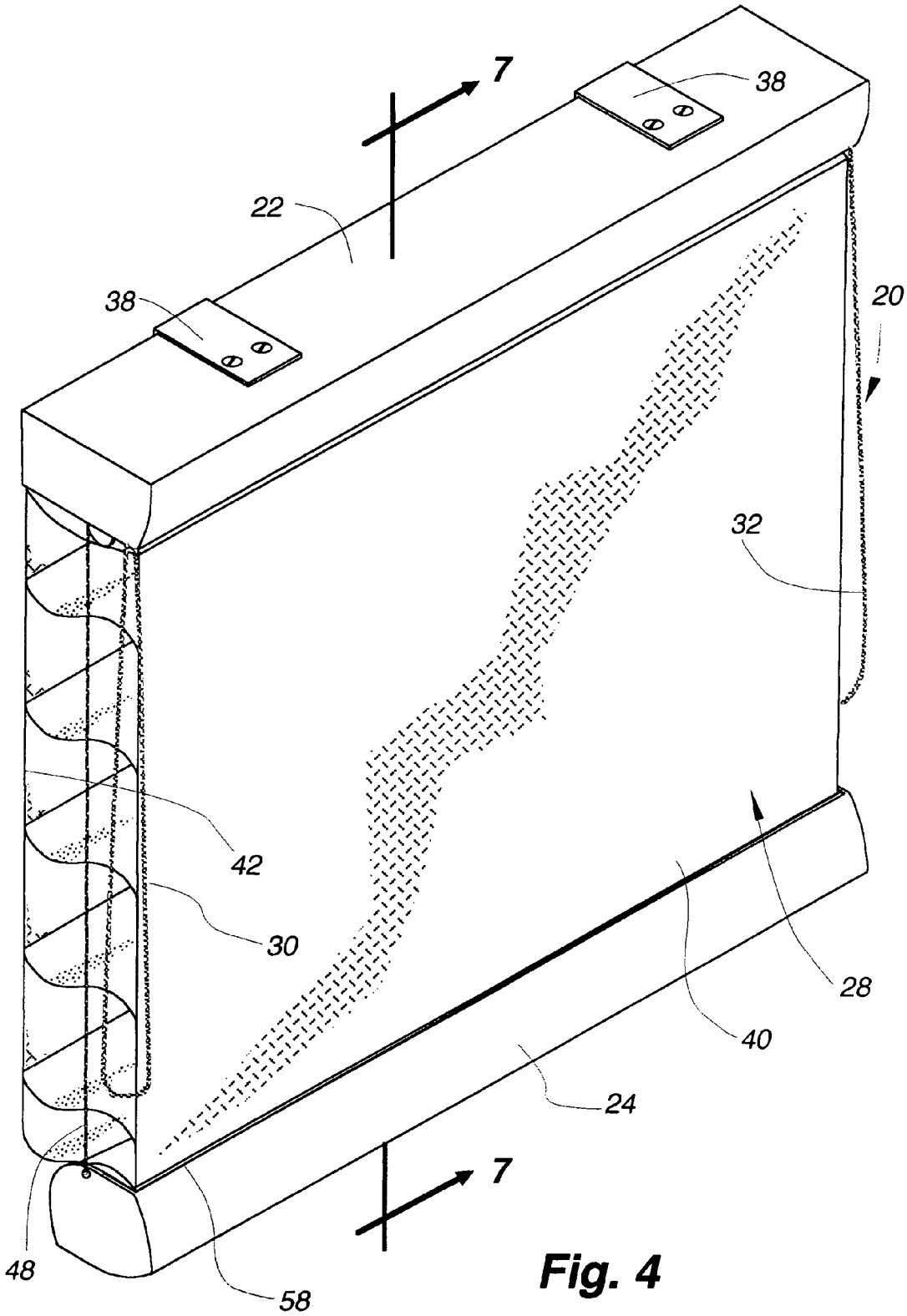
FIG. 4 is an enlarged isometric view of the covering of the present invention with the bottom rail partially raised and with the vanes in an open condition.
Figure 5:
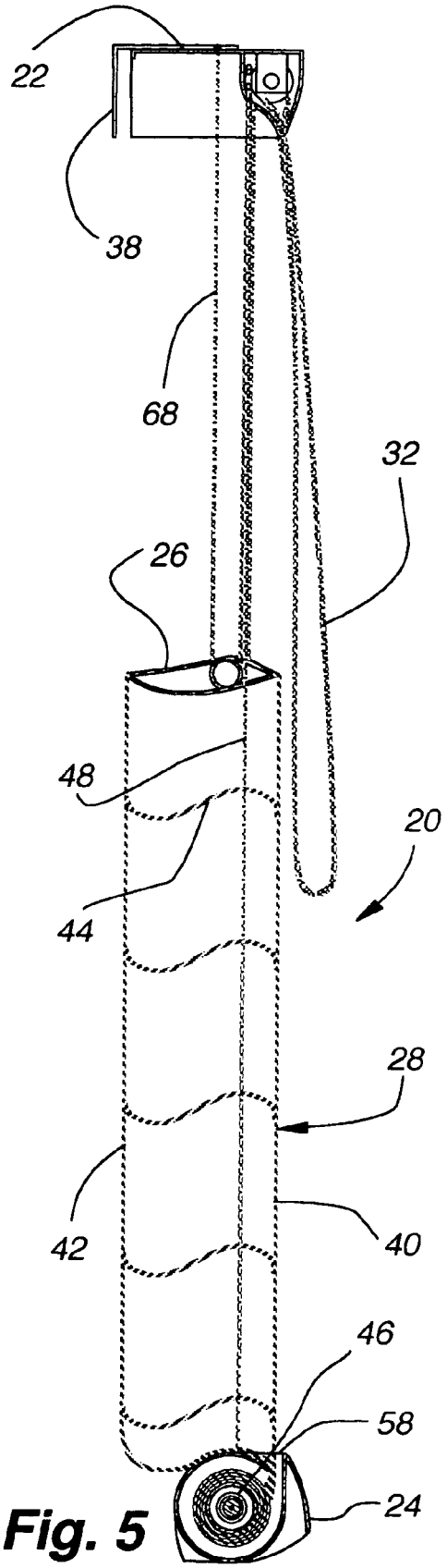
FIG. 5 is a vertical section taken through the covering of the present invention as seen in FIG. 3.
Figure 6:
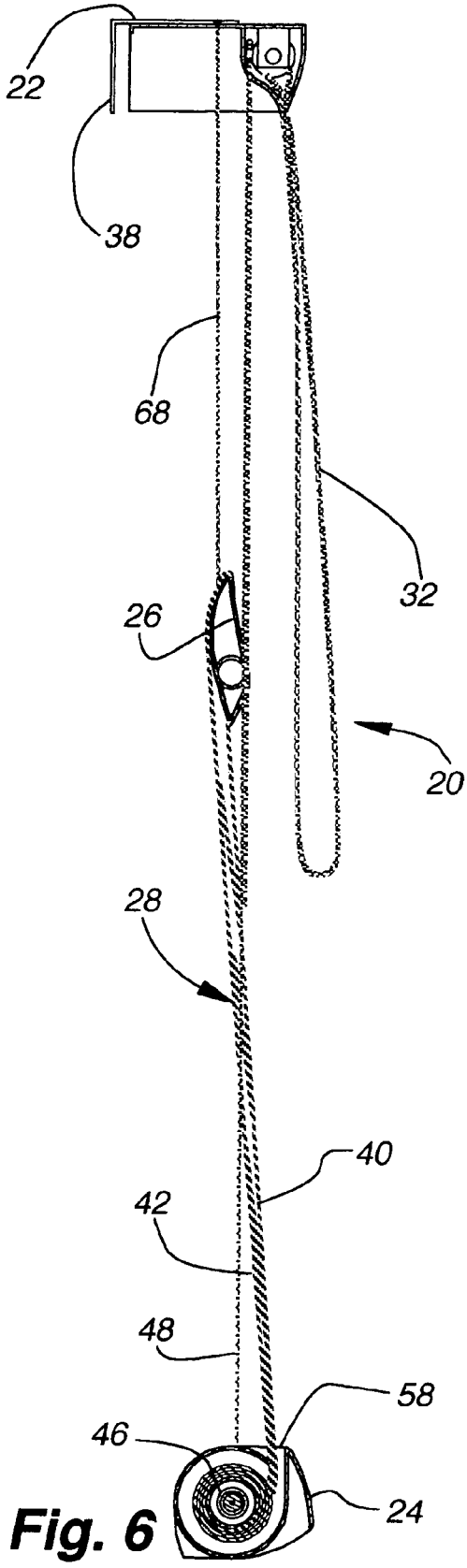
FIG. 6 is a vertical section taken through the covering of the present invention as seen in FIG. 2.
Figure 7:
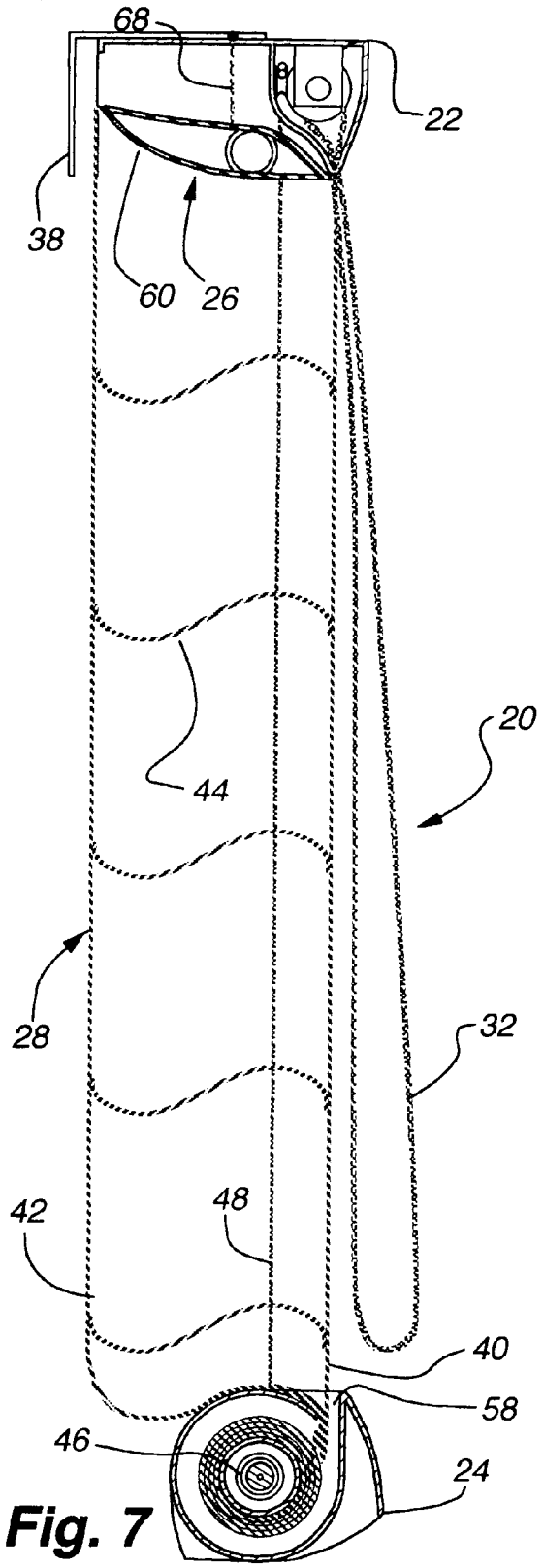
FIG. 7 is a vertical section taken along line 7—7 of FIG. 4.

A first embodiment of a covering 20 in accordance with the present invention is shown in FIGS. 1 through 20 and with reference to FIG. 1 can be seen to include a head rail 22, a bottom rail 24, an intermediate rail 26, a flexible fabric material or structure 28 extending between the intermediate rail and the bottom rail and operating cords 30 and 32 for operating first 34 and second 36 control systems, respectively (FIGS. 9–12) for the covering. The first control system 34 enables movement of the bottom rail vertically between a fully retracted condition of the covering as shown, for example, in FIG. 12, and a fully extended condition as shown in FIG. 1. The second control system 36 is utilized to not only tilt the intermediate rail for purposes to be described later, but to also move the intermediate rail vertically between the fully retracted position of FIG. 1 and a fully extended position (not shown) wherein the intermediate rail is positioned adjacent to the bottom rail when the bottom rail is in its fully extended position of FIG. 1. Both control systems are adapted to removably position the associated intermediate or bottom rail at any position between the fully retracted and extended positions.

The head rail 22 includes a pair of brackets 38 adapted to mount the head rail to the frame or another location adjacent to an architectural opening, such as a window, door, archway, or the like.

The fabric material 28 that extends between the intermediate rail 26 and the bottom rail 24 is comprised of front 40 and rear 42 flexible sheets of material such as sheer fabric, with the sheets being suspended from the intermediate rail in a horizontally spaced, vertically oriented condition when the fabric is fully extended as illustrated in FIG. 1. A plurality of vertically spaced, horizontally disposed vanes 44 extend between and are operatively connected to the sheets of material and while the vanes could assume different structures, in the preferred embodiment, they too are a flexible fabric material which may be the same or different than the material from which the sheets are made. Preferably, the vanes are opaque or translucent while the sheet material is transparent or translucent.

As will be appreciated with the operation of the covering to be described later, the fabric 28 is movable by the intermediate rail 26 between an open position illustrated in FIG. 1 and a closed position illustrated in FIG. 11. In the open position, the vanes 44 can be seen to assume a substantially S-shaped cross sectional configuration and are disposed substantially horizontally so as to define a space between adjacent vanes. This permits the passage of vision and light between the vanes and since the sheet materials 40 and 42 along the opposite side edges of the vanes are transparent or translucent, some degree of, light and vision is permitted through the fabric material when the covering is in the open condition of FIG. 1.

Figure 11:
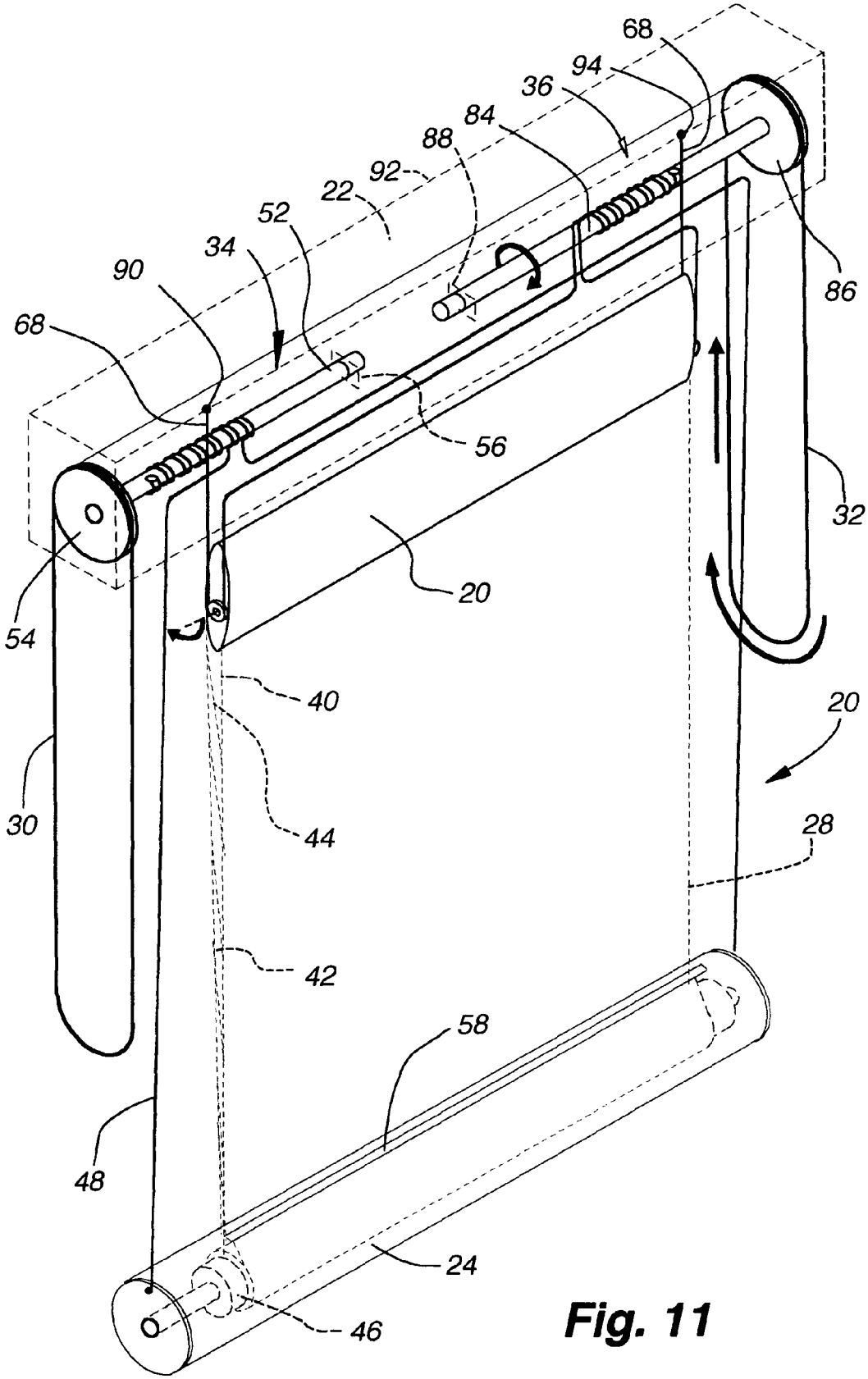
FIG. 11 is a diagrammatic isometric view similar to FIG. 9 with the vanes closed rather than open.
Figure 12:
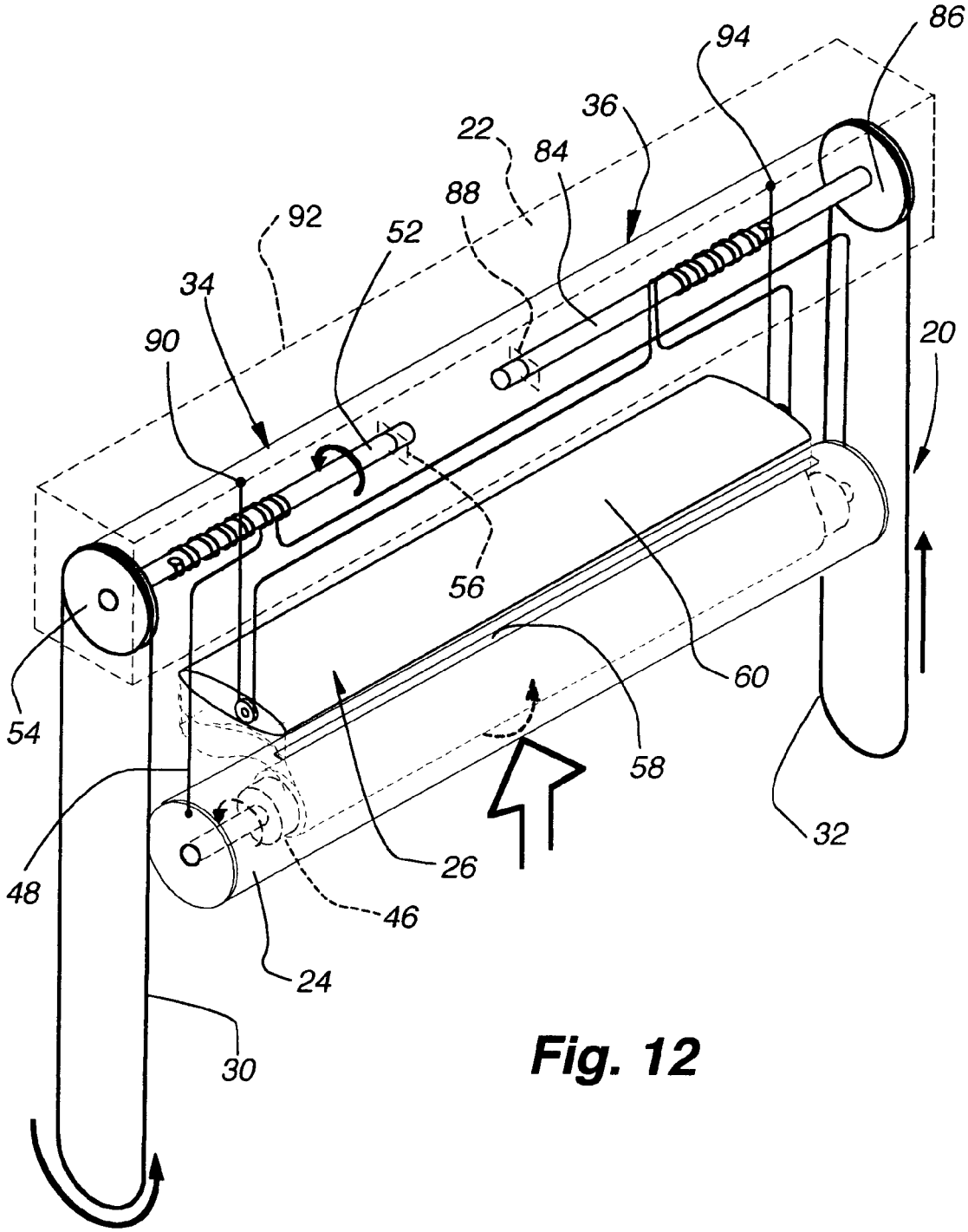
FIG. 12 is a diagrammatic isometric view of the covering of the present invention with the bottom rail fully raised into a position adjacent to the intermediate rail.

In the closed condition of FIG. 11, the fabric sheets 40 and 42 have been shifted vertically in opposite directions relative to each other so that the vanes 44 assume a substantially flat vertical planar orientation with adjacent vanes slightly overlapping to block, at least to some degree, the passage of vision and light through the fabric. Accordingly, the covering is movable between open and closed conditions by shifting the fabric sheets 40 and 42 in opposite vertical directions relative to each other as will be explained in more detail later.

The bottom rail 24, as best seen in FIGS. 5–12, includes an elongated rotable roller or roll bar 46 about which the fabric 28 can be wrapped or unwrapped with the roll bar being biased in a clockwise direction (as viewed in the drawings) by a conventional internal roller spring (not seen). The strength of the roller spring is determined by factors, which will become more apparent hereafter.

The first control system 34 shown at the left end of the covering 20 includes a pair of elongated flexible lift cords 48 or the like which extend from the headrail 22 to the bottom rail 24 at opposite ends of the bottom rail and are adapted to be extended or retracted by the closed loop flexible operating cord 30 or the like suspended at the left end of the covering for ready access by an operator of the covering. As will be explained in more detail later, movement of the operating cord 30 in one direction or the other causes the bottom rail to lift or lower through a retraction or extension of the lift cord 48 at each end of the covering. Retraction of the lift cords causes the bottom rail 24 to rise while retaining its horizontal orientation and move towards the head rail 22. As the bottom rail rises toward the head rail, the bias on the spring roller in the bottom rail causes the fabric to be wrapped around the roller. As the fabric is wrapped around the roller, it automatically moves the front and rear sheets of material 40 and 42 respectively toward each other in a manner to be described later thereby shifting the vanes 44 to a closed position so the vanes lie flat between the sheets of material as the fabric is wrapped about the roller.

As is probably seen best in FIGS. 9–12, the first control system 34 is mounted in the head rail 22 and includes a horizontal rod 52 supporting a pulley 54 at its left end and supported by a bearing 56 at its right end. The pulley 54 receives the endless operating cord 30 so that movement of the operating cord in one direction or the other causes a corresponding rotative movement of the pulley and the rod 52 which is fixed thereto for unitary movement therewith. The lift cords 48 associated with opposite ends of the bottom rail 24 are secured to the rod so as to be wrapped or unwrapped therefrom as the operating cord is moved.

It will therefore be appreciated that if the bottom rail 24 is in the fully extended position of FIG. 1, for example, rotation of the rod 52 in a clockwise direction will cause the lift cords 48 at opposite ends of the bottom rail to be wrapped around the associated rod causing the bottom rail to rise in a horizontal orientation and as it rises, the spring bias in the roll bar 47 causes the fabric material 28 to accumulate and be wrapped around the roller. It does not matter whether or not the fabric is in the open position of FIG. 1 or the closed position of FIG. 2 when the bottom rail is lifted as the fabric is passed through a narrow slot 58 provided in the top surface of the bottom rail prior to being wrapped about the roll bar forcing the fabric sheets 40 and 42 together, while in the bottom rail but unaffecting the fabric when outside the bottom rail. When the operating cord 30 for the first control system is moved in a counterclockwise direction causing the rod 52 to rotate correspondingly, the lift cords are allowed to unwrap from the rod and the bottom rail moves downwardly under the force of gravity and against the bias of the roll bar spring so the fabric material is unrolled from the roll bar and allowed to slide outwardly through the narrow slot 58 into a deployed position between the intermediate rail 26 and the bottom rail 24. It will be appreciated that the strength of the spring in the roll bar 46 is sufficient to wrap the fabric therearound as the bottom rail is raised but not so strong as to prevent gravity from lowering the bottom rail as the lift cords are extended.

As will be appreciated by reference to FIGS. 9–17, the intermediate rail 26 has a relatively flat ovular main body 60 that is hollow in construction and has end caps 62 in opposite ends thereof. The end caps are rigid in nature and can be made of any suitable material such as plastic and serve partially to provide closure to the open ends of the ovular body. The ovular body needs to be somewhat rigid so as to support the fabric 28 and in particular, the front sheet 40 of the fabric is supported from the front edge 64 of the intermediate rail while the back sheet 42 of the fabric is supported from the rear or back edge 66 in a conventional manner.

Figure 13:
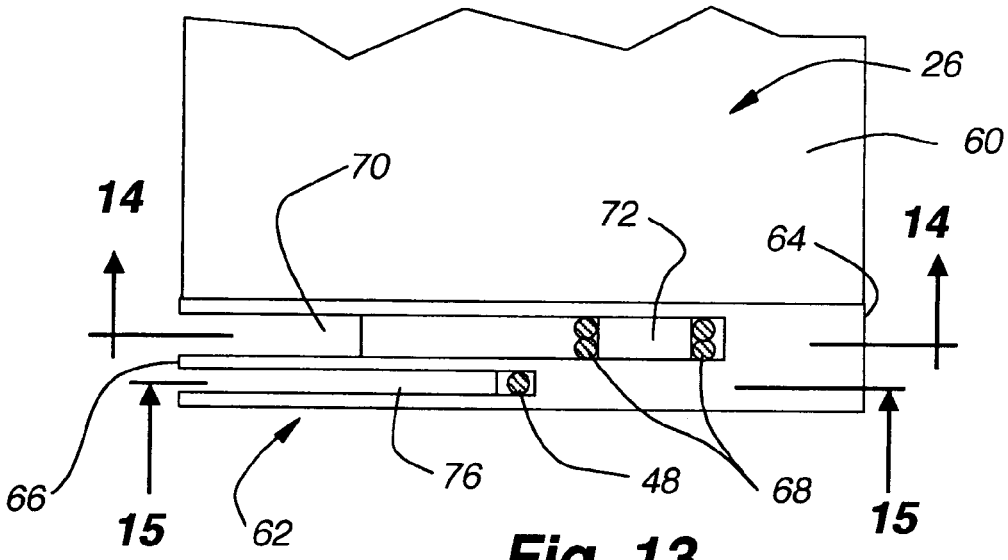
FIG. 13 is a fragmentary top plan view taken along Line 13—13 of FIG. 3 showing one end of the intermediate rail and an end cap mounted thereon.
Figure 14:
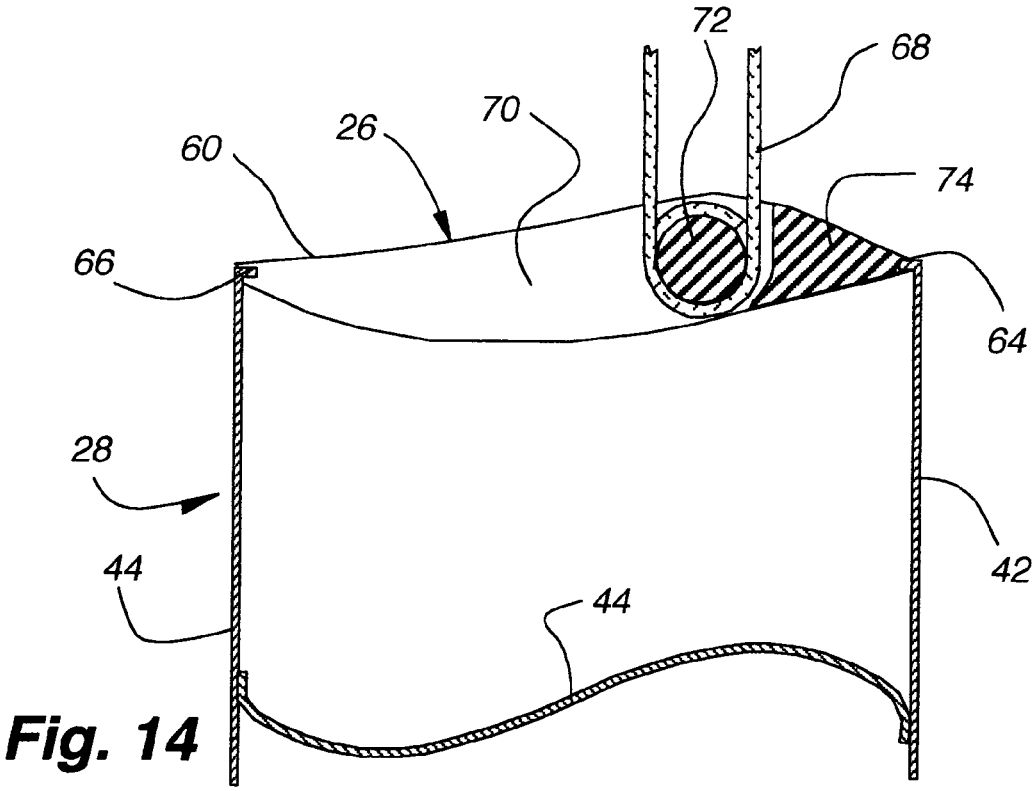
FIG. 14 is a fragmentary section taken along Line 14—14 of FIG. 13.

Each end cap 62 is provided with a plurality of slots formed transversely of the intermediate rail and adapted to receive the lift cords 46 for the bottom rail and tilt/lift cords 68 for the intermediate rail. The tilt/lift cords are part of the second control system 36 that will be described later. As seen in FIGS. 13 and 14, a first innermost slot 70 is formed from the rear edge 66 of the end cap and terminates at a location approximately ¾ of the way across the width of the end cap. The slot extends completely through the end cap from top to bottom. A wrap pin 72 is defined in the slot so as to extend from one side of the slot to the other adjacent to but slightly spaced from a block of material 74 defined adjacent to the front edge of the vane. The wrap pin 72 is adapted to receive the tilt/lift cord 68 in a manner such that the cord wraps around the pin twice for a purpose to be described later.

Figure 15:
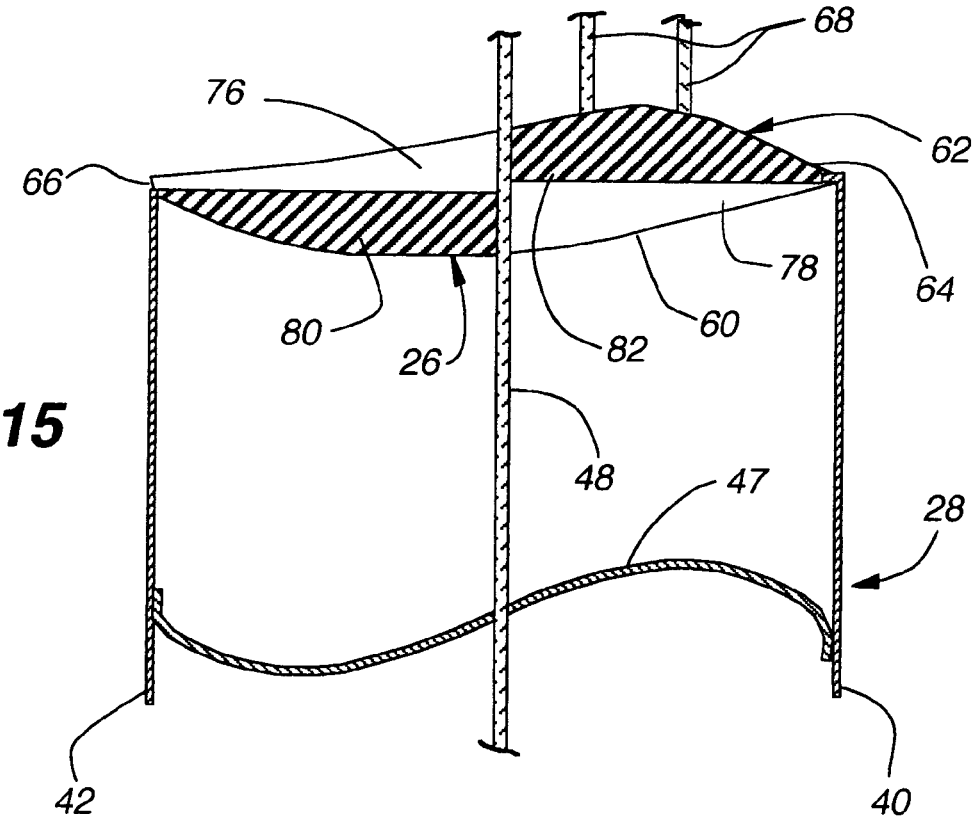
FIG. 15 is a fragmentary section taken along Line 15—15 of FIG. 13.
Figure 16:
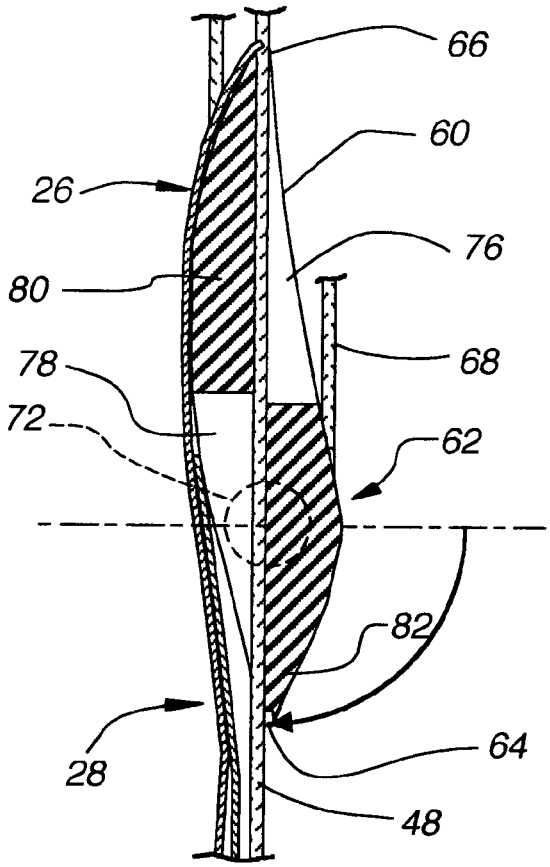
FIG. 16 is a fragmentary section similar to FIG. 15 with the intermediate rail rotated through 90°.
Figure 17:
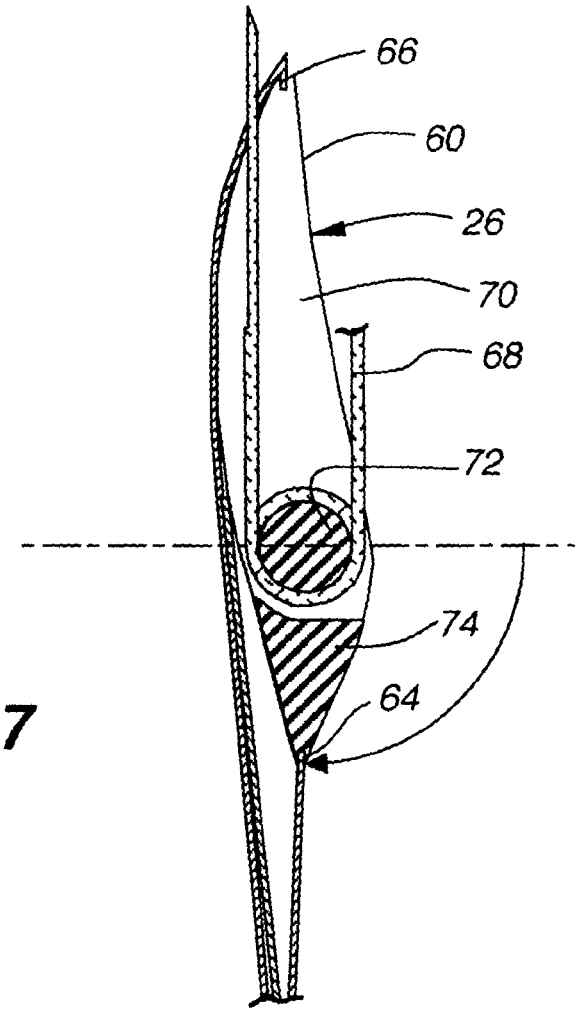
FIG. 17 is a fragmentary section similar to FIG. 14 with the vane having been rotated through 90°.
Figure 18:
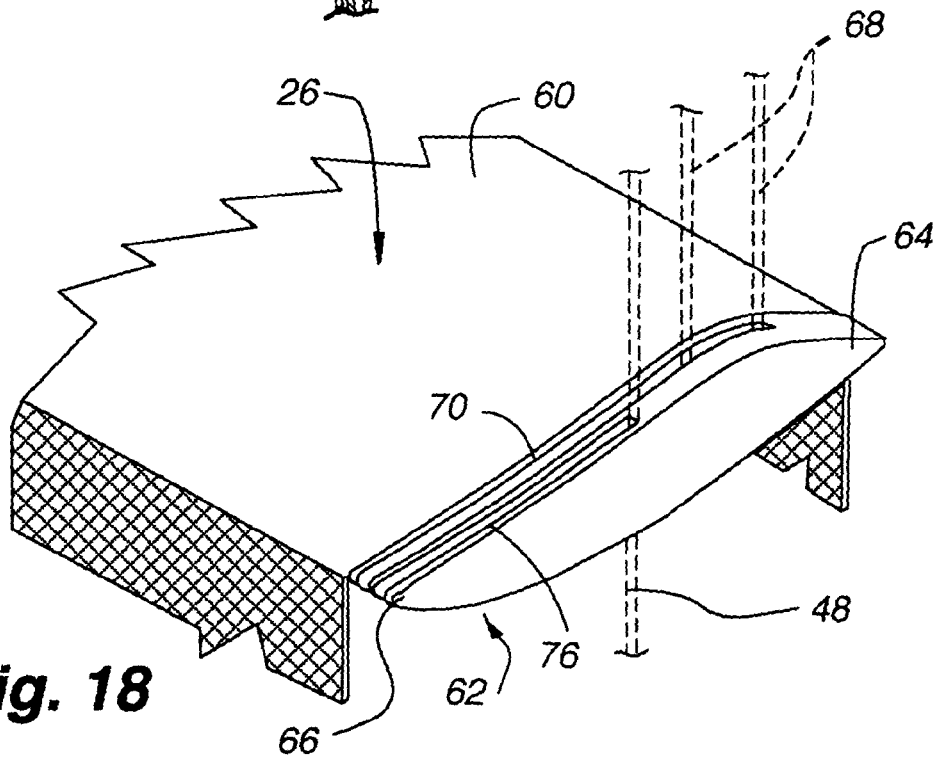
FIG. 18 is a fragmentary isometric looking at an end of the intermediate rail.
Figure 20:
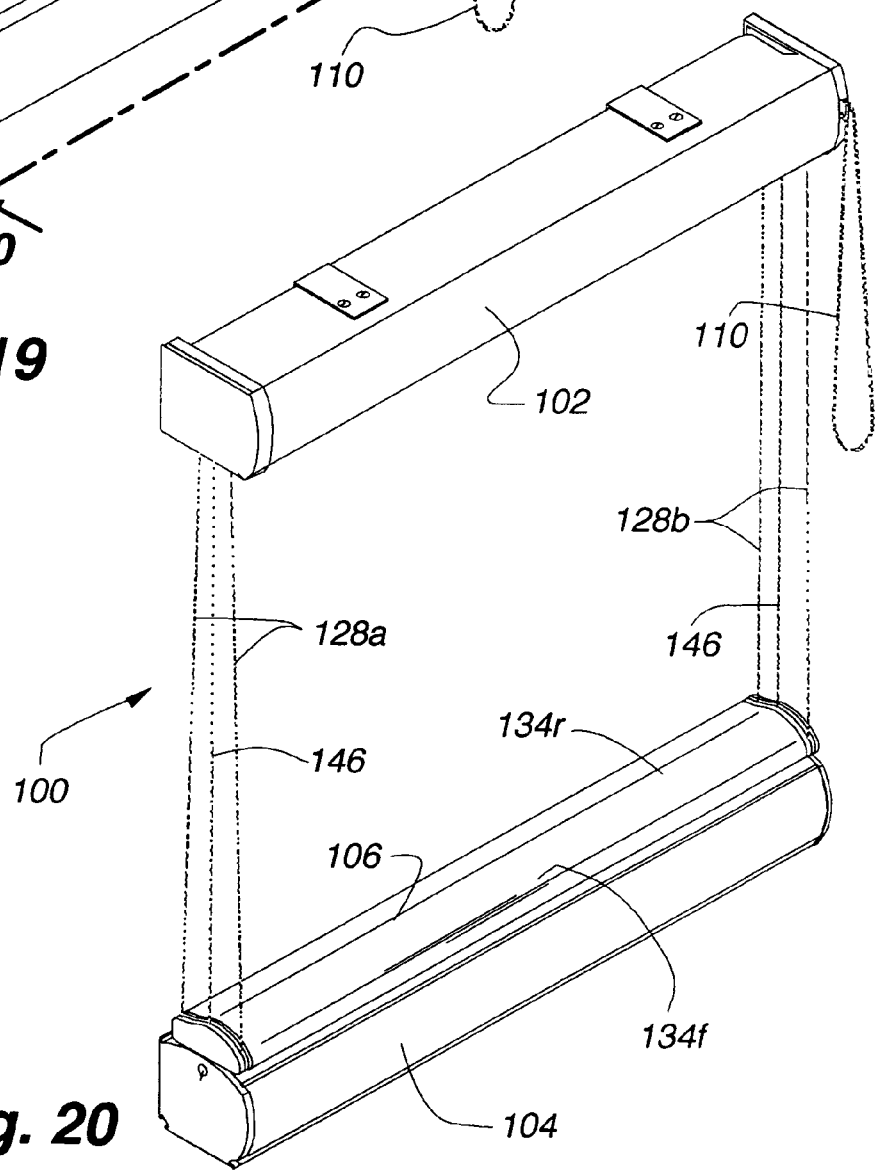
FIG. 20 is an isometric view similar to FIG. 19 with the bottom rail and intermediate rail in their lowermost positions.

A second pair of aligned slots 76 and 78 are disposed outwardly from the innermost slot 70 as seen in FIGS. 13, 15, and 16. The slot 76 of the pair extends from the rear edge 66 of the end cap along the top half of the end cap slightly more than half the distance to the front edge 64 of the end cap while the second slot 78 of the pair extends from the front edge 64 of the end cap along the bottom half of the end cap to slightly past the center of the end cap. The associated lift cord 46 for the bottom rail 24 passes through the pair of slots 76 and 78 as best seen in FIGS. 13 and 15 so that when the intermediate rail 26 is horizontally disposed, there is a passage communicating with both slots 76 and 78 of the pair to accommodate the passage of the lift cord transversely through the slots. Further, when the intermediate rail is pivoted through 90° as shown in FIG. 16, the lift cord 46 again passes through the slots, this time longitudinally of the slots. It will be appreciated, however, that when the intermediate rail is horizontally disposed as shown in FIG. 15, the solid portions 80 and 82 of the end cap that are aligned with the slots 76 and 78 engage the lift cord and prevent the intermediate rail from pivoting in a counterclockwise direction while permitting pivotal movement in a clockwise direction until the intermediate rail becomes vertically oriented as shown in FIG. 16 where the lift cord again engages the solid portions, this time along different surfaces thereof, preventing further pivotal movement. When the vane is vertically oriented as in FIG. 16, of course, the vane can be pivoted in a counterclockwise direction but prevented from further pivotal movement in a clockwise direction.

As probably best appreciated by reference to FIGS. 9–12, the second control system 36 includes a horizontally disposed rod 84 carrying a pulley 86 at one end and is supported at its opposite end in a bearing 88 for rotative movement that is created by the second endless operating cord 32 operatively engaged with the pulley 86. Movement of the second operating cord in one direction or the other, therefore, causes the rod 84 to rotate in a corresponding direction. A pair of the flexible tilt/lift cords 68 are secured at one end to the rod 84 and are adapted to be wrapped around or unwrapped from the rod depending upon the direction of movement of the operating cord 32. One of the tilt/lift cords 68 extends from the rod 84 to the left end of the intermediate rail 26 where it extends downwardly and is wrapped twice around the associated wrap pin 72 in the end cap 62 before having the free end of the cord extend upwardly where it is anchored at 90 to a bottom surface of a top wall 92 of the head rail 22. The second tilt/lift cord 68 also extends from the rod 84 downwardly to the wrap pin in the end cap at the opposite end of the intermediate rail where it too is wrapped twice around the wrap pin and then extends upwardly where the end of the cord is secured at 94 to a bottom surface of the top wall 92 of the headrail.

The tilt/lift cords associated with the second control system extend along a front side of the associated wrap pin 72 before being wrapped therearound and extending upwardly from the rear side of the wrap pin toward their locations of anchor to the top wall 92. It will, therefore, be appreciated that as the tilt/lift cords are unrolled from the associated rod 84 by counterclockwise rotation of the operating cord 32, the tilt/lift cords become slack along the front edge of the wrap pins so that the wrap of cord about the wrap pins is loose enough to allow the intermediate rail 26 to drop by gravity. Before the intermediate rail drops vertically by gravity, however, it will pivot about a horizontal axis defined by the wrap pins 72 in a clockwise direction inasmuch as the end caps are designed to be heavier along the fronts edges 64 thereof. After the intermediate rail has pivoted through approximately 90 degrees (from the position of FIG. 15 to the position of FIG. 16), the lift cords 48 interact with the slots 76 and 78 in the associated end caps of the intermediate rail preventing further pivotal movement of the intermediate rail so that if the tilt/lift cords are continued to be unwrapped from the rod 84, the looseness of the wrap of the tilt/lift cords about the wrap pins allow the entire rail to drop by gravity while in its vertical orientation of FIG. 11.

The intermediate rail 26 can be lowered in the afore-noted manner from the fully retracted position of FIG. 11 to a fully extended position (not shown) adjacent to the bottom rail 24. This is true regardless of the location of the bottom rail, i.e. whether it is fully extended into its lowermost position or raised fully or partially into an intermediate location above the fully extended position.

However, if the operating cord 32 is moved in a clockwise direction, the tilt/lift cords 68 are caused to wrap about the rod 84 thereby tightening the wrap of the tilt/lift cords about the wrap pins and causing the intermediate rail to initially pivot in a counterclockwise direction causing the tilt/lift cords to switch from the positions shown in FIG. 16 to the position of FIG. 15. Once the intermediate rail pivots to the horizontal orientation of FIG. 15, the lift cords again operatively engage the end caps terminating the pivotal movement of the intermediate rail whereby further wrapping of the tilt/lift cords about the rod 84 shortens their effective length causing the intermediate rail to rise.

Figure 10:
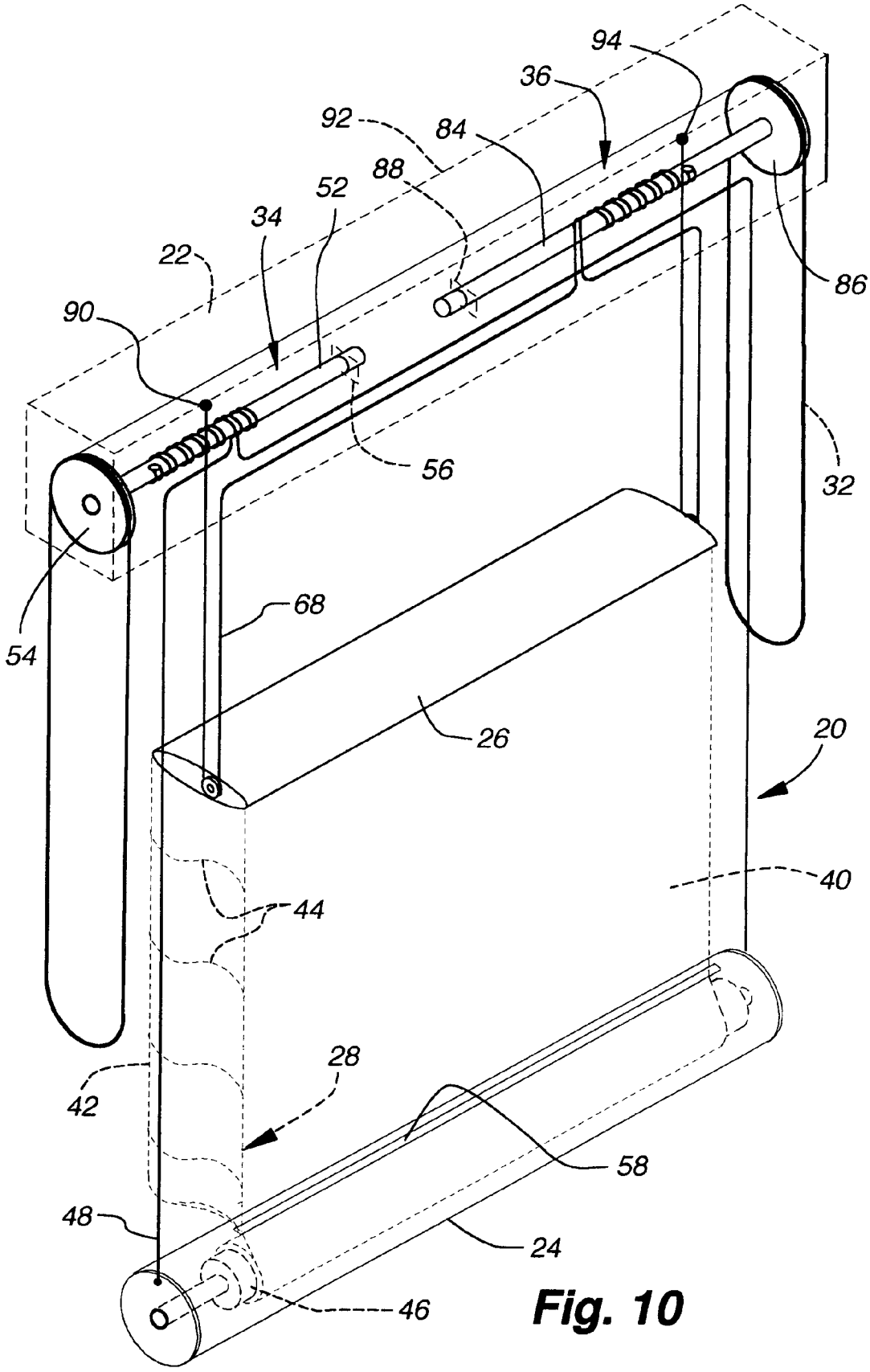
FIG. 10 is a diagrammatic isometric view similar to FIG. 9 with the intermediate vane partially lowered.

Clutches (not shown) are associated with both the first and second control systems 34 and 36 to permit the bottom rail 24 and the intermediate rail 26 to removably maintain any position between their fully extended and fully retracted positions so the fabric 28 extending therebetween can be extended fully across the architectural opening (FIG. 1), from the top partially down (FIG. 4), from the bottom partially up (FIG. 2), or to any degree there between across an intermediate portion of the opening (FIG. 10).

Figure 8:
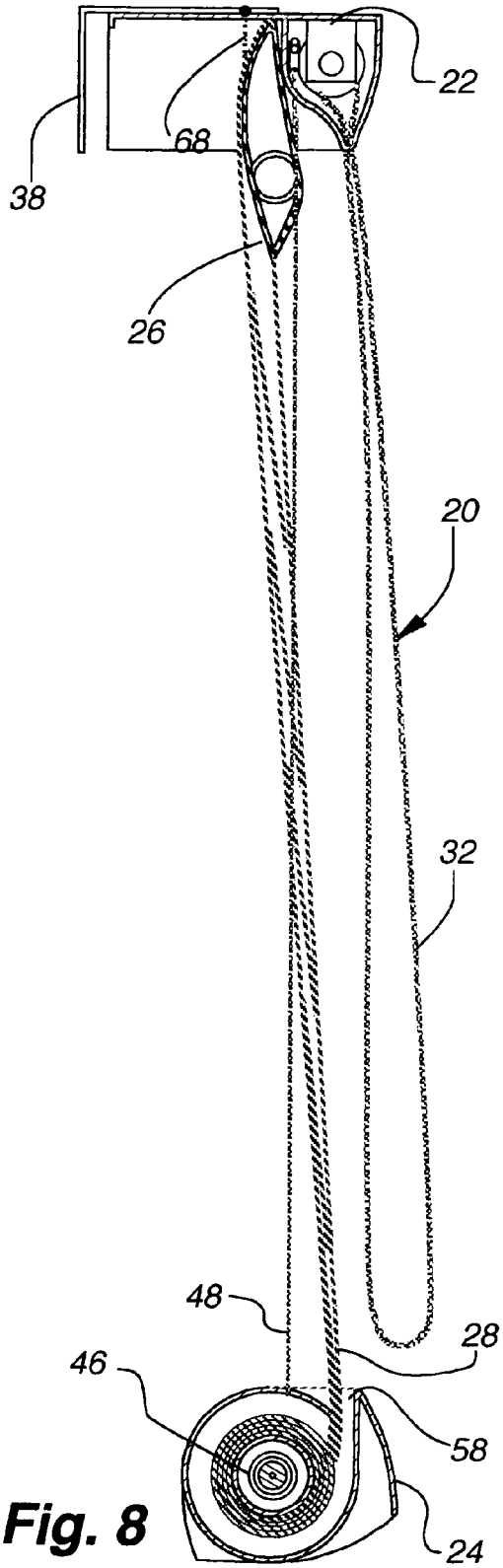
FIG. 8 is a section similar to FIG. 7 with the vanes in a closed rather than an open position.
Figure 9:
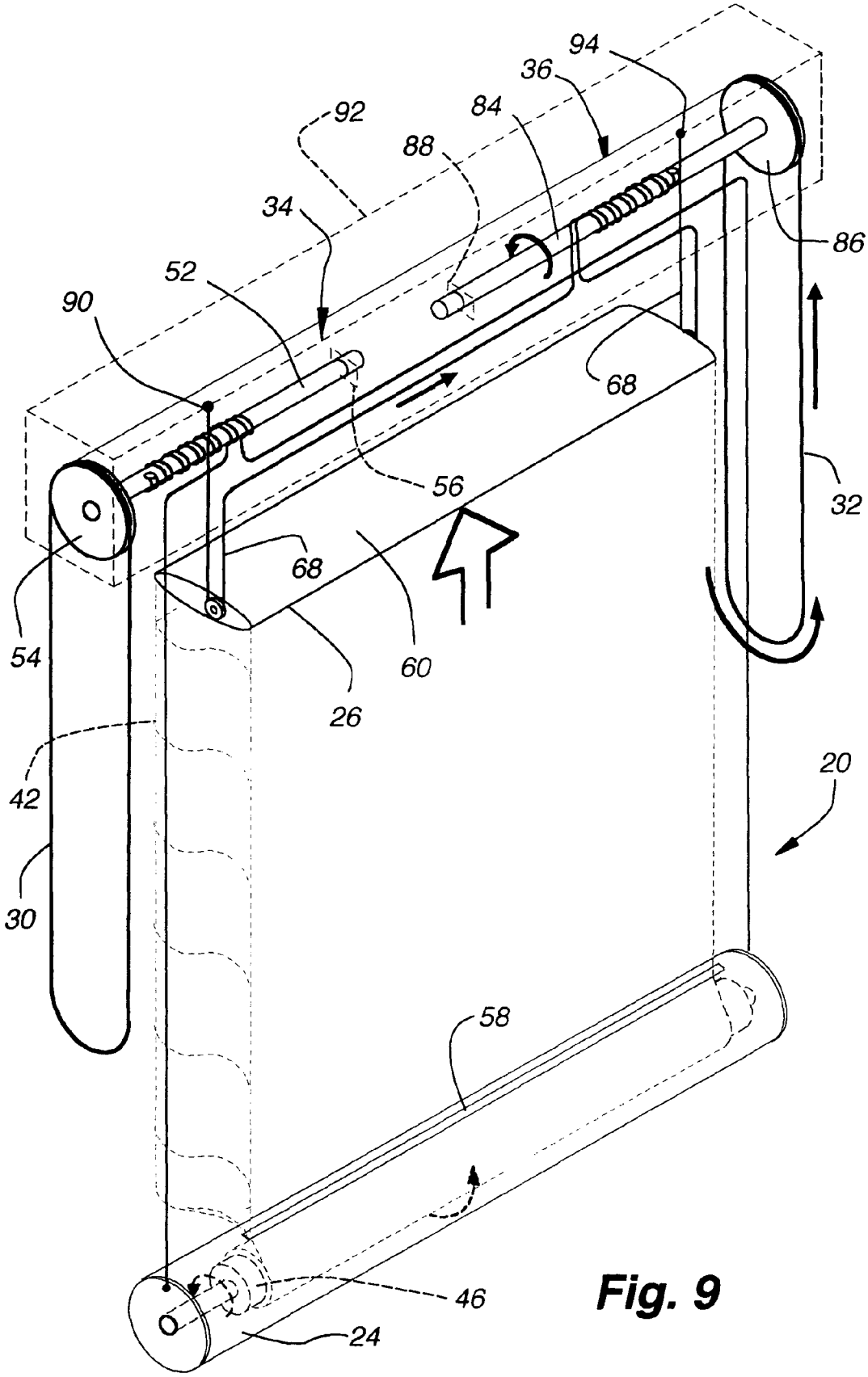
FIG. 9 is a diagrammatic isometric view showing the covering of the present invention in a fully extended position and with the vanes in an open position and further illustrating the control mechanisms for operating the covering.

It should also be appreciated that the intermediate rail 26 is designed and contoured to fit within the head rail 22 when the intermediate rail 26 is fully retracted regardless of whether or not the intermediate rail is horizontally oriented (FIG. 7) or vertically oriented (FIG. 8). This prohibits undesired light from passing between the head rail and intermediate rail when the intermediate rail is fully retracted.

Another embodiment of a covering 100 in accordance with the present invention is shown in FIGS. 19–28 to include a headrail 102, a bottom rail 104, and intermediate or midrail 106, a flexible fabric material or structure 108 extending between the intermediate rail and the bottom rail, and an intermediate rail operating or control cord 110 for controlling the movement of the intermediate rail. The control cord is operative to raise and lower the intermediate rail and also to tilt the intermediate rail about a longitudinal horizontal axis also included in the covering, and as will be described in more detail hereafter, is a counterbalance system 112 (FIG. 19A) primarily confined within the headrail for facilitating manual lifting or lowering of the bottom rail relative to the intermediate and head rails.

The headrail 102 is mountable to the framework of an architectural opening by a pair of bracket members 114 (FIGS. 19 and 20) in a conventional manner and as will be appreciated, the architectural opening could be a window, door, archway, or the like.

The fabric material 108 that extends between the intermediate rail 106 and the bottom rail 104 is comprised of front and rear vertically oriented horizontally spaced flexible sheets of material 116*f* and 116*r* (FIG. 22) such as sheer fabric, with the sheets being suspended from the intermediate rail and a plurality of vertically spaced, horizontally disposed slats or vanes 118 that extend between and are operatively connected to the sheets of material. While the slats could assume different forms, in the preferred embodiment, they too are a flexible fabric material which may be the same or different than the material from which the sheets are made. Preferably, the slats are opaque or translucent while the sheet material is transparent or translucent.

Figure 22:
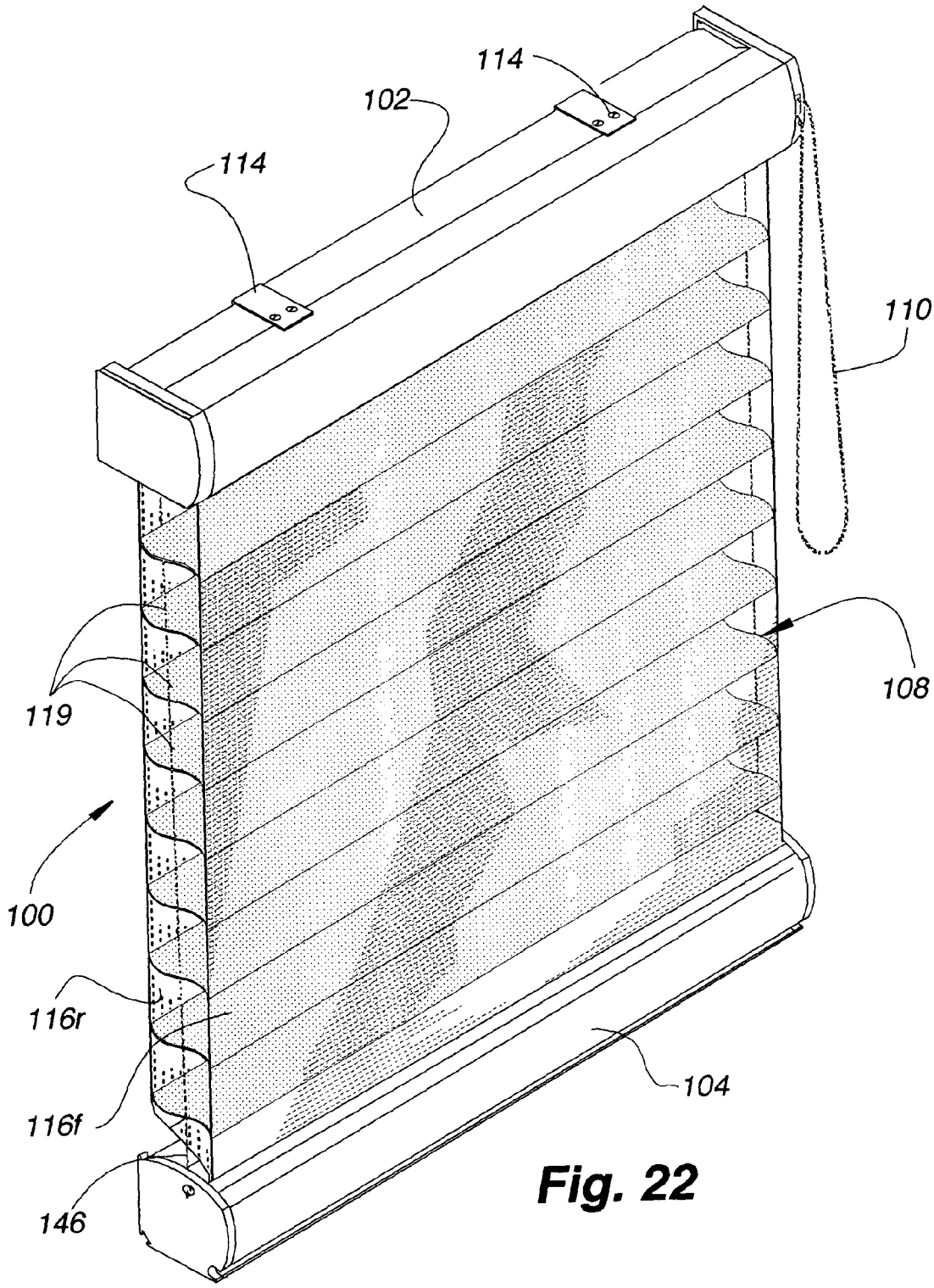
FIG. 22 is an isometric view similar to FIG. 21 with the bottom rail in a lowermost position, the intermediate rail in an uppermost position, and with the slats in an open position.
Figure 23:
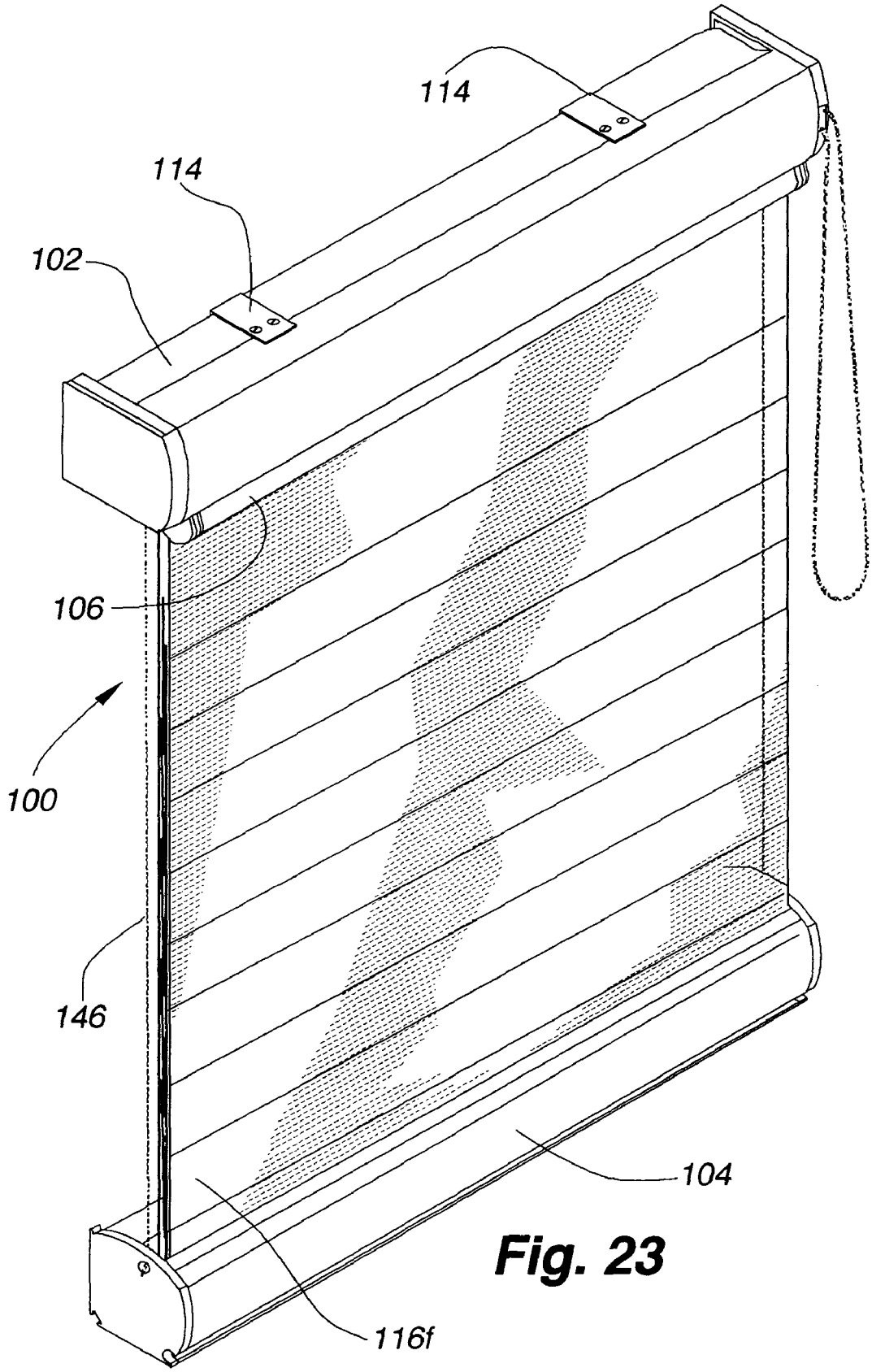
FIG. 23 is an isometric view similar to FIG. 22 except where the slats are in a closed position.
Figure 24:
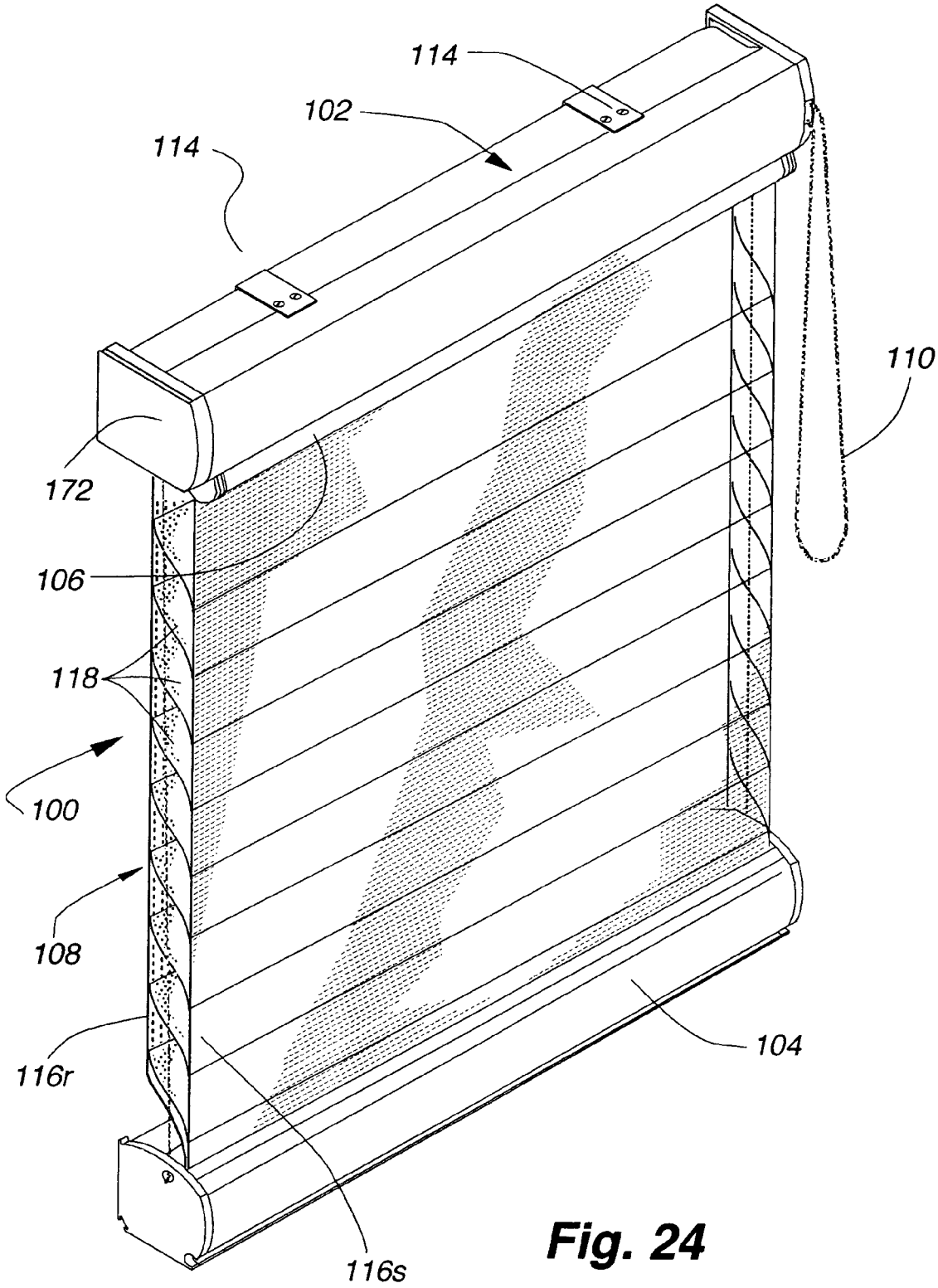
FIG. 24 is an isometric view similar to FIGS. 22 and 23 with the slats in a partially open position.

As will be appreciated with the operation of the covering to be described later, the fabric 108 is movable by the intermediate rail 106 between an open position as shown in FIG. 22, and a closed position as shown in FIG. 23. In the open position, the slats 118 can be seen to assume a substantially S-shaped, cross-sectional configuration and are disposed substantially horizontally so as to define a space between adjacent slats. This permits the passage of vision and light between the slats and since the sheet materials 116 along the opposite side edges of the slats are transparent or translucent, some degree of light and vision is permitted through the fabric material when the covering is in the open condition of FIG. 22.

In the closed condition of FIG. 23, the fabric sheets 116 have been shifted vertically in opposite directions relative to each other so that the slats 118 assume a substantially flat, vertical planar orientation with adjacent slats slightly overlapping to substantially block the passage of vision and light through the fabric. The slats could be tilted in an opposite direction to a second closed position (not shown) by moving the sheets of material 116 in the reverse opposite direction. Accordingly, the covering is movable between open and closed positions by shifting the fabric sheets in opposite vertical directions relative to each other as will be explained in more detail later.

The bottom rail 104, as will be explained in more detail later and as shown diagrammatically in FIG. 19A, includes an elongated rotatable roller or roll bar system 120 about which the fabric 108 can be wrapped or unwrapped with the roll bar being biased in a clockwise direction (as viewed in FIG. 19A) by a conventional internal roller spring system to be described later. The strength of the roller spring system is determined by factors which will become more apparent hereafter.

Figure 19:
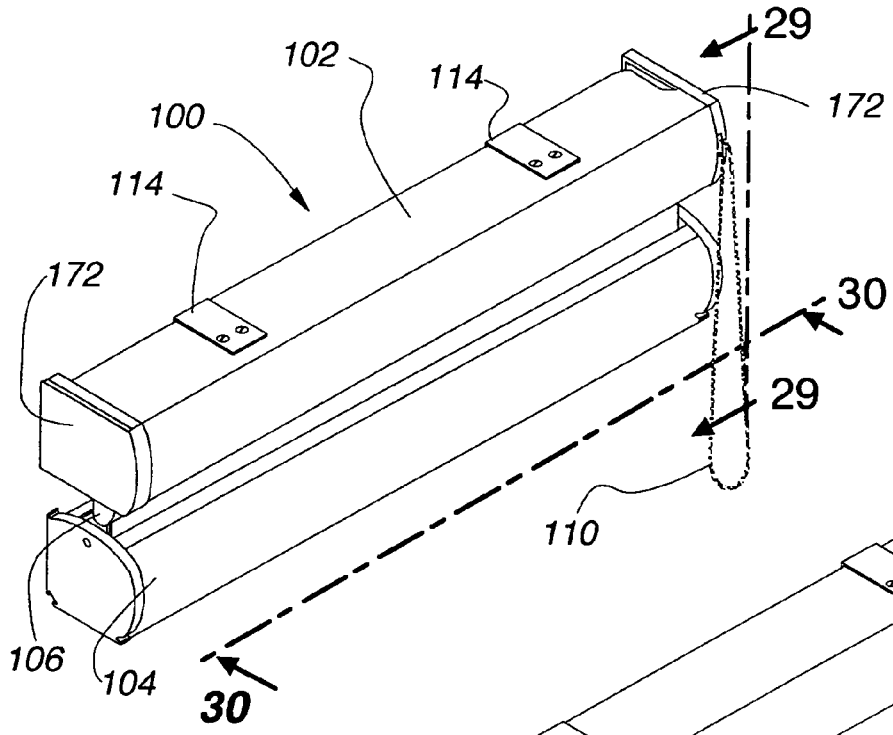
FIG. 19 is an isometric view of a second embodiment of the covering of the present invention in a fully retracted position.
Figure 19A:
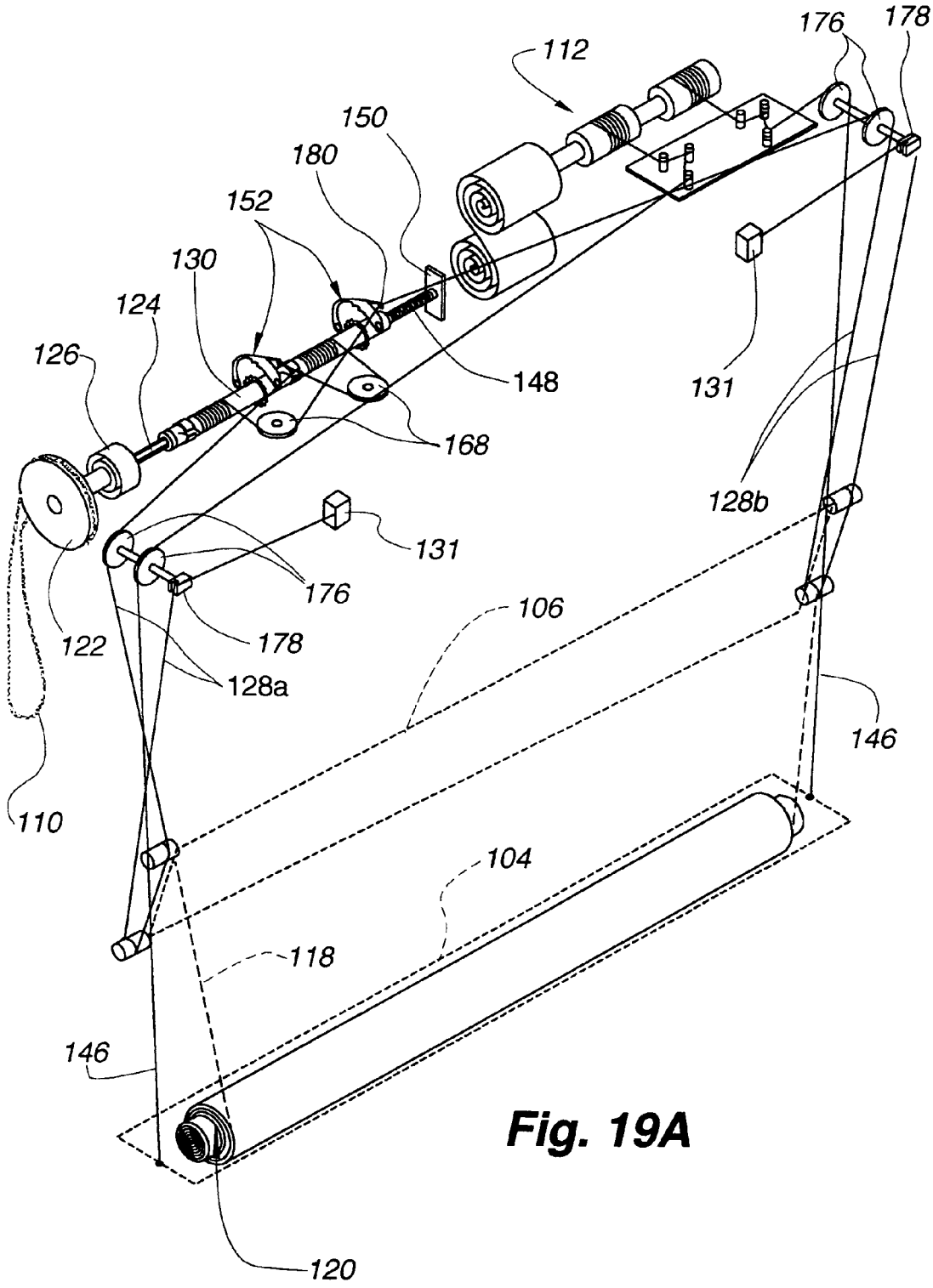
FIG. 19A is an isometric diagrammatic view of the operating mechanism for the covering of FIG. 19 of the present invention.

A control system for controlling movement of the intermediate rail 106 is shown diagrammatically in FIG. 19A and will be seen to include a pulley 122 at the left end of the headrail around which passes the endless control or pull cord 110 which is frictionally engaged with the pulley so as to move in unison therewith. The pulley is fixed to a horizontal drive shaft 124 of square cross section through a conventional two-way spring clutch 126 which prevents rotative movement of the drive shaft unless the pulley 122 is moved in one direction or the other by the endless pull cord. A pair of lift cords 128*a* and 128*b*, one associated and operatively connected to each end of the intermediate rail, are also operatively connected at one end to a spool 130 mounted on the drive shaft 124 for unitary rotation therewith, with the opposite end of each lift cord being anchored to the headrail with an anchor 131 at a predetermined location along the length of the headrail. The lift cords are adapted to be wound about or unwound from the spool by rotative movement of the pulley, and as will be appreciated, when the lift cords are wrapped onto the spool, the effective length of the lift cords is shortened thereby pulling upwardly on the intermediate rail 106. Of course the opposite occurs when the lift cords are unwound from the spool allowing the intermediate rail to drop downwardly by the force of gravity. Each end of the intermediate rail has a pair of longitudinally extending spacer pins 132 (FIGS. 54–57) adjacent each longitudinal edge 134*f* and 134*r* of the intermediate rail which are adapted to interact with the lift cords as will be described later.

Figure 58:
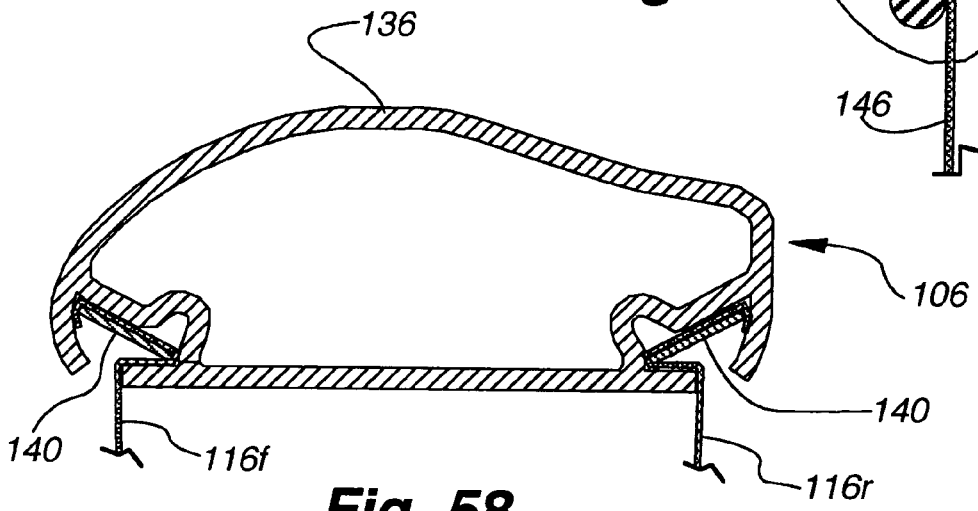
FIG. 58 is an enlarged fragmentary section taken along line 58—58 of FIG. 17.
Figure 59:
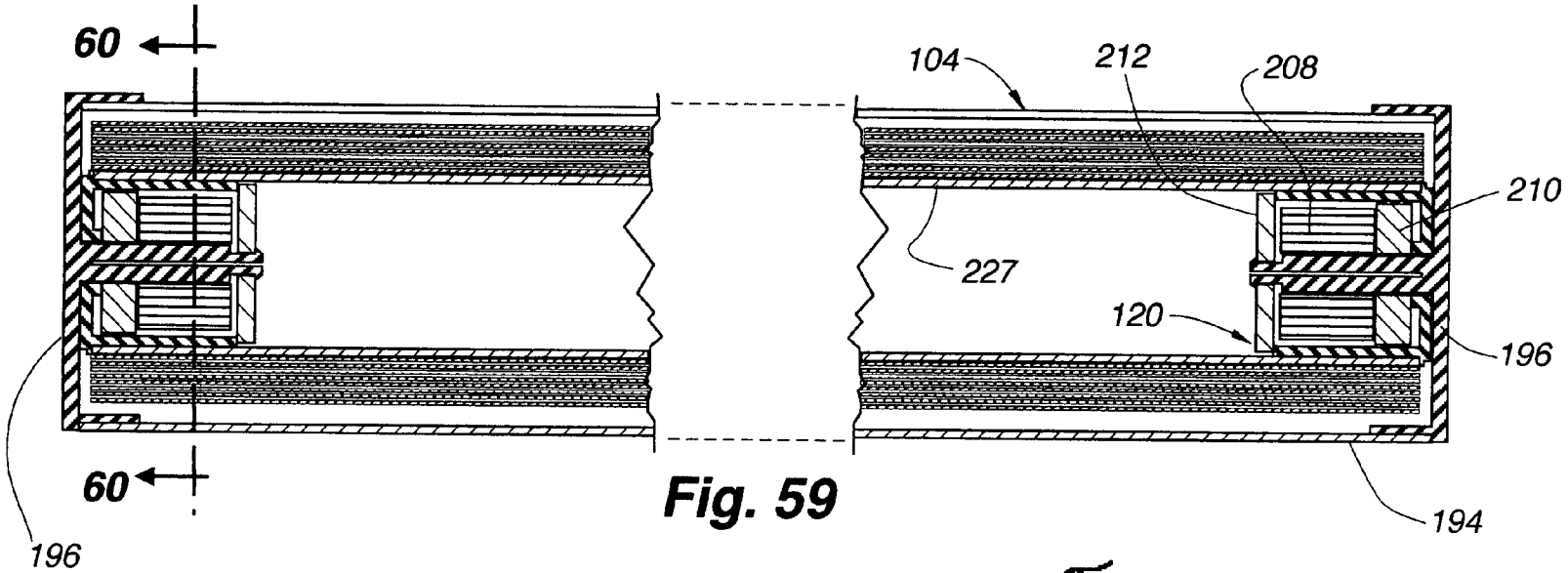
FIG. 59 is an enlarged section with portions removed taken along line 59—59 of FIG. 17.
Figure 60:
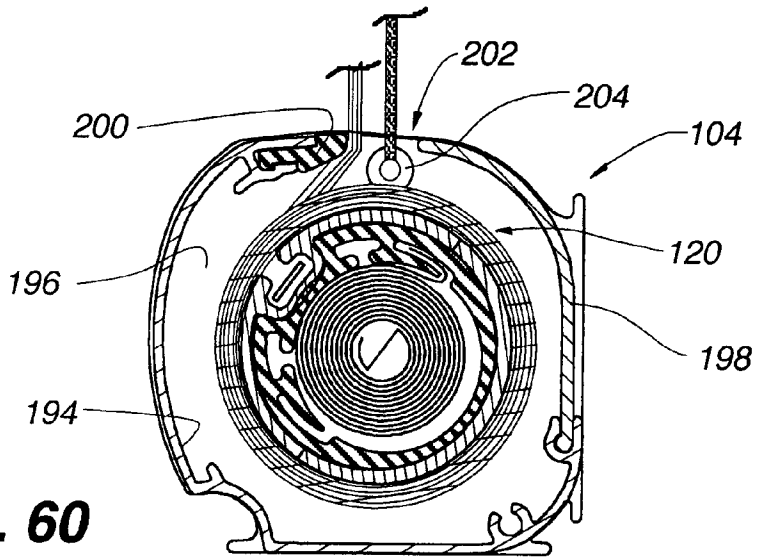
FIG. 60 is an enlarged section taken along line 60—60 of FIG. 59.
Figures 60A, 60B:
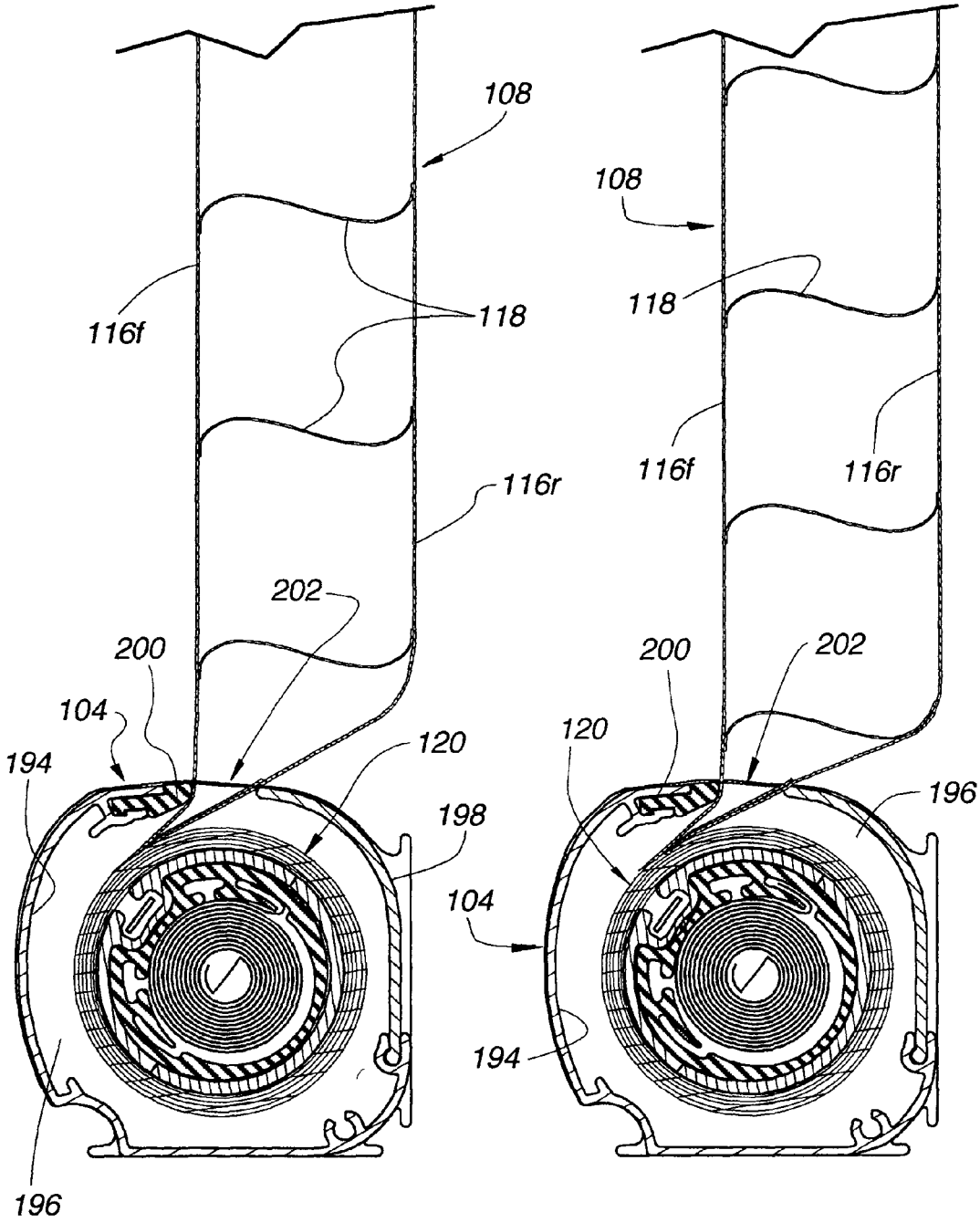
FIGS. 60A and 60B are sections similar to FIG. 60 showing the opening of the fabric material as it is removed from the bottom rail.
Figure 77:
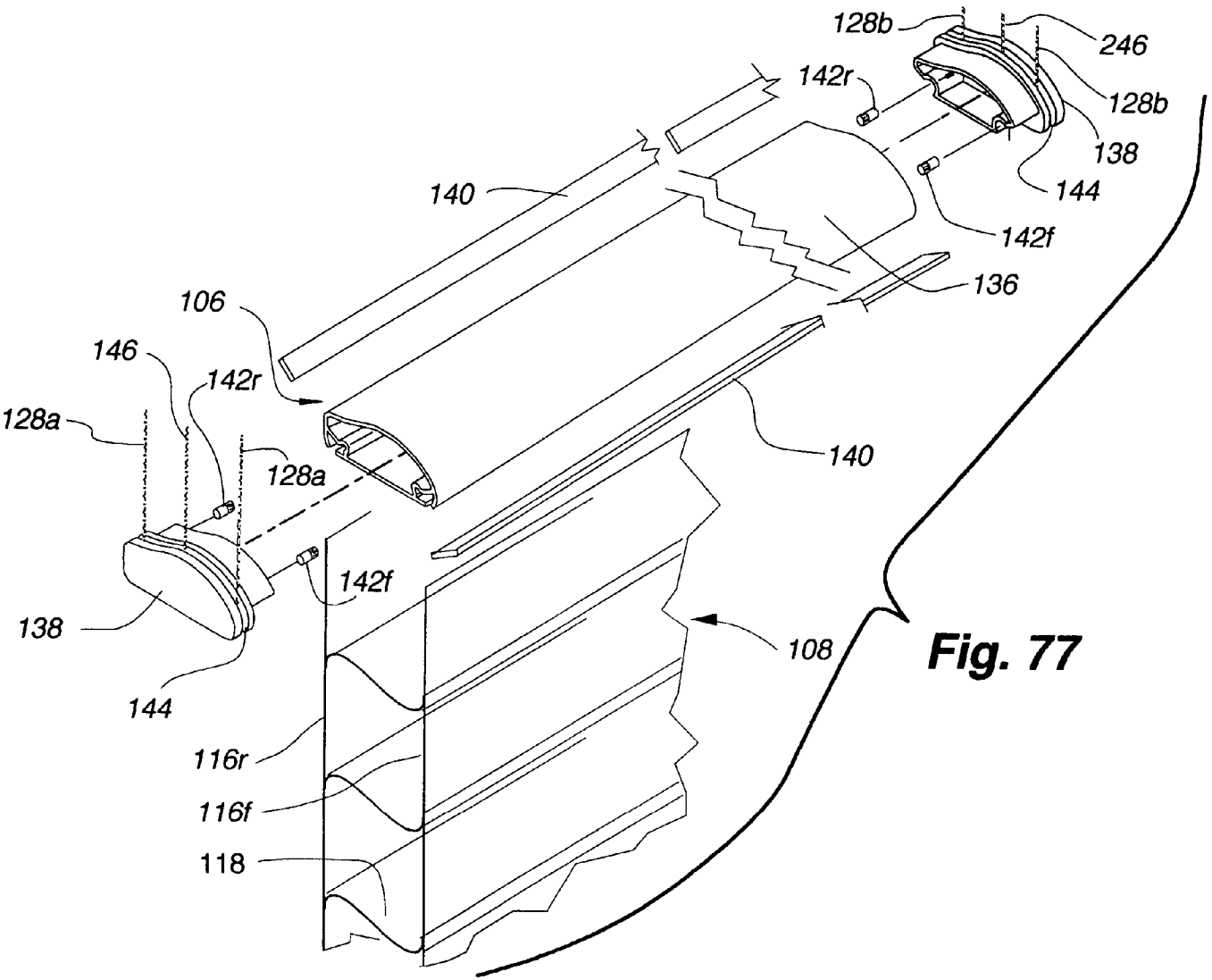
FIG. 77 is an exploded fragmentary isometric illustrating the intermediate rail and its connection to the lift cords and the fabric of the covering of the embodiment of FIG. 19.
Figure 78:
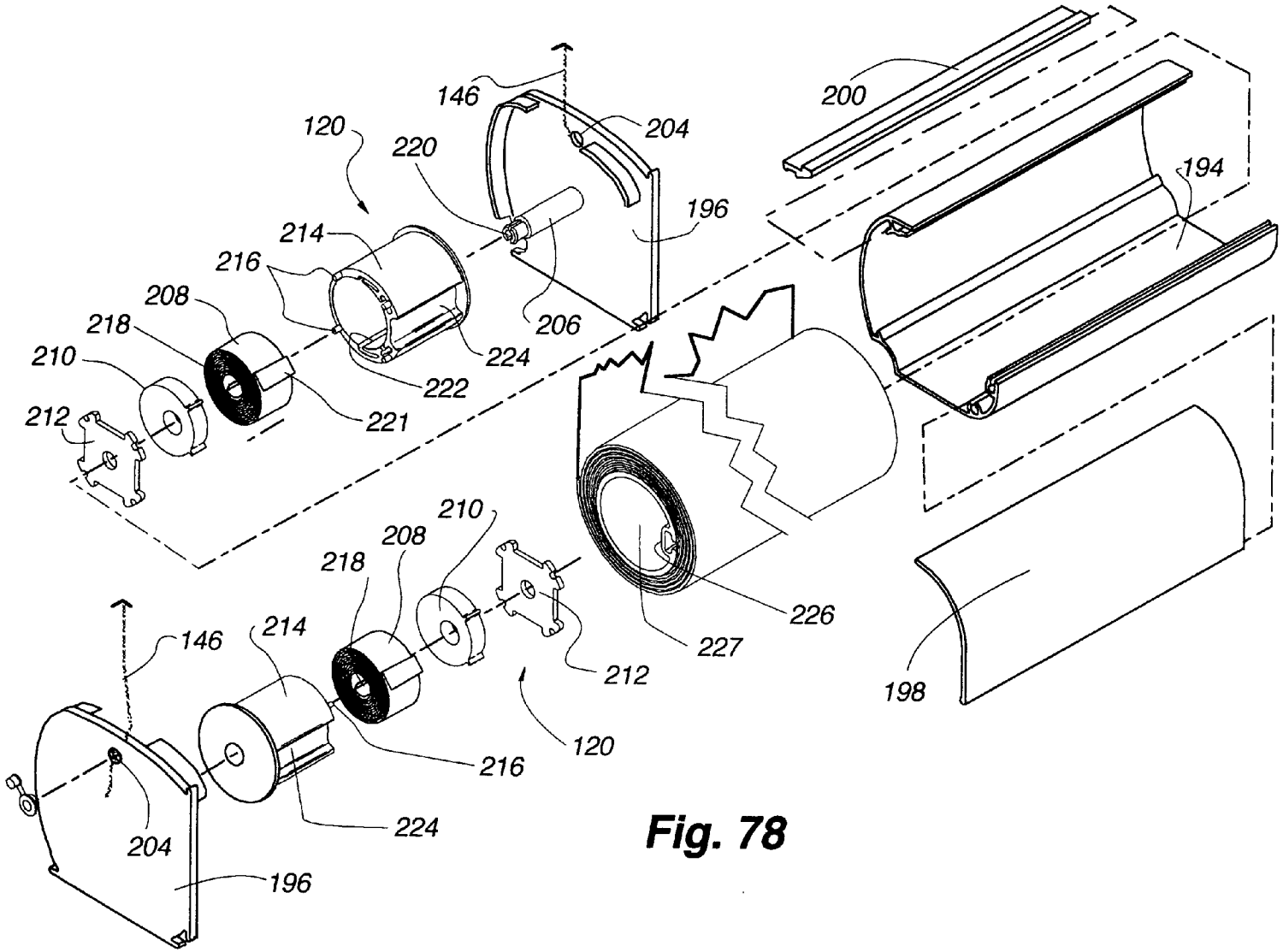
FIG. 78 is an exploded fragmentary isometric illustrating the components of the bottom rail of the covering of FIG. 19.

As will be appreciated by reference to FIG. 77, the intermediate rail 106 has a relatively flat main body 136 of ovular cross-section that is hollow in construction and has end caps 138 in opposite ends thereof. The end caps are rigid in nature and can be made of any suitable material such as plastic and serve partially to provide closure to the open ends of the ovular body. The ovular body needs to be somewhat rigid so as to support the fabric 108 and in particular, the front sheet 116*f* of the fabric is supported from the front edge 134*f* of the intermediate rail while the rear sheet 116*r* of the fabric is supported from the rear or back edge such as by inserting the top edges of the front and back sheets in preformed grooves in the main body and securing the edges therein with anchor strips 140 (FIG. 58). The end caps are releasably secured in the open ends of the main body with friction pins 142*f* and 142*r* which are associated with the front and rear edges of the intermediate rail and confined within grooves defined in the main body 136 and each end cap 138 (FIG. 77).

Each end cap 138, as best seen in FIGS. 54–58 and 77 is provided with a transverse slot 144 bridged by the pair of spacer pins 132 and the friction pins 142*f* and 142*r* which are generally positioned adjacent to the front and rear edges respectively of the intermediate rail. Each lift cord 128*a* and 128*b* passes into the slot 144 (FIG. 55) in its associated end cap and is wrapped once around each friction pin before returning upwardly with one end of the lift cord being anchored to the anchor 131 as mentioned previously and the other end of the cord to the spool 130. Each lift cord descending from the spool is first wrapped around the friction pin 142*f* adjacent to the front edge 134*f* of the intermediate rail 106 and subsequently around the friction pin 142*r* at the rear edge 134*r* of the intermediate rail before returning upwardly and being secured to the anchor 131.

Figure 54:
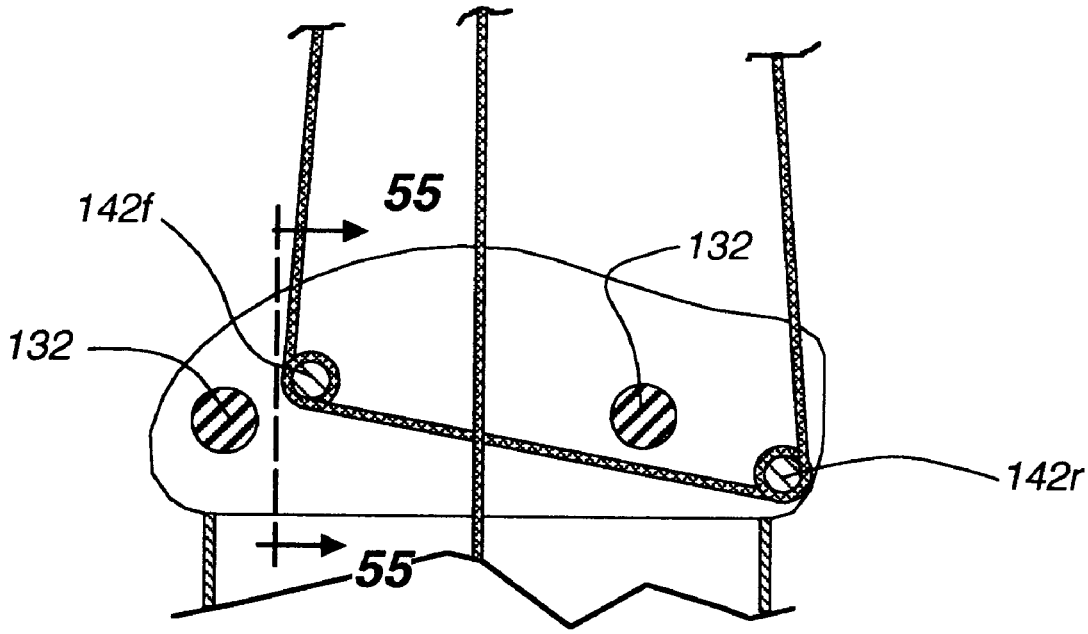
FIG. 54 is an enlarged fragmentary section taken along line 54—54 of FIG. 17.
Figure 55:
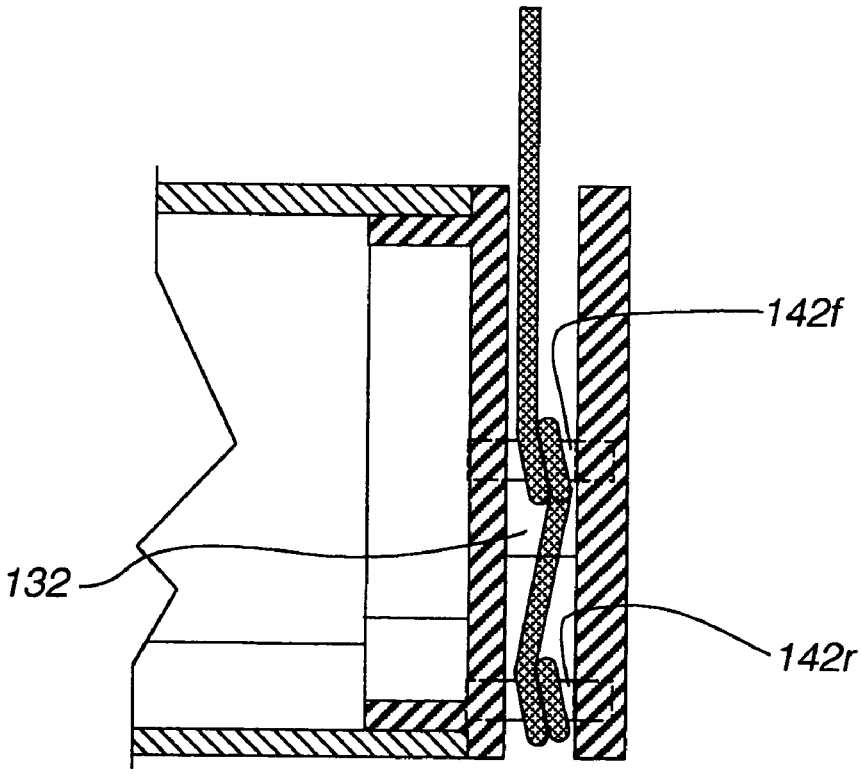
FIG. 55 is an enlarged fragmentary section taken along line 55—55 of FIG. 54.
Figure 56:
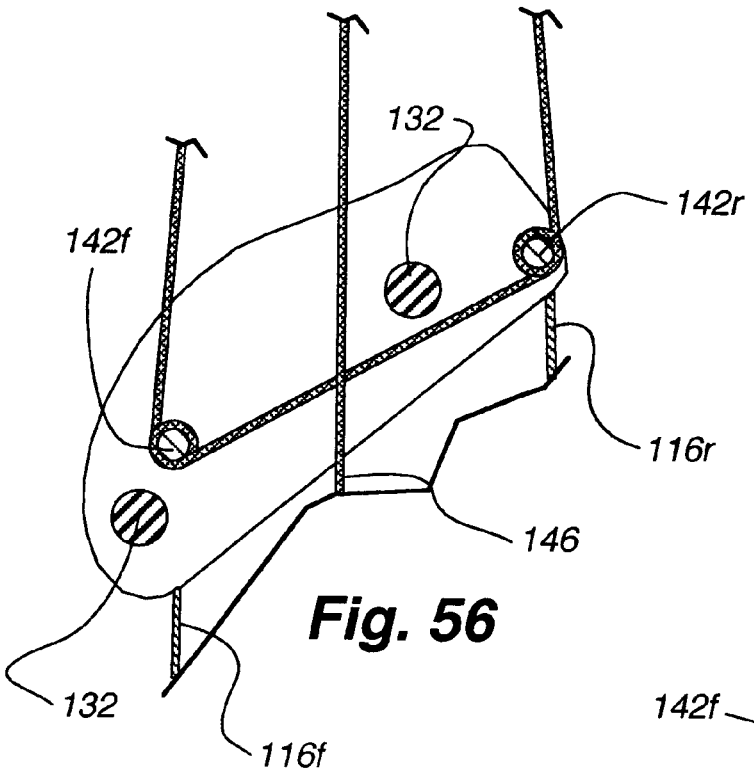
FIG. 56 is a section similar to FIG. 55 with the intermediate rail in a partially closed position.
Figure 57:
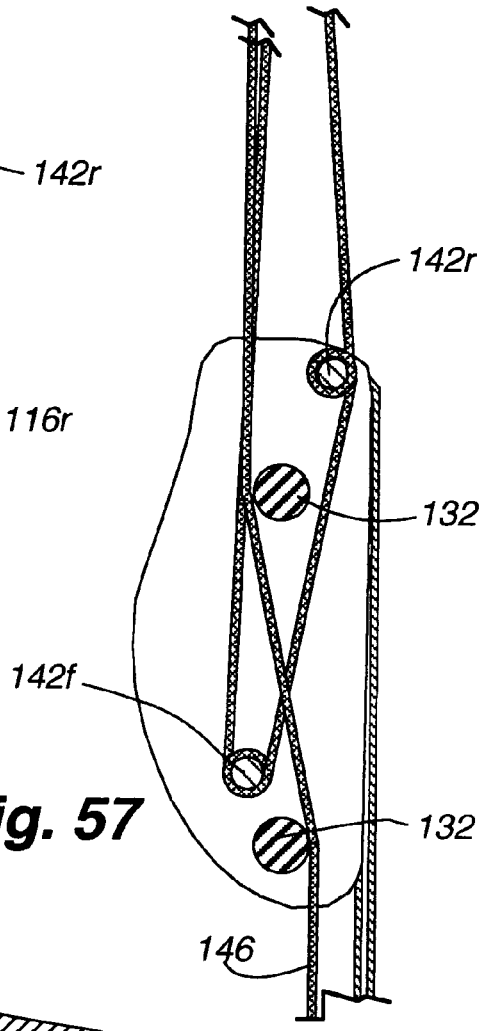
FIG. 57 is a fragmentary section similar to FIGS. 55 and 56 with the intermediate rail in a fully closed position.

The effect of the lift cords 128*a* and 128*b* on the intermediate rail 106 is best illustrated by reference to FIGS. 54–57 with FIG. 54 illustrating the intermediate rail in a horizontal or open position such that each of the slats 118 in the fabric 108 suspended therefrom is also horizontally disposed and in an open condition. As will be appreciated, if the lift cords are unwound from the spool 130 with the intermediate rail positioned as in FIG. 54, there will be excess cord extending from the spool to the front edge 134*f* of the intermediate rail thereby allowing the front edge of the rail to drop by gravity so that the intermediate rail passes through a partially open position illustrated in FIG. 56 and finally into a closed position as shown in FIG. 57. Further pivotal movement of the intermediate rail is prevented by engagement of the lower spacer pin 132 (i.e. the spacer pin closest to the front edge of the intermediate rail) engaging a bottom rail lift cord 146 that extends from the headrail 102 to the bottom rail 104 as will be described in more detail later.

It will therefore be appreciated that if the intermediate rail lift cords 128*a* and 128*b* are further unwound from the spool 130, the tension on the cords will loosen where it passes around each friction pin 142*f* and 142*r* thereby allowing the cord to slip relative to the friction pins and through gravity and the weight of the intermediate rail, the intermediate rail is allowed to move or drop downwardly while in the closed vertically oriented position of FIG. 57. As the intermediate rail moves downwardly, the fabric structure connected thereto is gathered in the bottom rail 104 where it is wrapped around the roll bar as the bias on the roll bar 120 encourages wrapping of the fabric thereabout.

Figure 21:
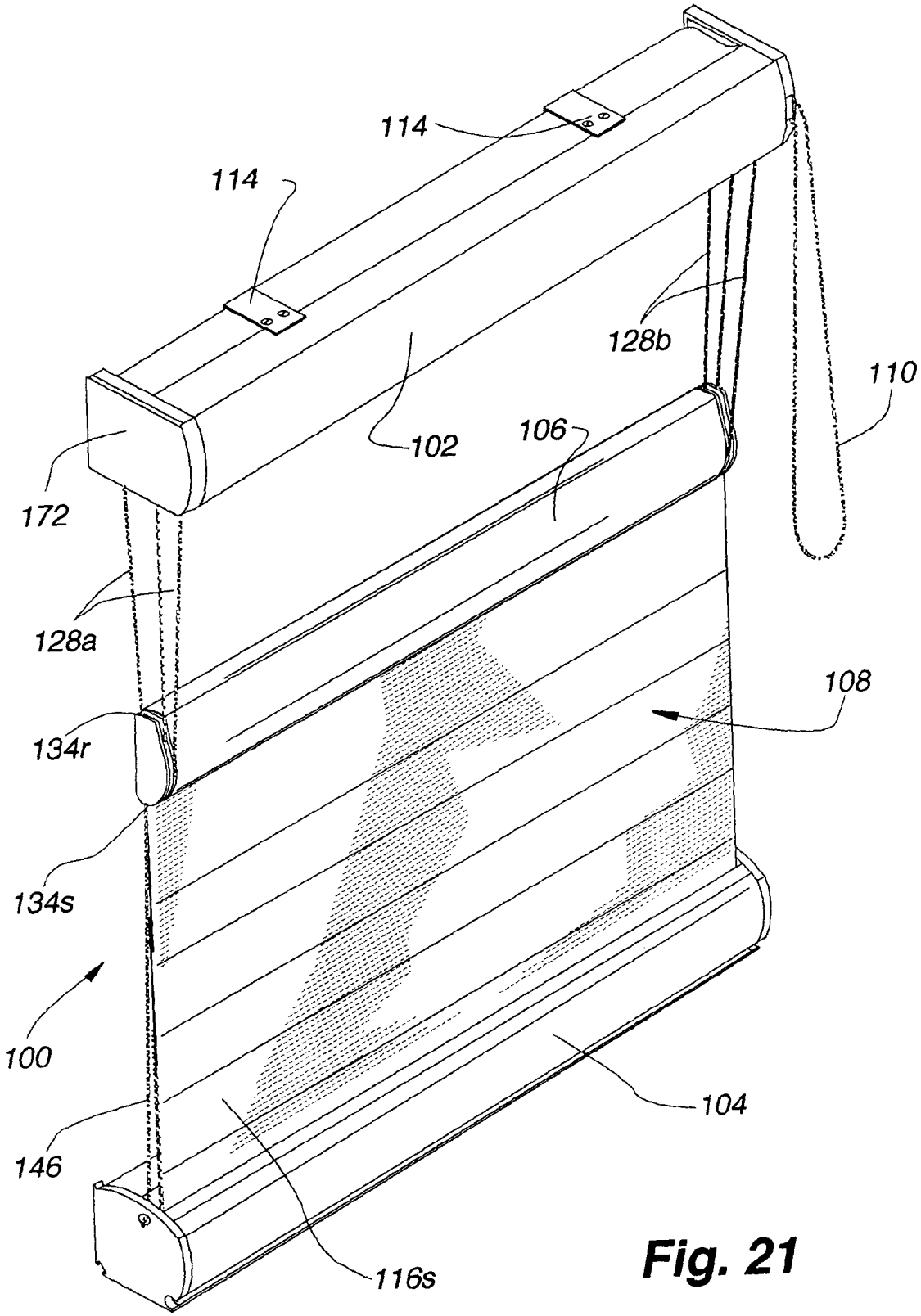
FIG. 21 is an isometric view of the covering of FIG. 19 of the present invention with the bottom rail in its lowermost position and with the intermediate rail at an intermediate position between the headrail and bottom rail and with the slats in a closed position.

If the intermediate rail lift cords 128*a* and 128*b* are moved in the opposite direction as is caused when the lift cords are wound about the spool 130, tension is placed in the lift cords due to an effective shortening of the cords between the friction pins 142*f* near the front edge of the intermediate rail and the spool. The lift cords thereby grab the associated friction pins 142*f* causing the pins adjacent to the front edge of the intermediate rail to pivot upwardly relative to the friction pins adjacent to the back edge until the intermediate rail pivots past the horizontal position of FIG. 54 to a substantially vertical position as shown in FIG. 21, for example, at which point the intermediate rail is lifted upwardly thereby carrying the fabric structure therewith.

As mentioned previously, the intermediate rail lift cords 128*a* and 128*b* associated with the spool 130 are manipulated by the endless control cord 110 and through the drive shaft 124 having the two-way clutch 126 thereon. The two-way clutch, which will be described in more detail later, prevents rotation of the drive shaft in either direction when the control cord is not being pulled so that it retains the intermediate rail at the position it occupied when the control cord was last pulled. It will therefore be appreciated that the intermediate rail can be positioned anywhere between the fully retracted position of FIGS. 19, 22, and 23 and the fully extended position of FIG. 20.

Figure 45:
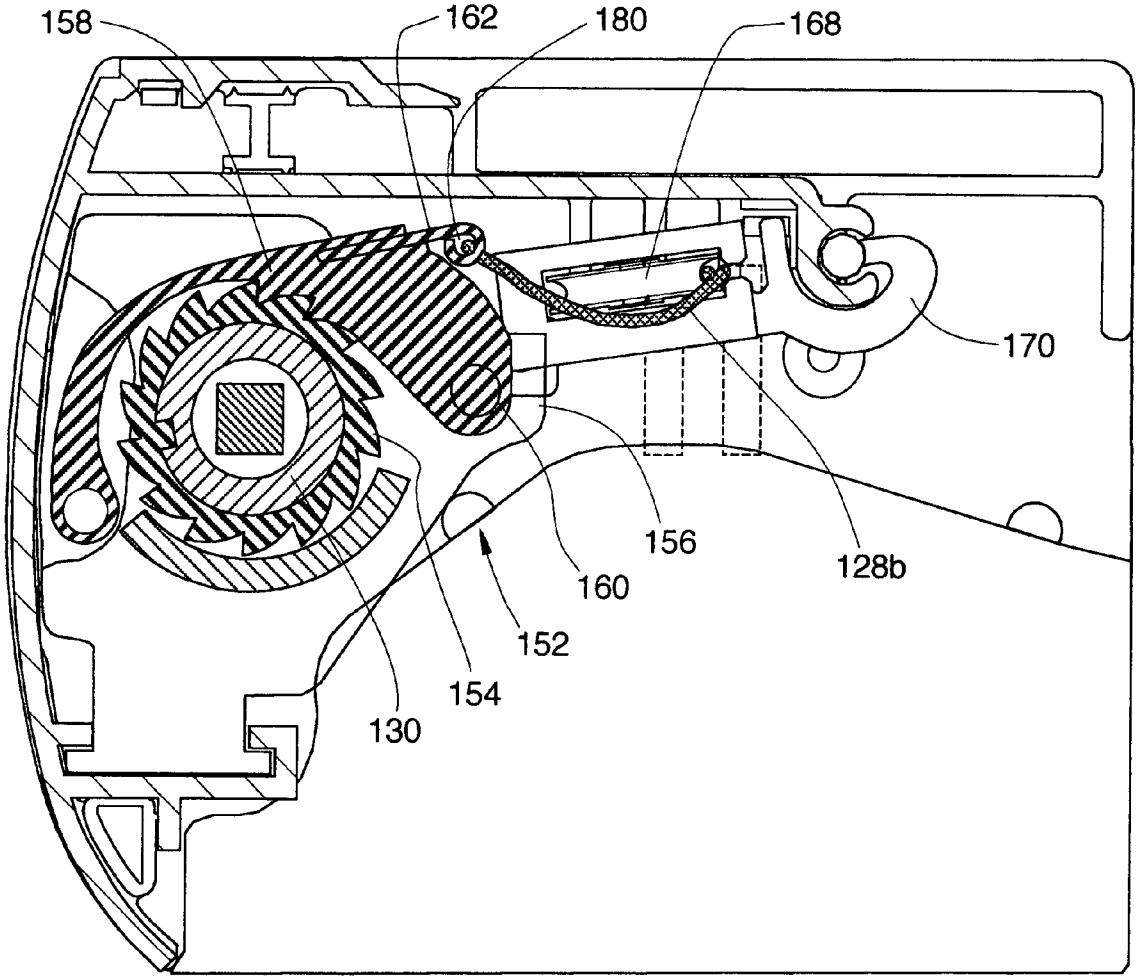
FIG. 45 is an enlarged section taken along line 45—45 of FIG. 37.

With reference to FIGS. 19A, 34, 37, 38, 45 and 56, it will be appreciated that the drive shaft 124 extends from the two-way clutch 126 horizontally along the length of the headrail with its innermost end axially slidably seated in the spool 130. The innermost end of the spool is supported on a fixed threaded bearing shaft 148 supported on a bracket 150 mounted on the headrail 102 at a fixed location. The drive shaft supports for unitary rotation therewith the elongated spool which has an internal passage of square cross section adapted to mate with the drive shaft so as to rotate in unison therewith while the threaded bearing shaft is threadedly mated with an axial hole 151 in the inner end of the spool so that the spool is caused to slide linearly axially along the drive shaft as it is rotated by the drive shaft and shifted longitudinally by the threaded bearing shaft. A pair of pawl brake devices 152 are mounted in the headrail in surrounding relationship with the spool 130 so as to define two finite areas along the length of the spool around which the lift cords 128*a* and 128*b* associated with each end of the intermediate rail 106 can be wrapped or unwrapped. As probably best appreciated by reference to FIGS. 45 and 46, the pawl brake devices each include a circumferential tooth ring 154 that is seated on the spool 130 and keyed thereto for unitary rotation therewith. Each pawl device further includes a mounting base 156 on which a trigger arm 158 is pivotally mounted on a shaft 160 with the trigger arm including a catch finger 162 that cooperates with an associated lift cord 128*a* or 128*b* in moving the trigger arm into and out of engagement with the tooth ring. As will be appreciated, the trigger arm has a pair of notches 164 formed therein that engage with the teeth on the ring 154 to prevent rotation of the ring when the trigger arm is pivoted counterclockwise to its fullest extent as seen in FIG. 45. When the trigger arm is pivoted clockwise to its fullest extent as viewed in FIG. 46, the teeth are disengaged from the trigger arm thereby allowing the spool to rotate. The pawl brake devices are fixed at a predetermined location along the length of the headrail in any suitable manner and the trigger arms are biased into engagement with the tooth ring by a spring that is not seen.

Figure 44:
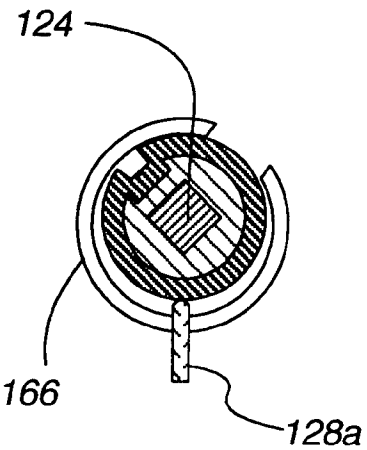
FIG. 44 is a section taken along line 44—44 of FIG. 42.
Figure 42:
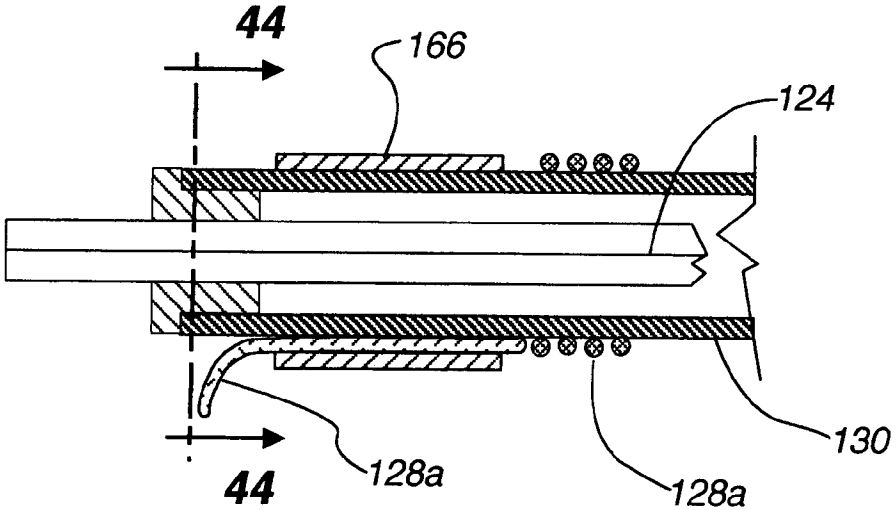
FIG. 42 is an enlarged fragmentary section taken along line 42—42 of FIG. 36.
Figure 43:
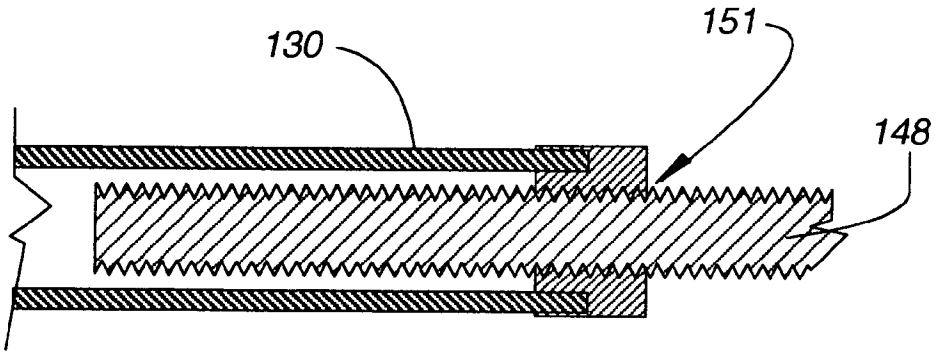
FIG. 43 is an enlarged fragmentary section taken along line 43—43 of FIG. 36.
Figure 46:
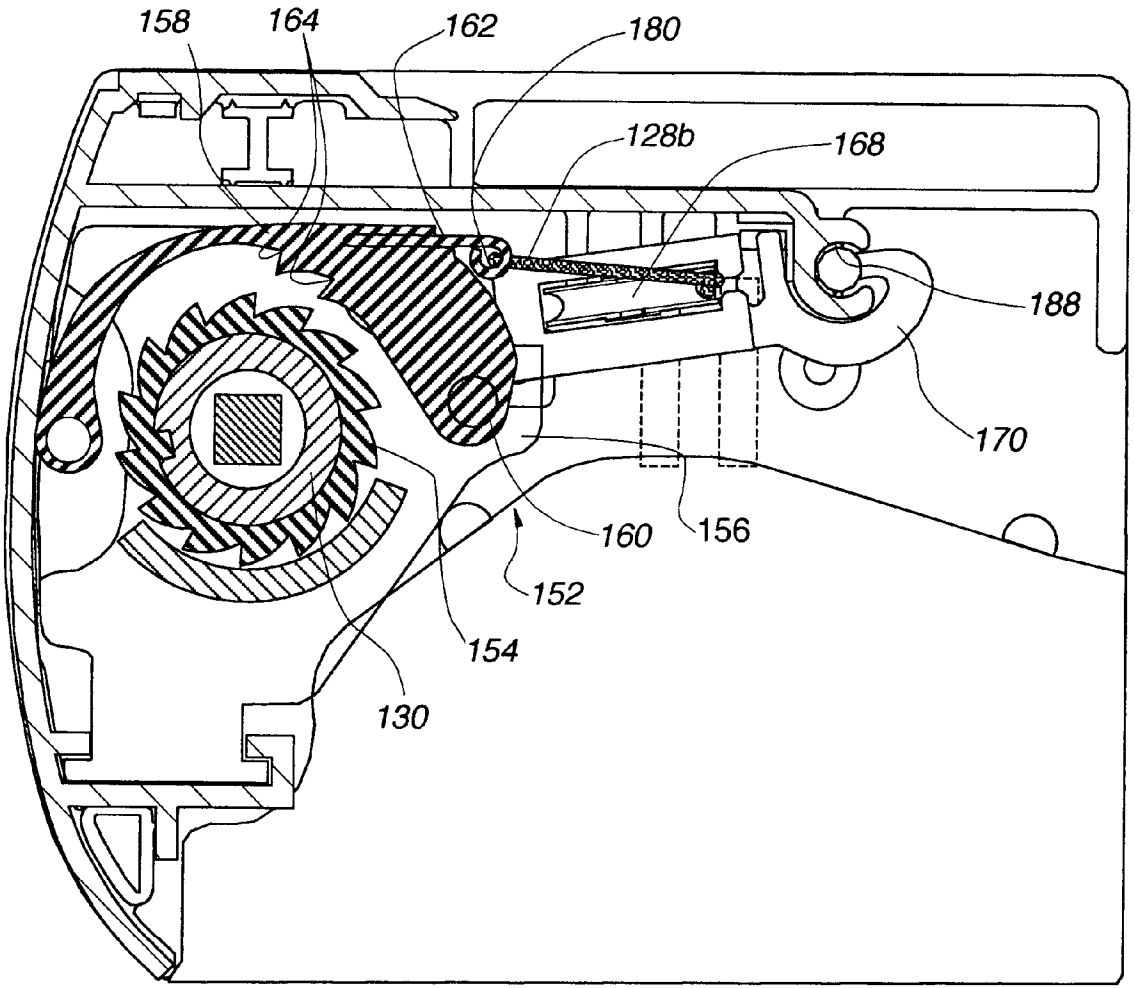
FIG. 46 is an enlarged section taken along line 46—46 of FIG. 38.
Figure 49:
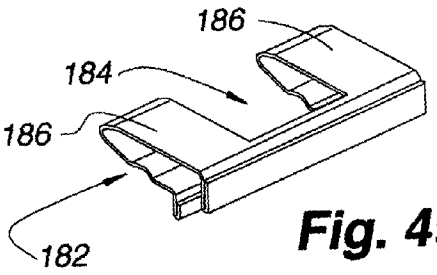
FIG. 49 is an isometric view of the clip shown in FIG. 48.

With reference to FIGS. 42 and 44, the end of each lift cord 128*a* and 128*b* associated with the spool 130 is anchored to the spool with a C-shaped spring clip 166 that passes around the spool pinching the end of the lift cord between the clip and the outer surface of the spool. Each clip is positioned on the spool at a position along the length of the spool that is approximately aligned laterally with a pulley 168 mounted on a bracket 170 secured to the rear edge of the headrail 102 through a tongue-in-groove connection as best seen in FIGS. 45 and 46.

Figure 39:
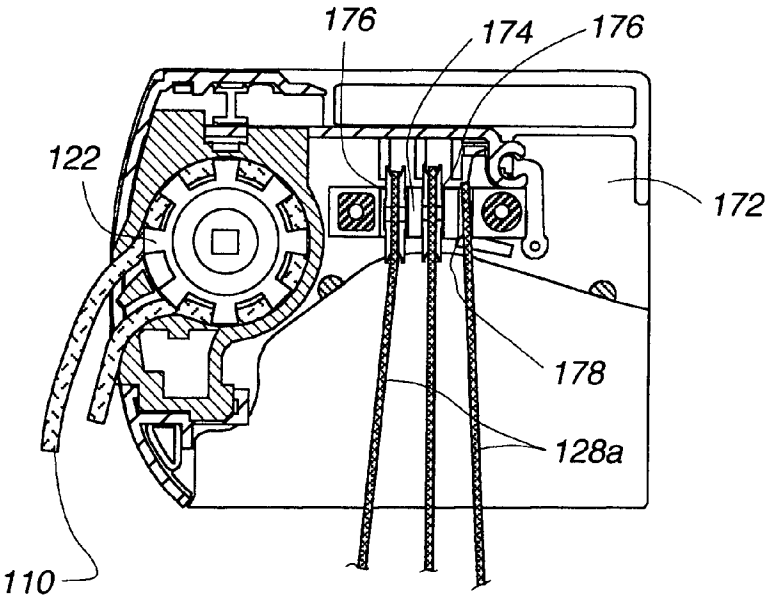
FIG. 39 is an enlarged fragmentary section taken along line 39—39 of FIG. 30.

The headrail 102 has end caps 172 at opposite ends thereof with each end cap having a bracket 174 as best illustrated in FIG. 39 with a pair of equal-sized guide pulleys 176 mounted thereon for rotation about a transverse horizontal axis and a groove 178 for slidably receiving an intermediate rail lift cord 128*a* or 128*b* adjacent to the associated guide pulley 176. As is probably best appreciated by reference to FIGS. 19A, 34, 37, and 38, each lift cord is extended from the anchor 131 through the groove 178, downwardly around the friction pin 142*r* near the rear edge 134*r* of the intermediate rail, subsequently around the friction pin 142*f* near the front edge 134*f* of the rail, then upwardly and around one of the guide pulleys 176, then horizontally through a loop 180 on the catch finger 162 of an associated trigger arm 158, around the pulley 168, and then down to the spool 130 adjacent to the C-clip 166 which secures the cord to the spool. As will be appreciated, the side of the pulley 168 from which the lift cord extends toward the spool is tangentially aligned with the spool and the lift cord is fed to the spool at a constant location relative to the length of the headrail 102.

As mentioned previously, rotation of the spool as effected by movement of the control cord 110 causes the spool 130 to shift or slide axially along the drive shaft 124 due to the threaded mounting of the spool on the bearing shaft 148 so that as lift cord is wound about the spool, it is laid in a smooth helical pattern and does not overlap previously laid wraps of the cord. Similarly, when the spool is rotated in an opposite direction to unwind the lift cord from the spool, it is continually fed tangentially to the pulley 168 as the spool is shifted linearly by the threaded connection to the bearing shaft. It will also be appreciated by reference to FIGS. 37, 38, 45 and 46, that the pulley 168 is mounted horizontally rearwardly of the trigger arm 158 and by reference to FIGS. 37 and 38, the guide pulleys 176 are also mounted horizontally rearwardly of the trigger arm so that when tension is placed in a lift cord 128*a* or 128*b*, the trigger arm is pulled rearwardly and pivoted in a clockwise direction from the position of FIG. 45 to the position of FIG. 46. Oppositely, when tension is relieved from a lift cord, the spring bias on the trigger arm causes it to pivot counterclockwise allowing the trigger arm to engage the teeth on the ring 154 and prevent further rotation of the spool. It will therefore be appreciated that when the control cord 110 is pulled in either direction thereby placing tension in the associated lift cords, the pawl brake devices are released allowing the spool to rotate. Of course, as previously mentioned, movement of the control cord also releases the spring clutch 126 to permit rotation of the spool so that the lift cords can be wrapped around or unwrapped from the spools freely. When the control cord is not being pulled, the two-way clutch, in a conventional manner, prevents rotation of the spool 130 even though tension is still retained in the lift cords due to the weight of the intermediate rail 106 so that the brake devices 152 remain disengaged. If, however, the intermediate rail was moved downwardly until it engaged the bottom rail 104 as seen for example in FIG. 20, and the covering was not properly strung so that there was excess lift cord that would continue to unwrap from the spool as the control cord 110 was being pulled, slack would develop in the lift cord as the weight of the intermediate rail would no longer be pulling on the lift cords. The slack in the lift cord would allow the brake devices to activate thereby preventing the spool from further rotating and the lift cords from becoming raveled in a condition to which they might tangle thereby preventing the covering from working properly. Accordingly, the pawl brake devices are provided in the event the covering is not properly strung. When properly strung, the ends of the lift cords connected to the spool are fully unwrapped when the intermediate rail first engages the bottom rail in the lowermost position of the bottom rail.

Figure 50:
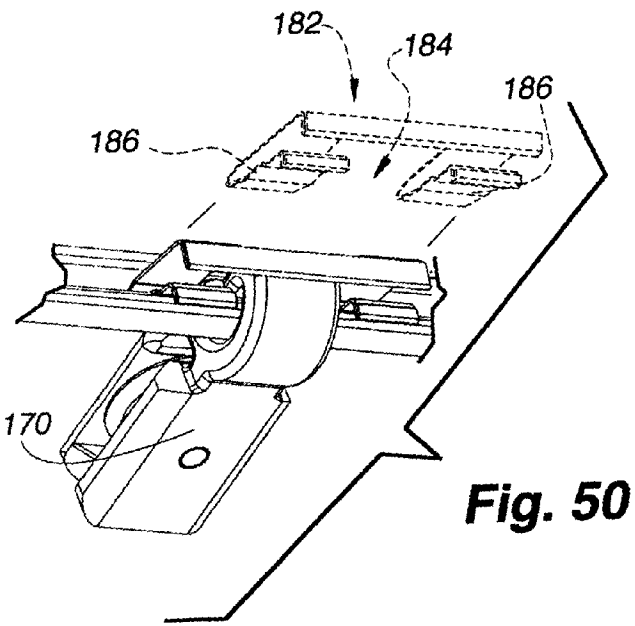
FIG. 50 is a fragmentary isometric showing the clip as it connects the movable pulley to the headrail.
Figure 47:
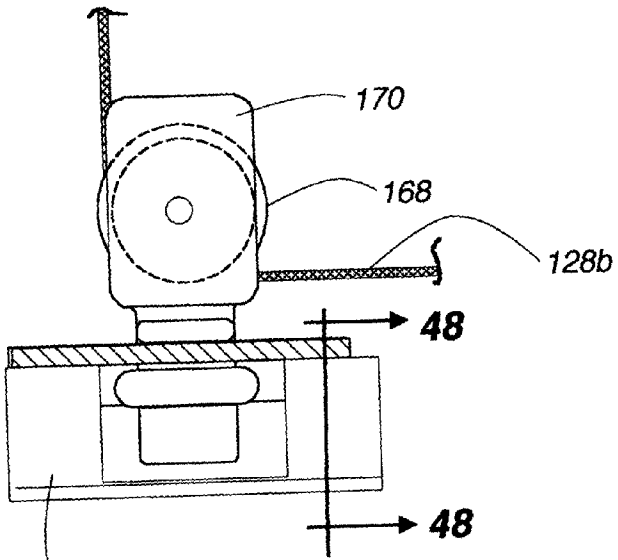
FIG. 47 is an enlarged section taken along line 47—47 of FIG. 38.
Figure 48:
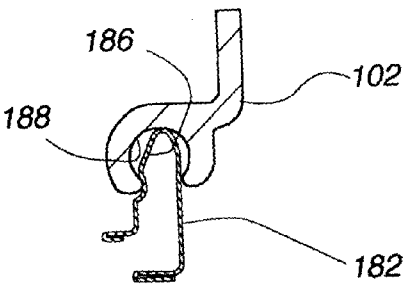
FIG. 48 is a section illustrating the interconnection of a clip for mounting a slidable pulley to the headrail.

The pulley 168 is secured to the rear edge of the headrail with a clip 182 as seen best in FIGS. 48 and 50. The clip has a notch 184 formed therein for straddling the bracket 170 on which the pulley is mounted and spring fingers 186 that are inserted into a groove 188 formed in the rear edge of the headrail so that the clip is snap-fit therein as best seen in FIG. 48. The clip thereby positively positions the pulley along the length of the head rail at a location that is predetermined to be in approximate alignment with the C-clip used to secure the end of the lift cord to the spool when the intermediate rail is in its lowermost position of FIG. 20.

Figure 52:
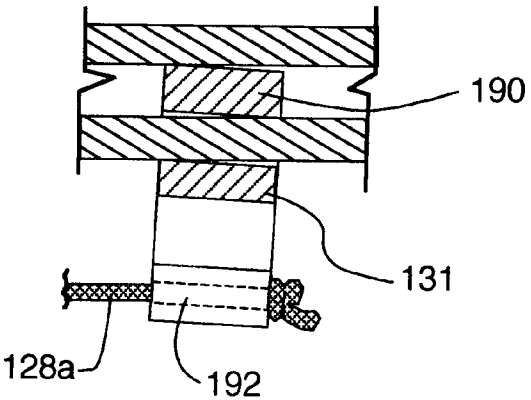
FIG. 52 is a fragmentary section taken along line 52—52 of FIG. 51.
Figure 53:
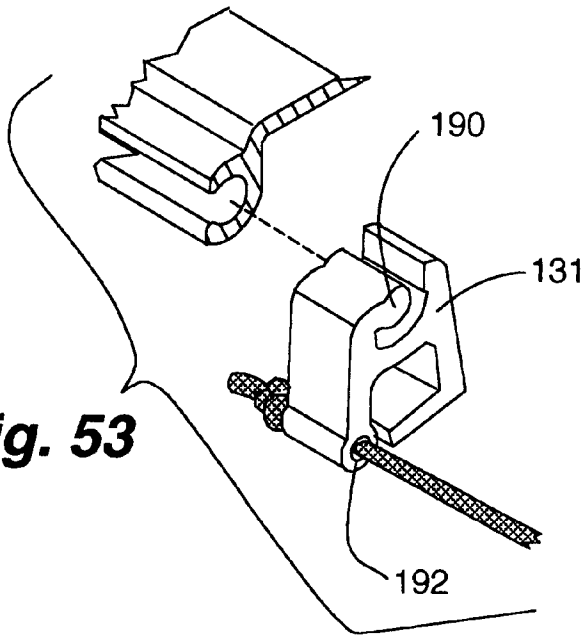
FIG. 53 is an exploded fragmentary isometric showing the connection of an anchor to the headrail.
Figure 51:
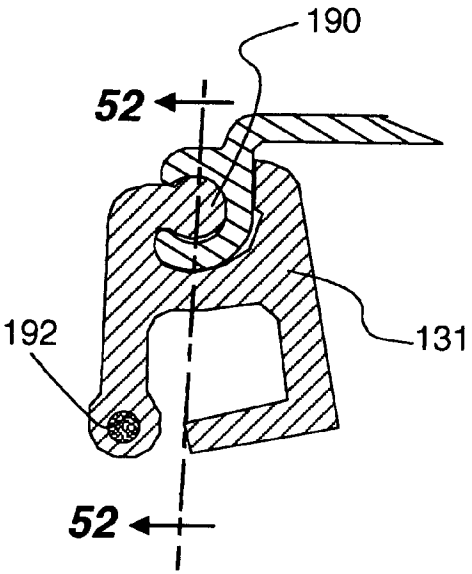
FIG. 51 is an enlarged fragmentary section taken along line 51—51 of FIG. 36.

By reference to FIGS. 51–53, the anchor 131 can be seen to comprise a body having a beaded finger 190 adapted to be slid along the groove 158 in the rear edge of the headrail until it is properly positioned. The anchor becomes wedged in the groove as illustrated in FIG. 52 when tension is placed on the associated lift cord 128*a* or 128*b* that is anchored thereto. The cord is connected to the anchor by extending the cord through a hole 192 in the anchor and knotting the cord on its end to prevent its removal. When properly stringing the covering, the intermediate rail 106 can be positioned in engagement with the bottom rail 104 and with each intermediate lift cord 128*a* and 128*b* fully unwrapped from the spool 130 and then sliding the anchor 131 along the length of the headrail until initial tension is placed in the lift cord. As mentioned previously, if the anchor is not positioned properly to place initial tension in the lift cord, the associated pawl brake device 152 will prevent unraveling in the system that might otherwise inhibit proper operation of the covering.

Referring to FIGS. 59, 60, 60A, 60B and 78, the bottom rail 104 can be seen to include an elongated open-topped, channel-shaped member 194 having friction-fit end caps 196 at opposite ends, a removable top plate 198 and a low friction strip 200. The top plate 198 and strip 200 are removably connected to the channel shaped member to define a slot 202 along the top of the bottom rail through which the fabric 108 can pass. The slot 202 is generally centered in the top of the head rail for a purpose to be described later. Each end cap includes an aperture 204 near its top edge to which an associated bottom rail lift cord 146 from the counterbalance system 112, to be described later, is attached. As mentioned previously, the bottom rail houses the roll bar system 120 about which the fabric structure 108 can be wrapped and unwrapped and the roll bar is biased in a counterclockwise direction as viewed in FIG. 78 or in a clockwise direction as viewed in FIG. 60.

Each end cap 196 has an inwardly directed axially extending shaft 206 adapted to support a coil spring 208, a spacer disk 210, and a lock plate 212. The spring and the spacer disk are disposed within a bearing sleeve 214 while the lock plate is adapted to be snap fit onto the inner end of the bearing sleeve by pins 216 received in notches provided in the lock plate. The coil spring has an inner tang 218 adapted to be seated in a slot 220 provided in the shaft of the associated end cap and an outer tang 221 adapted to be received in a slot 222 in the inner cylindrical surface of the bearing sleeve 214. Accordingly, the spring 208 biases its associated bearing sleeve in a clockwise direction as viewed in FIG. 60 and a counterclockwise direction as viewed in FIG. 78. The bearing sleeve has an axial slot 224 formed in its outer surface adapted to matingly receive a radially inwardly directed protuberance 226 on a roller 227 so that the roller rotates in unison with the bearing sleeves. The spacer disk 210 is merely provided so that the spring is positively positioned on the shaft 206 even though the spacer disk may not be needed if a larger width spring was used.

It will be appreciated from the above that by properly tensioning the spring 208 relative to the roll bar 120 and fabric to be wrapped thereon, the springs will encourage the fabric to be wrapped around the roll bar as the fabric is fed to the roll bar during operation of the covering. The spring tension is important, however, and it should not be large enough to lift the bottom rail 104 against gravity but merely strong enough to encourage the fabric to be wrapped therearound as fabric is fed to the roll bar through the slot 202 in the bottom rail.

As mentioned previously, the fabric extends through the centered slot 202 in the top of the bottom rail defined between the top plate 198 and the low friction strip 200. As also mentioned previously, when the intermediate rail is lifted to unroll fabric from the roller, the slats 118 are in their closed vertical position, but when the slats are opened by reversing the direction of pull on the control cord 110, it has been found they will open uniformly all the way down to the bottom rail if the slot 202 is offset from the location on the roller where the fabric leaves the roller. This can be appreciated by reference to FIGS. 60A and 60B. The fabric 108 will be seen to leave the roller 120 from a location offset from the center of the bottom rail so that it extends rearwardly at an angle as it leaves the roller. The low friction strip provides a smooth surface across which the fabric slides to prevent damage to the fabric and the removable top plate provides easy access to the interior of the bottom rail for ease of assembly.

Figure 62:
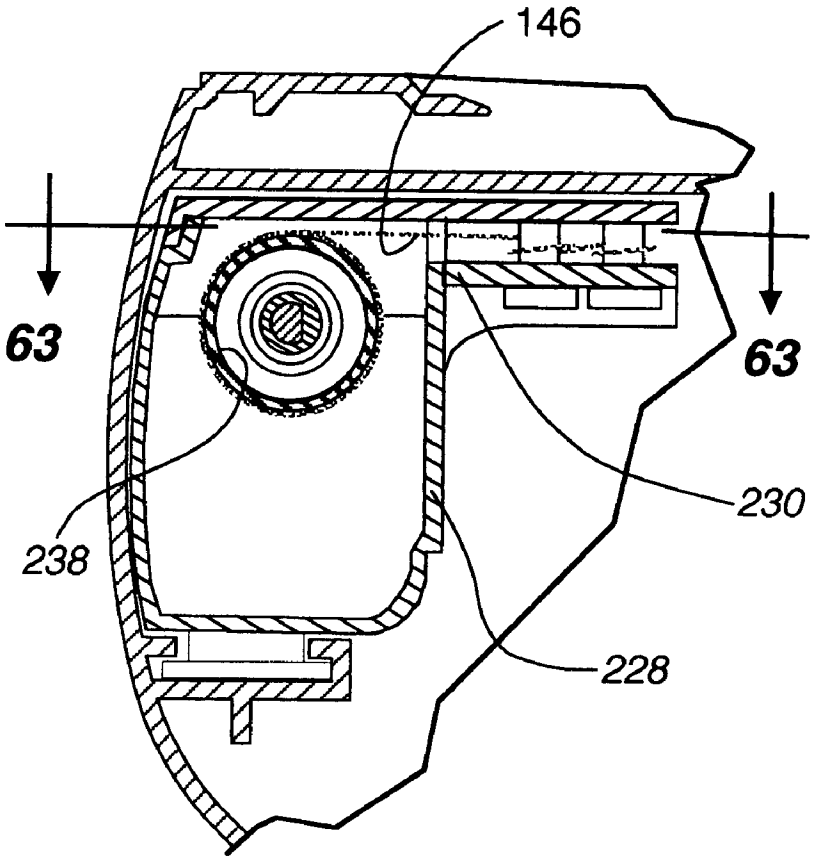
FIG. 62 is an enlarged fragmentary section taken along line 62—62 of FIG. 35.
Figure 61:
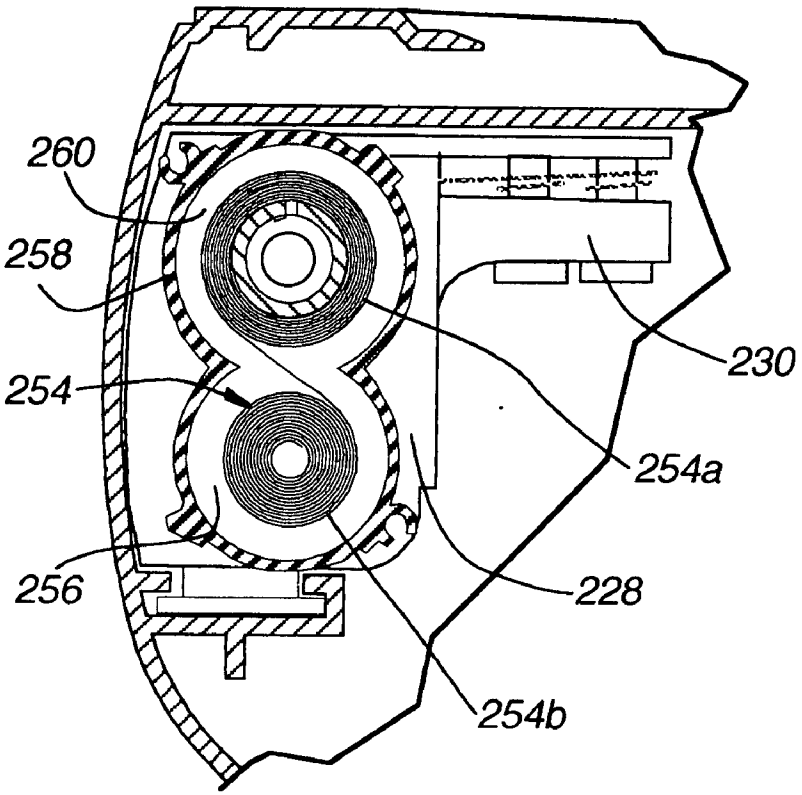
FIG. 61 is an enlarged fragmentary section taken along line 61—61 of FIG. 35.
Figure 63:
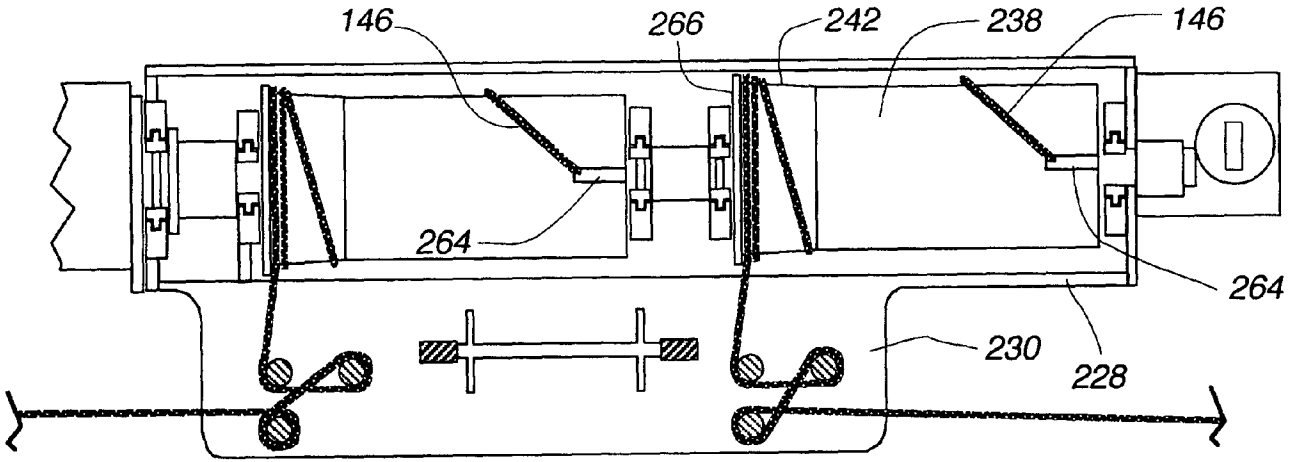
FIG. 63 is a fragmentary section taken along line 63—63 of FIG. 62.
Figure 63A:
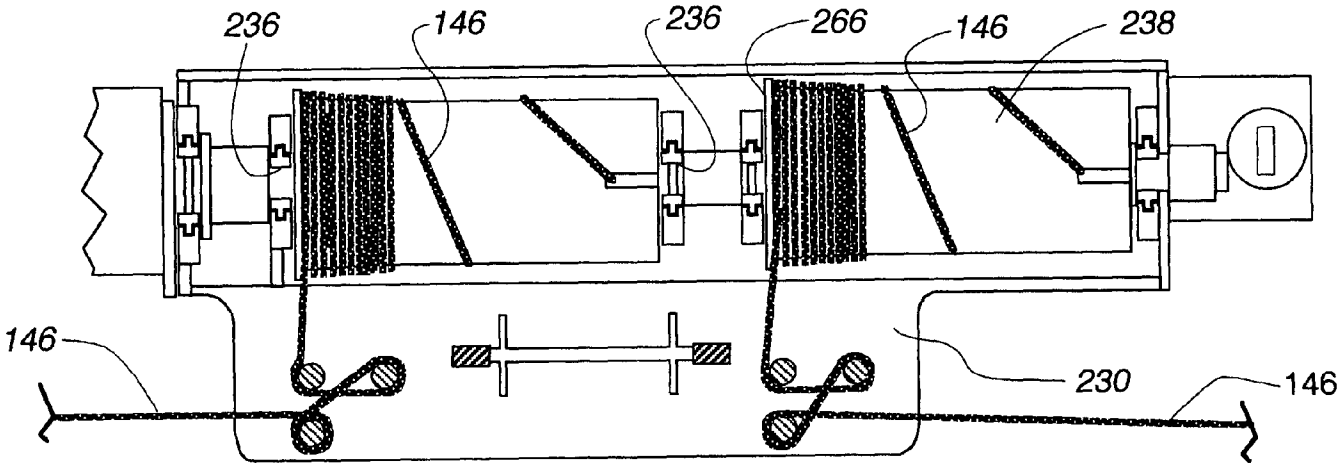
FIG. 63A is a section similar to FIG. 63 with the counterbalance cords further wrapped about their associated spools.
Figure 76A:
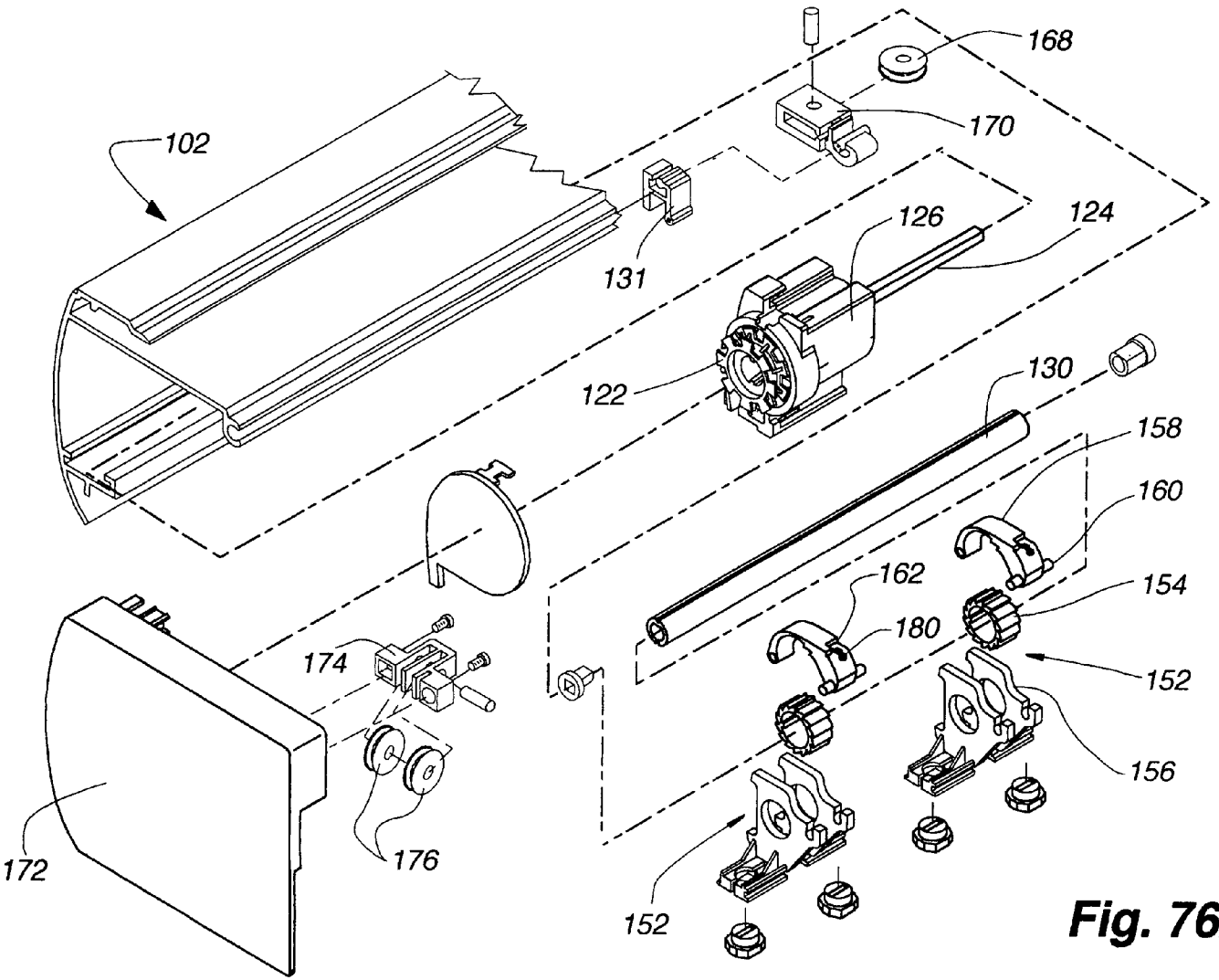
FIG. 76A is an exploded isometric view showing the operative components in the headrail that are associated with the control of the intermediate rail.
Figure 76B:
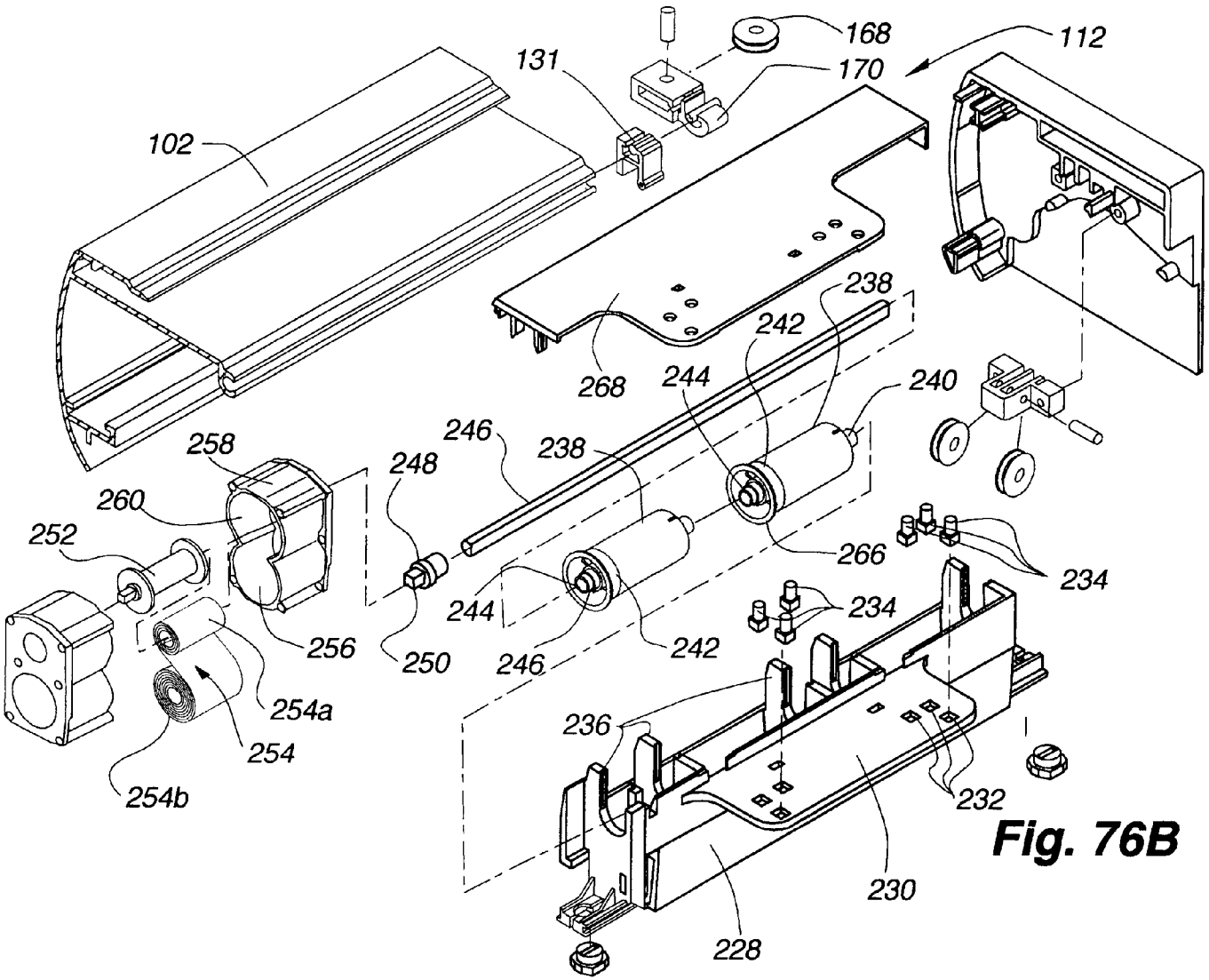
FIG. 76B is an exploded isometric similar to FIG. 76A illustrating the operative components in the headrail associated with the counterbalance control of the bottom rail of the covering.

The counterbalance system 112 interconnecting the headrail 102 with the bottom rail 104 is probably best illustrated in FIGS. 19A, 61–63A and 76B. As mentioned previously, the counterbalance system is designed to facilitate a manual lifting and lowering of the bottom rail relative to the headrail such that movement is easily obtainable and allows the bottom rail to remain in any position to which it is manually positioned during operation of the covering. A main body housing 228 for the counterbalance system, seen best in FIGS. 61, 62, and 76B, is mounted in the channel defined in the headrail and is positively positioned along the length of the channel with fasteners. The main body has a horizontal plate 230 with square apertures 232 therein adapted to seat guide pins 234 around which the bottom rail lift cords 146 are wrapped as seen best in FIGS. 19A, 63 and 63A. A forward portion of the main body includes a plurality of axially spaced, U-shaped notches 236 adapted to support spaced spools 238 on which the bottom rail lift cords are wrapped and unwrapped. Each spool has a shaft or bearing surface 240 projecting from axial ends thereof adapted to be seated in the U-shaped notches so that the spools are rotatably supported on the main body 228. The spools further have a generally cylindrical outer surface with a frustoconical extension 242 at one end for a purpose to be described later. Each spool has an axial passage 244 of non-circular cross-sectional configuration therethrough adapted to receive an elongated drive shaft 246 having the same cross section so that rotation of the drive shaft affects rotation of the spools. One end of the drive shaft has a cap 248 thereon with a recess (not seen) that receives the end of the shaft and is of the same non-circular cross-sectional configuration as the shaft so as to rotate therewith. The cap further has a square shaft 250 protruding from its opposite end adapted to be received in a mating axial opening in a spring spool 252 (FIG. 76B) such that the spring spool rotates in unison with the shaft and the lift cord spools. The spring spool is anchored to one end of a constant tension spring 254 so that part of the spring can be wrapped around the spring spool as the lift spools are rotating creating a constant bias on the lift spools which is sufficient to support the bottom rail 104 in a manner to be described later. As will be appreciated in FIG. 76B, the constant tension spring has two wraps 254*a* and 254*b* with one wrap 254*a* adapted to wrap around the spring spool and the other wrap 254*b* confined in the lower chamber 256 of a two-chamber housing 258 for the constant tension spring. The spring spool is disposed in an upper chamber 260. As will be appreciated, as the spring spool 252 is rotated by the lift spools 238 and the drive shaft 246, the spring is transferred from one spring chamber to the other but is confined within the two-part housing that defines an enclosure for the spring and the spring spool.

With reference to FIG. 19A, it will be appreciated that the lift cords 146 for the bottom rail 104 have their lower ends anchored to an associated end cap 196 of the bottom rail by being secured in the opening 204 in the associated end cap of the bottom rail while the other end of the lift cord is secured to an associated lift cord spool 238. Each lift cord spool has a slot 264 in its end opposite the frustoconical extension 242 so the cord can be knotted and received in the slot with the effective length of the lift cord being dependent on the size of the architectural opening and such that when the bottom rail is positioned in its fully extended position shown in FIGS. 21–25, the lift cord has only a few wraps about its associated spool 238.

As each bottom rail lift cord 146 extends upwardly from the bottom rail 104, it passes around an associated guide pulley 176 mounted on the end cap of the headrail 102 and subsequently horizontally and toward the main body 228 for the counterbalance system where it is wrapped once around two of the three guide pins 234 and partially around the third guide pin before extending substantially perpendicularly to the end of the associated lift cord spool 238 having the frustoconical extension. As the cord is fed to the associated spool during rotation of the spool, it is always fed to the frustoconical end of the spool adjacent to a flange 266 on that end of the spool and is encouraged by each subsequent wrap to be pushed to the right as viewed in FIGS. 63 and 63A with the frustoconical surface assisting in allowing each wrap of cord to slide to the right and down the frustoconical surface that has a decreasing diameter. As lift cord is unwound from the spools, it is encouraged to be unwound from the flanged end of the spool toward the guide pin 234 around which it initially passes. With the afore-described system, it has been found that entanglement of the lift cords is avoided thereby providing a reliable operation.

A top plate 268 for the counterbalance system snaps into place over the main body 228 so as to enclose the U-shaped notches 236 and thereby confine the lift cord spools and the guide pins 234 within the main housing body.

It will be appreciated from the above that the bias on the lift cord spools 238 provided by the constant tension spring 254 is provided to offset the weight of the bottom rail 104 so that any place the bottom rail is positioned between its fully extended and retracted positions will be maintained. Further, since the bias of the spring offsets the weight of the bottom rail, it is easy to lift or lower the bottom rail into a desired position for the bottom of the fabric structure 108.

In operation of the covering of the present invention, it will be appreciated that the intermediate rail 106 to which the top of the fabric structure 108 is secured can be easily raised or lowered with the control cord 110 and retained in any selected position between the headrail 102 and the bottom rail 104 simply by releasing the pull cord so that the double spring clutch 126 can secure the intermediate rail in that position. Once the intermediate rail has been desirably positioned, the pull cord can be moved in an opposite direction to pivot the slats 188 between open and closed positions so that the slats are pivotal between open and closed positions at any vertical position of the intermediate rail.

Further, the bottom rail 104, which anchors the lower edge of the fabric structure 108 can be manually raised or lowered independently of the intermediate rail 106 so that the fabric structure can be positioned at any degree of extension and at any location across the architectural opening with the top edge of the fabric structure being determined by the position of the intermediate rail and the bottom edge of the fabric structure being determined by the position of the bottom rail. Illustrations of these positions can be seen, for example, in FIG. 21 where the bottom rail is fully extended and the intermediate rail is positioned at a partially elevated location and wherein the slats have been closed.

Figure 25:
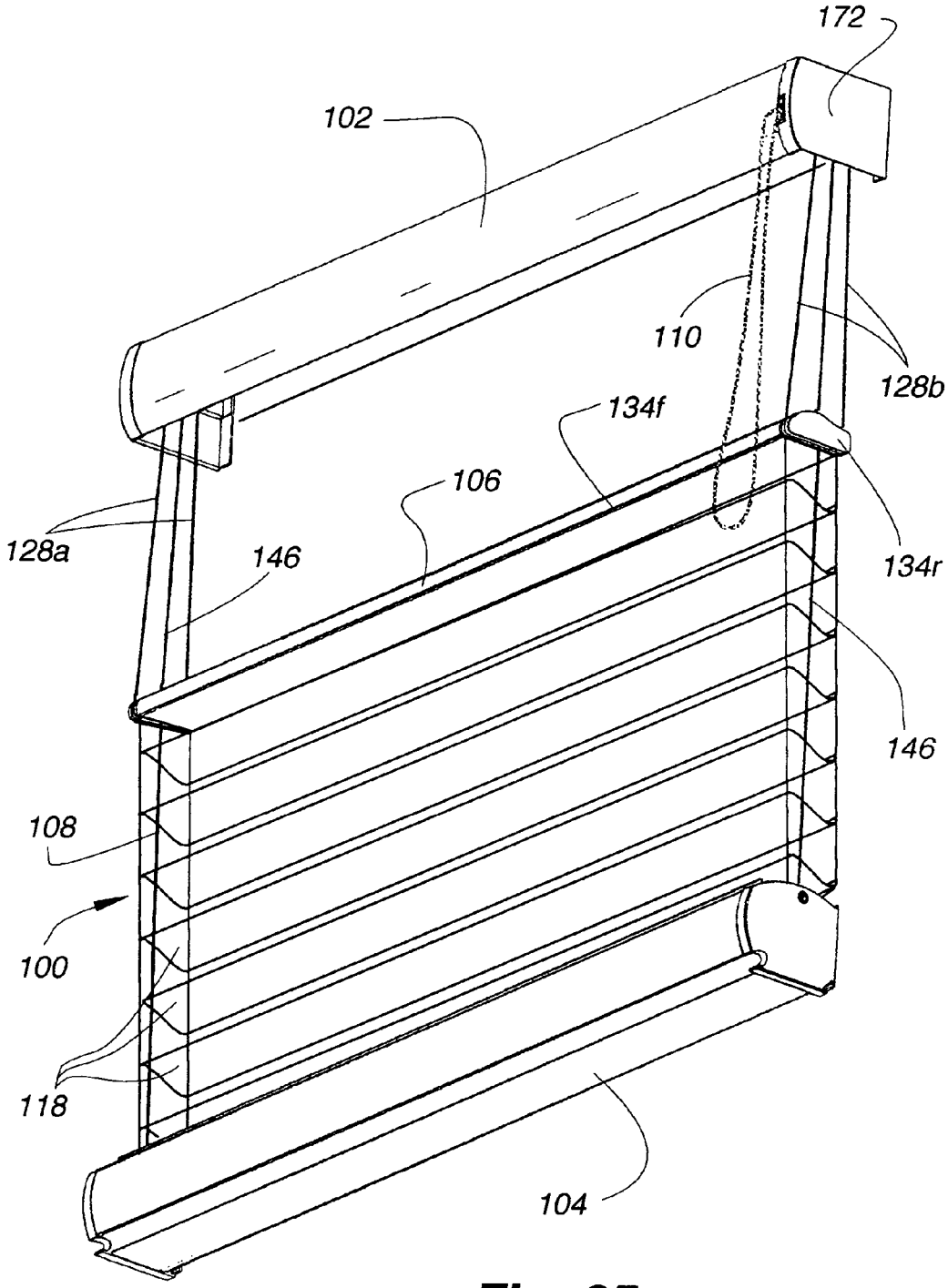
FIG. 25 is an isometric view looking upwardly toward the bottom of the covering FIG. 19 of the present invention with the bottom rail in its lowermost position and the intermediate rail in an intermediate position, and the slats in an open position.
Figure 26:
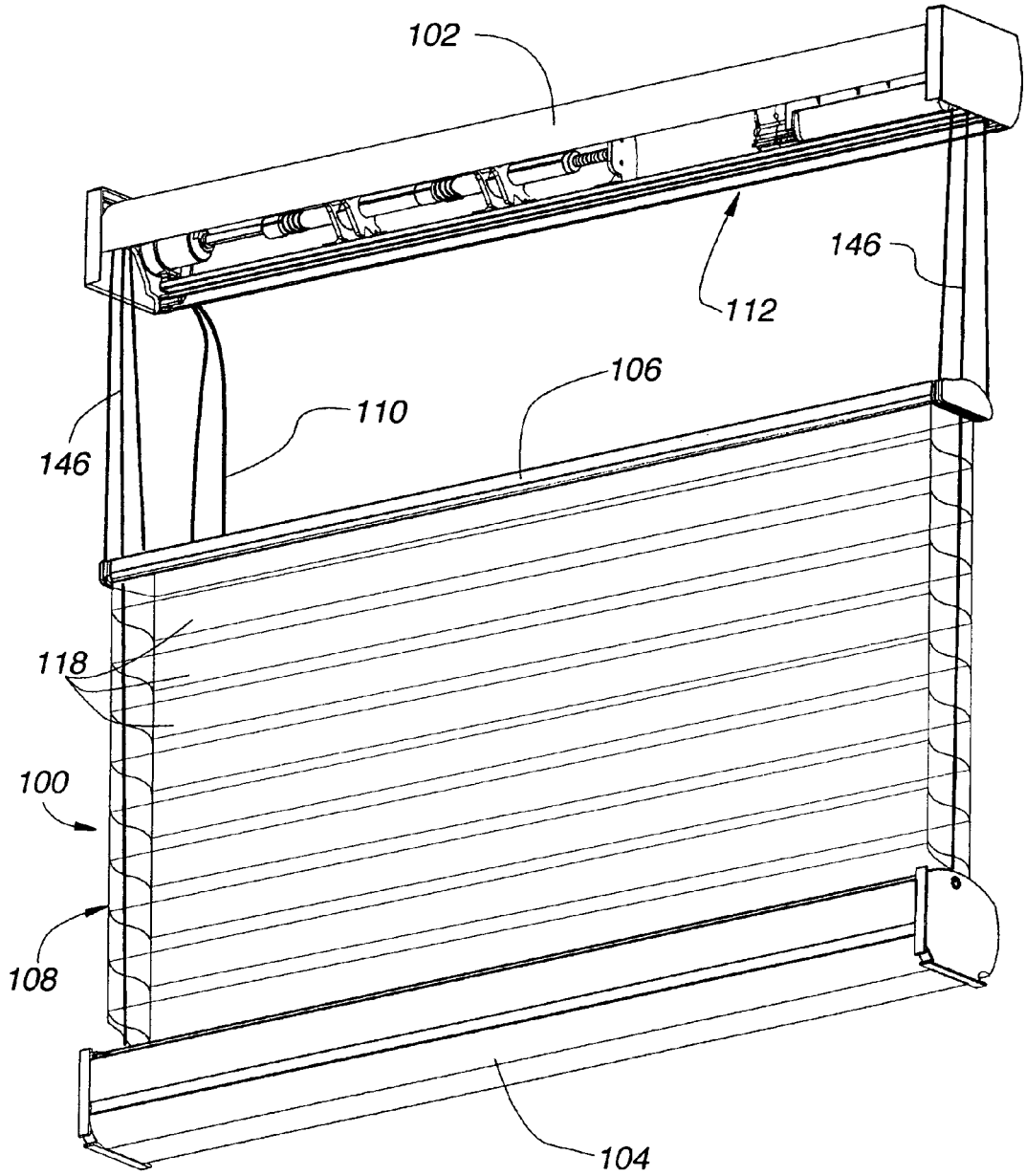
FIG. 26 is an isometric view similar to FIG. 25 looking upwardly at the back side of the covering of the present invention and again with the bottom rail fully extended, the intermediate rail at an intermediate position between the headrail and the bottom rail, and the slats in an open position.
Figure 28:
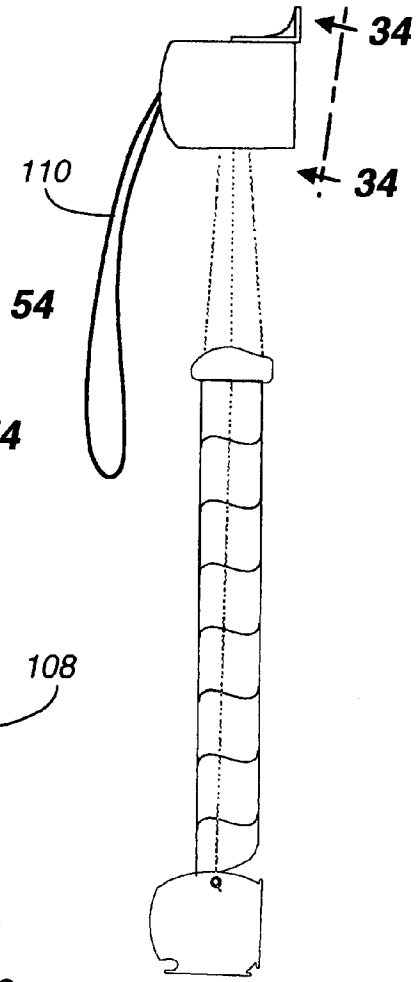
FIG. 28 is a right side elevation of the covering of FIG. 19 of the present invention as seen in FIG. 27.
Figure 27:
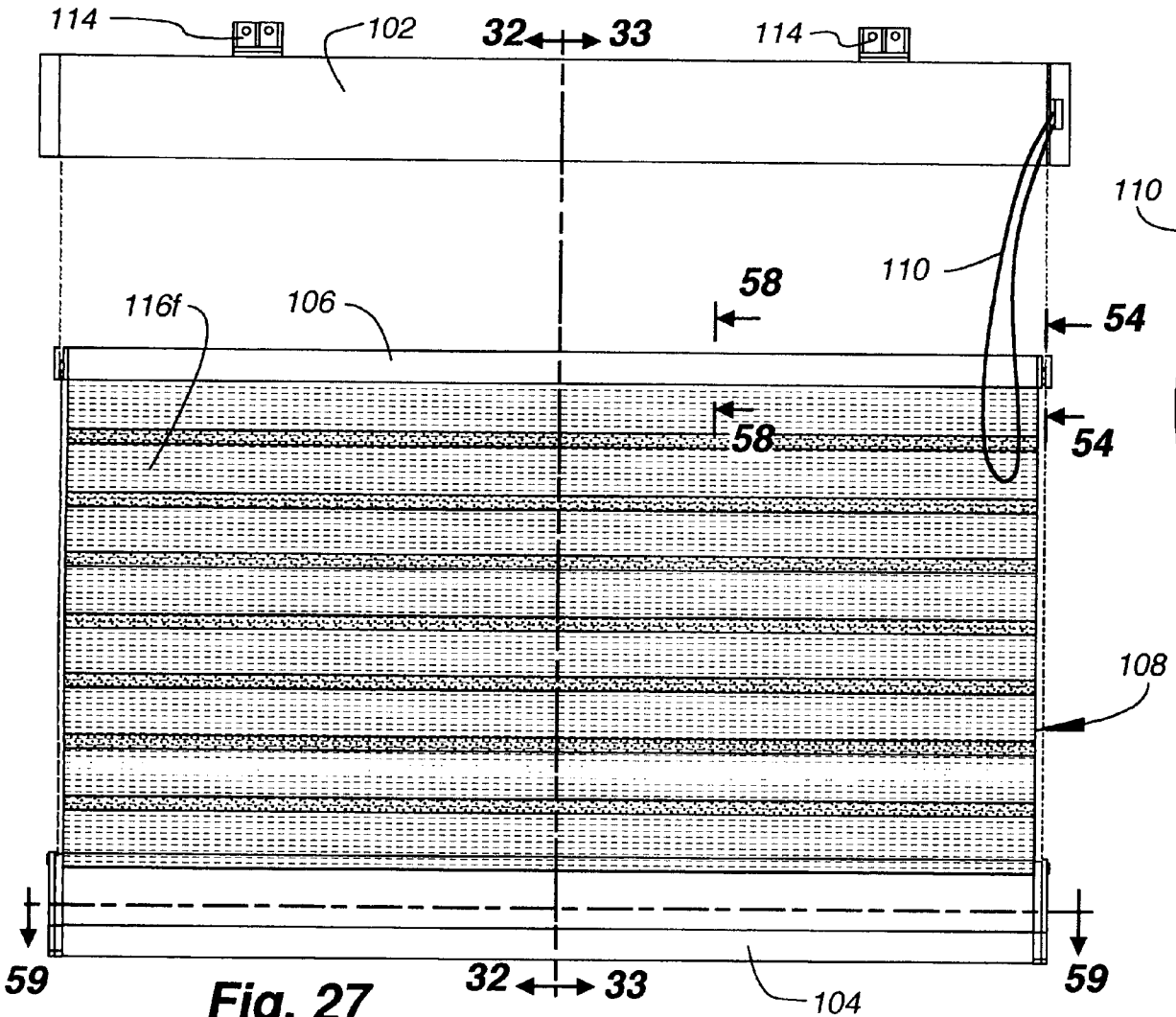
FIG. 27 is a front elevation of the covering of FIG. 19 of the present invention with the lower rail at a lowermost position, the intermediate rail at an intermediate position, and the slats in an open position.
Figure 30:
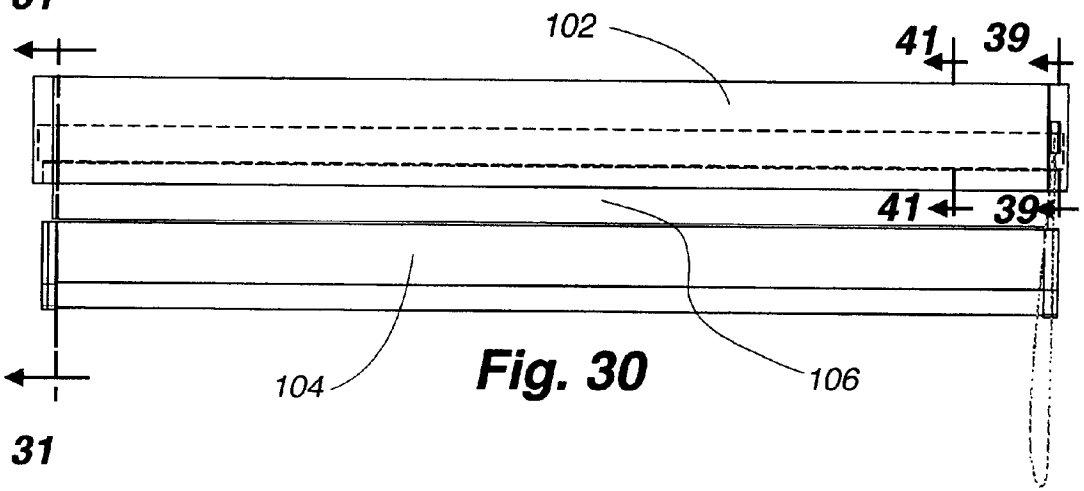
FIG. 30 is a front elevation as viewed along line 30—30 of FIG. 19.
Figure 29:
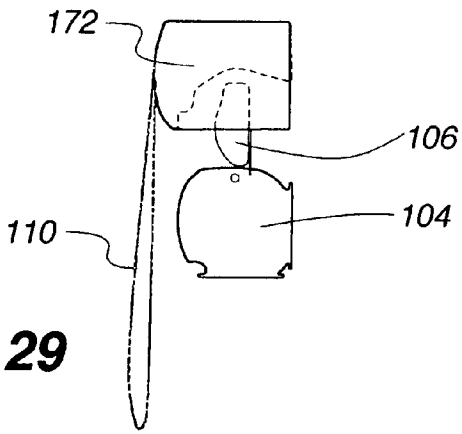
FIG. 29 is an end elevation as viewed along line 29—29 of FIG. 19.
Figure 31:
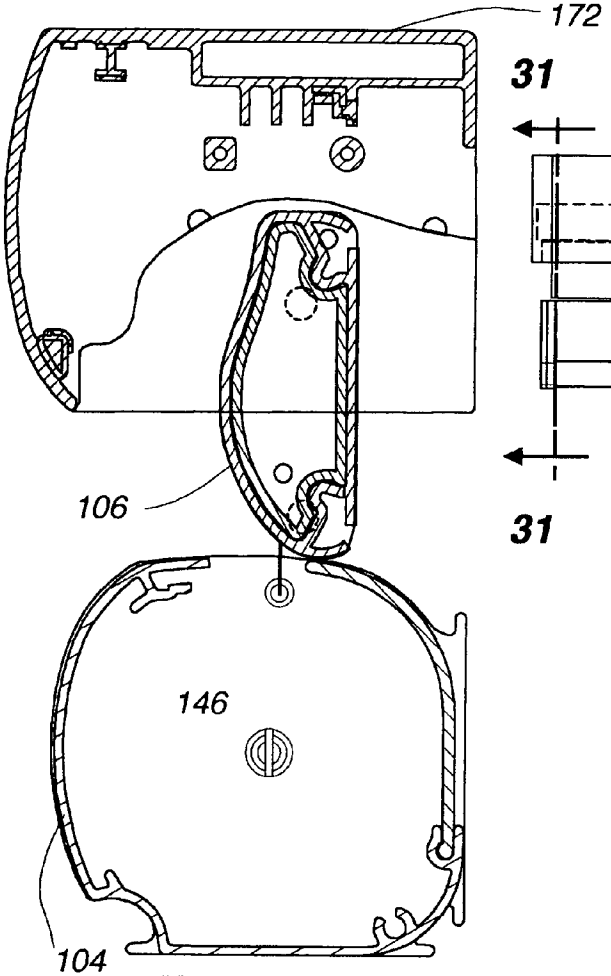
FIG. 31 is an enlarged section taken along line 31—31 of FIG. 30.
Figure 32:
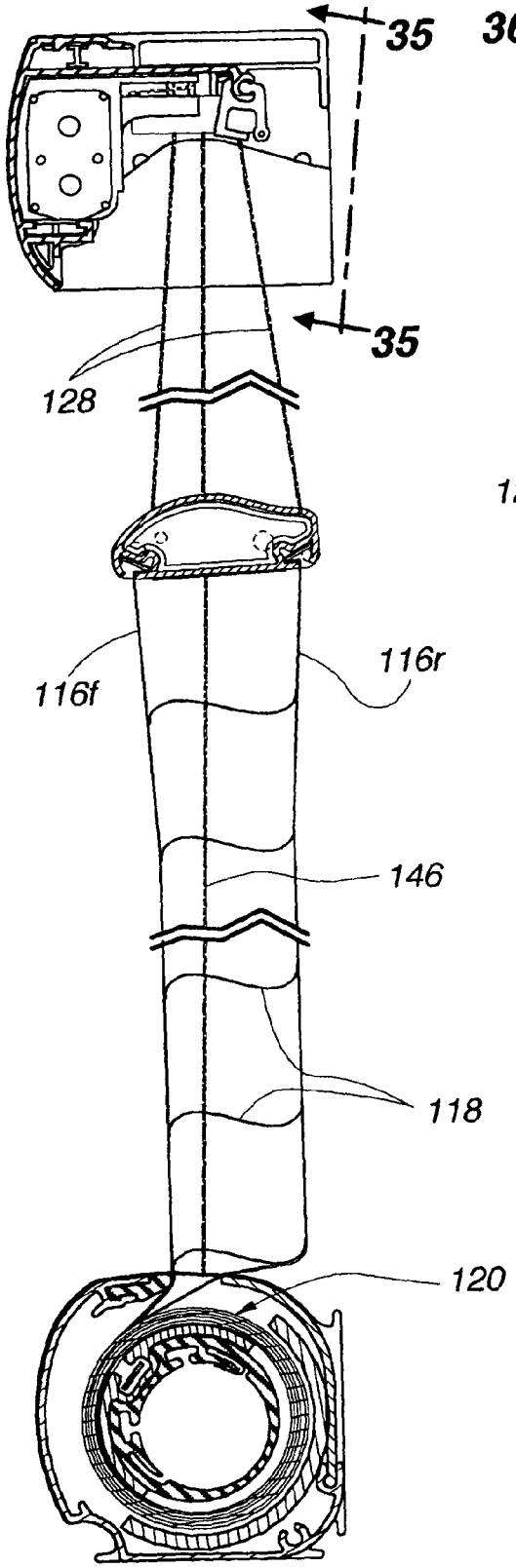
FIG. 32 is an enlarged section taken along line 32—32 of FIG. 17.
Figure 33:
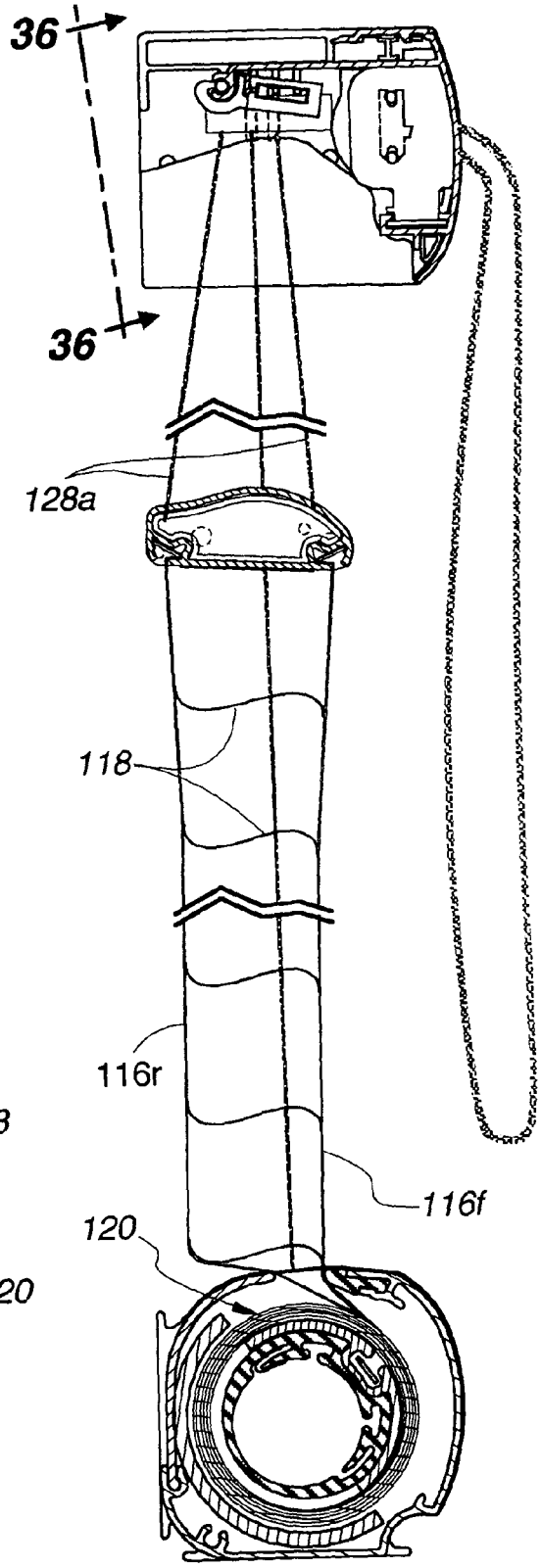
FIG. 33 is an enlarged section taken along line 33—33 of FIG. 17.
Figure 34:
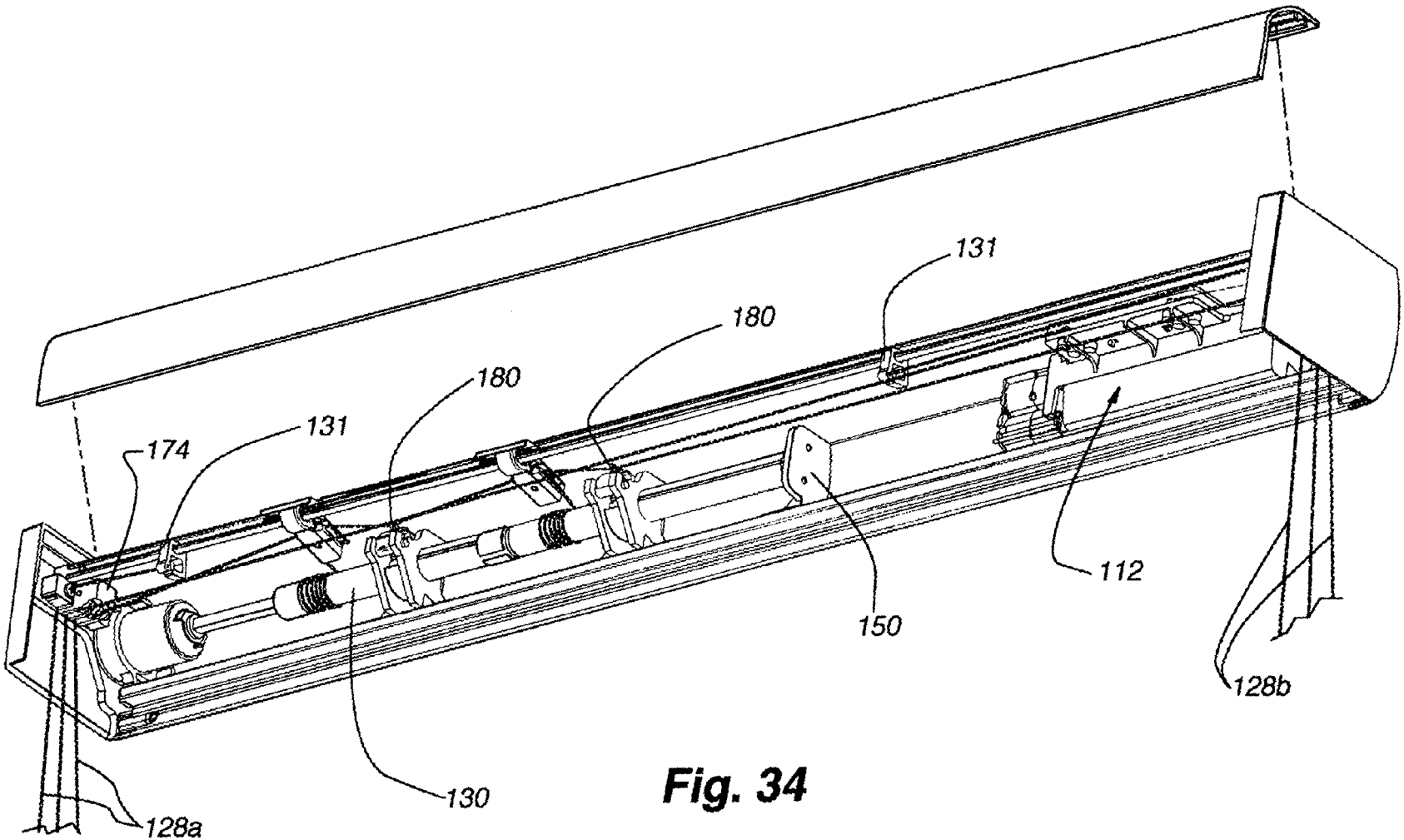
FIG. 34 is an enlarged view taken along line 34—34 of FIG. 28.
Figure 35:
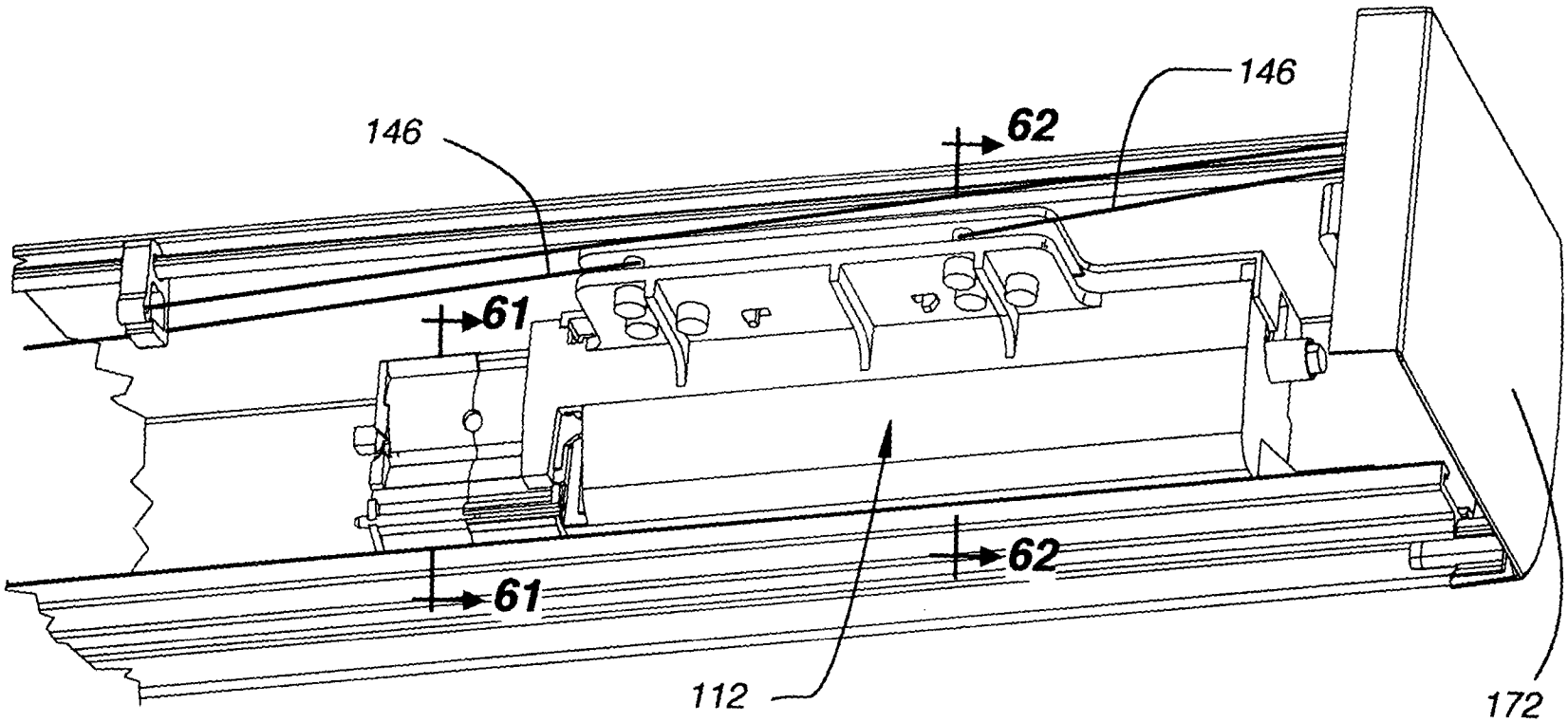
FIG. 35 is an enlarged fragmentary section taken along line 35—35 of FIG. 32.
Figure 36:
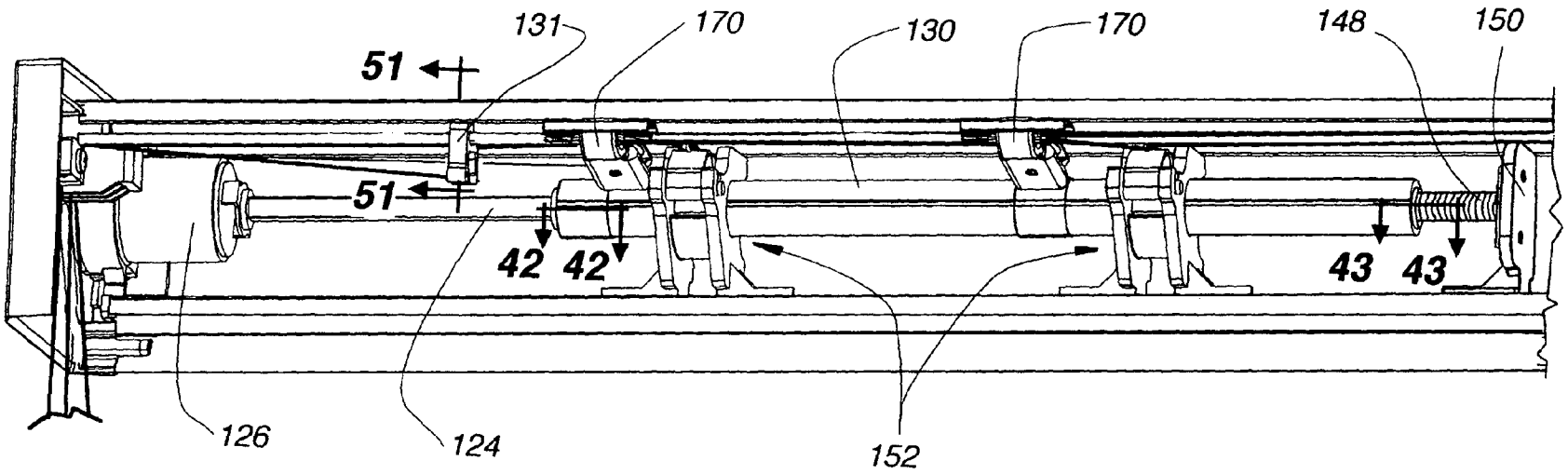
FIG. 36 is an enlarged fragmentary section taken along line 36—36 of FIG. 33.
Figure 37:
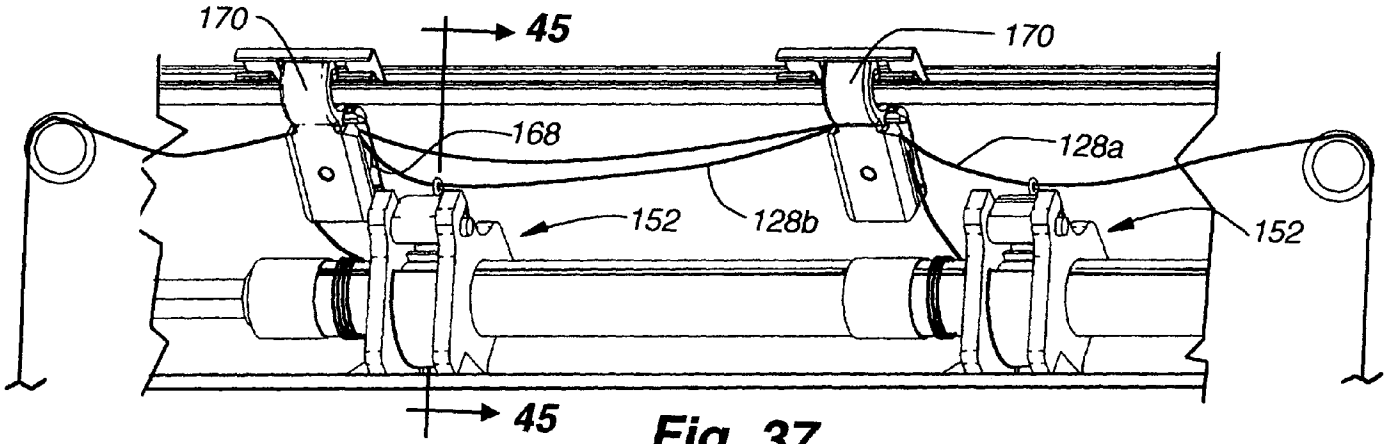
FIG. 37 is an enlarged fragmentary view similar to FIG. 36 illustrating the ratchet/pawl spool lock with the lift cords in a lax condition.
Figure 38:
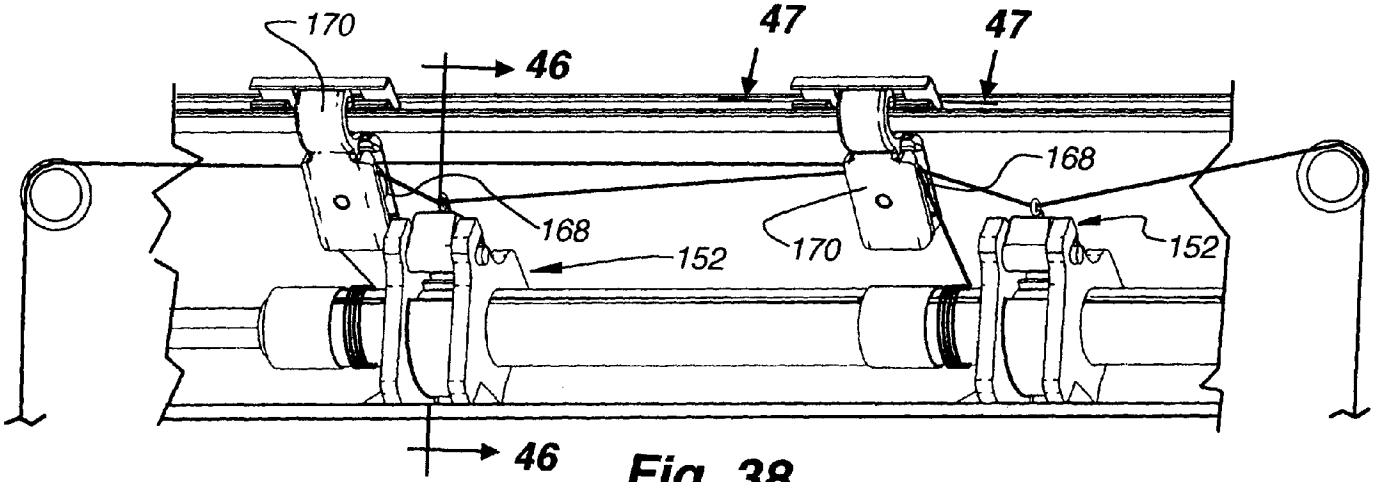
FIG. 38 is a fragmentary view similar to FIG. 37 with the lift cords in a taut condition.
Figure 41:
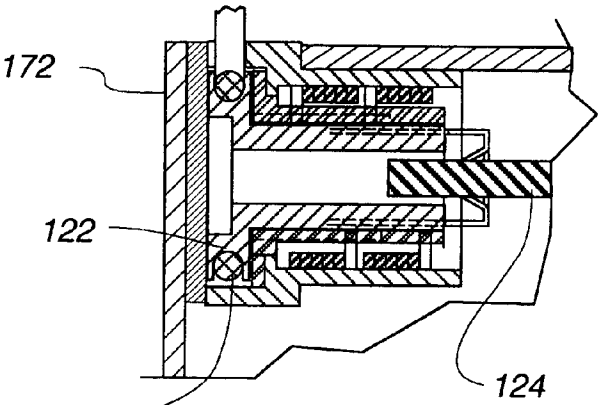
FIG. 41 is a further enlarged fragmentary section taken along line 41—41 of FIG. 40.
Figure 40:
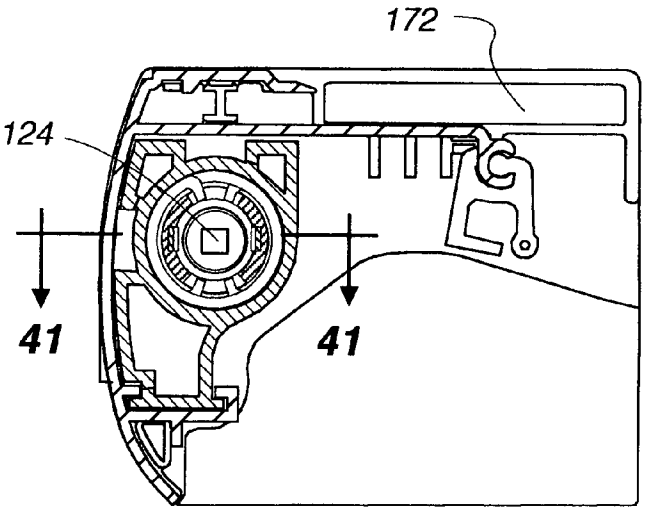
FIG. 40 is an enlarged section taken along line 40—40 of FIG. 30.

FIG. 22 shows the bottom rail fully extended with the intermediate rail raised so as to engage the headrail and with the slats in an open position. FIG. 23 has the bottom rail and intermediate rail positioned as shown in FIG. 22 but the slats are shown closed. FIG. 24 again has the bottom rail and intermediate rail as shown in FIG. 22 but wherein the slats are partially open. FIG. 25 shows the intermediate rail and bottom rail positioned substantially as in FIG. 21 but the slats are open.

Figure 68:
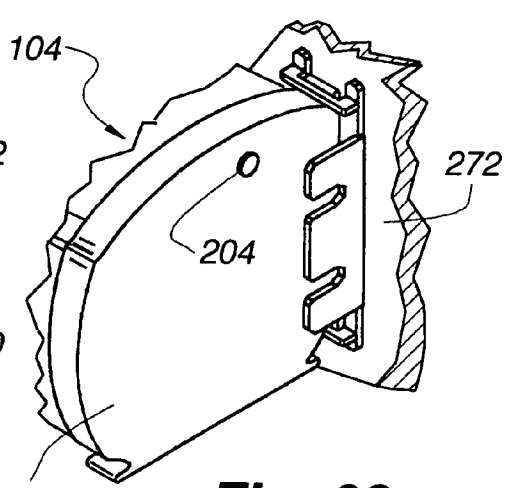
FIG. 68 is a fragmentary isometric similar to FIG. 67 with the end cap fully mounted on the bracket of FIGS. 64 and 65.
Figure 67:
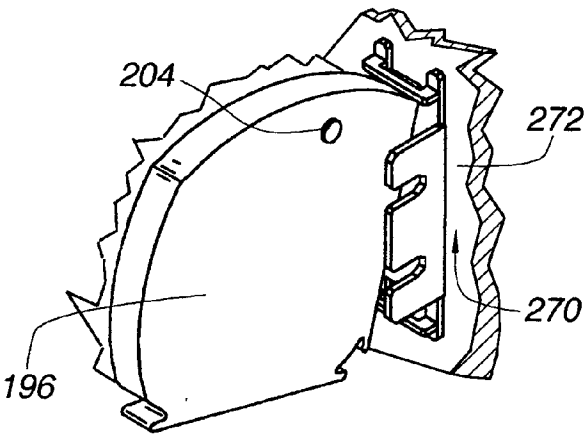
FIG. 67 is a fragmentary isometric similar to FIG. 66 with the end cap being partially attached to the bracket of FIGS. 64 and 65.
Figure 66:
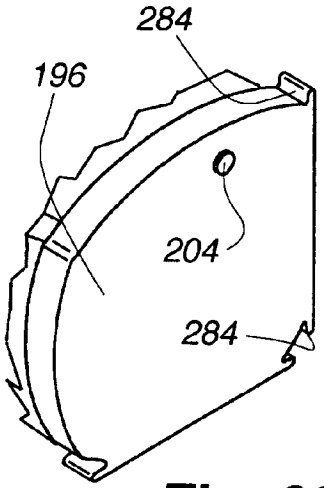
FIG. 66 is a fragmentary isometric view of the end cap of the bottom rail of the embodiment of FIG. 19 of the present invention.
Figure 70:
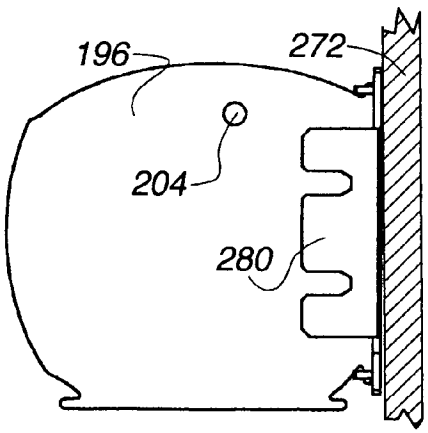
FIG. 70 is an end elevation of the end cap and bracket as shown in FIG. 68.
Figure 69:
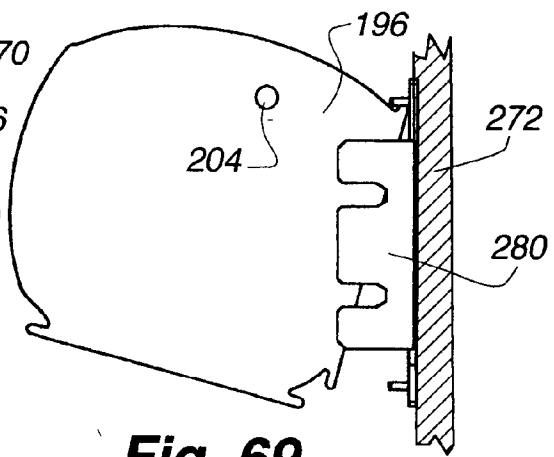
FIG. 69 is an end elevation of the end cap and bracket as shown in FIG. 67.
Figures 64, 65:
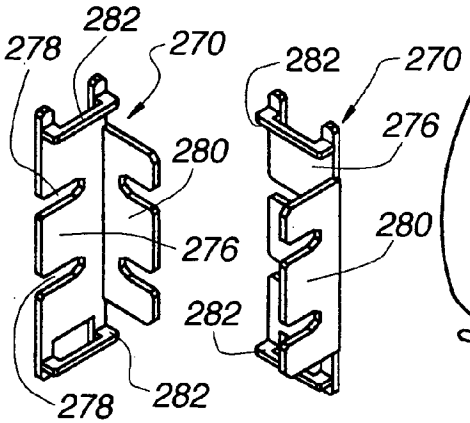
FIG. 64 is an isometric view of a mounting bracket for mounting the headrail of the covering of FIG. 19 on a side frame member of an architectural opening.
FIG. 65 is an isometric view similar to FIG. 64 taken from an angle of 90° from that of FIG. 64.

With reference to FIGS. 64–75, it will be appreciated that the bottom rail 104 can be releasably locked in a fully extended position in which case the covering would merely be operated by manipulating the intermediate rail 106 between its uppermost position adjacent to the headrail 102 and a lowermost position adjacent to the bottom rail 104 and further tilting the slats 118 between their open and closed positions. In order to secure the bottom rail adjacent to the bottom of the architectural opening, a universal bracket 270 shown in FIGS. 64 and 65 is secured to the framework for the architectural opening along a side wall 272 as viewed in FIGS. 67–70 or along a bottom wall 274 as shown in FIGS. 71–74. The bracket can be seen to include a base 276 having notches 278 for receiving fasteners (not shown) so that the base can be secured to the side wall or bottom wall of the frame for the architectural opening. As shown in FIGS. 67–69, the base is secured to the side wall 272 and an upstanding flange 280 perpendicular to the base defines a lateral limit so the bottom rail 104 can be easily positioned and secured to the bracket. There is a bracket at each end of the bottom rail and each bracket has upper and lower catches 282 that are adapted to cooperate with upper and lower ribs 284 on the back edge of the end caps 196 of the bottom rail. To secure the bottom rail in position, the upper rib is inserted beneath the upper catch of the bracket as shown in FIGS. 67 and 69 and subsequently the bottom rail is pivoted until the lower rib is aligned with the lower catch at which point the bottom rail can be lowered so that the ribs are releasably retained in the catches. Of course, a reverse procedure releases the bottom rail from the brackets.

Figures 71, 72, 73, 74, 75:
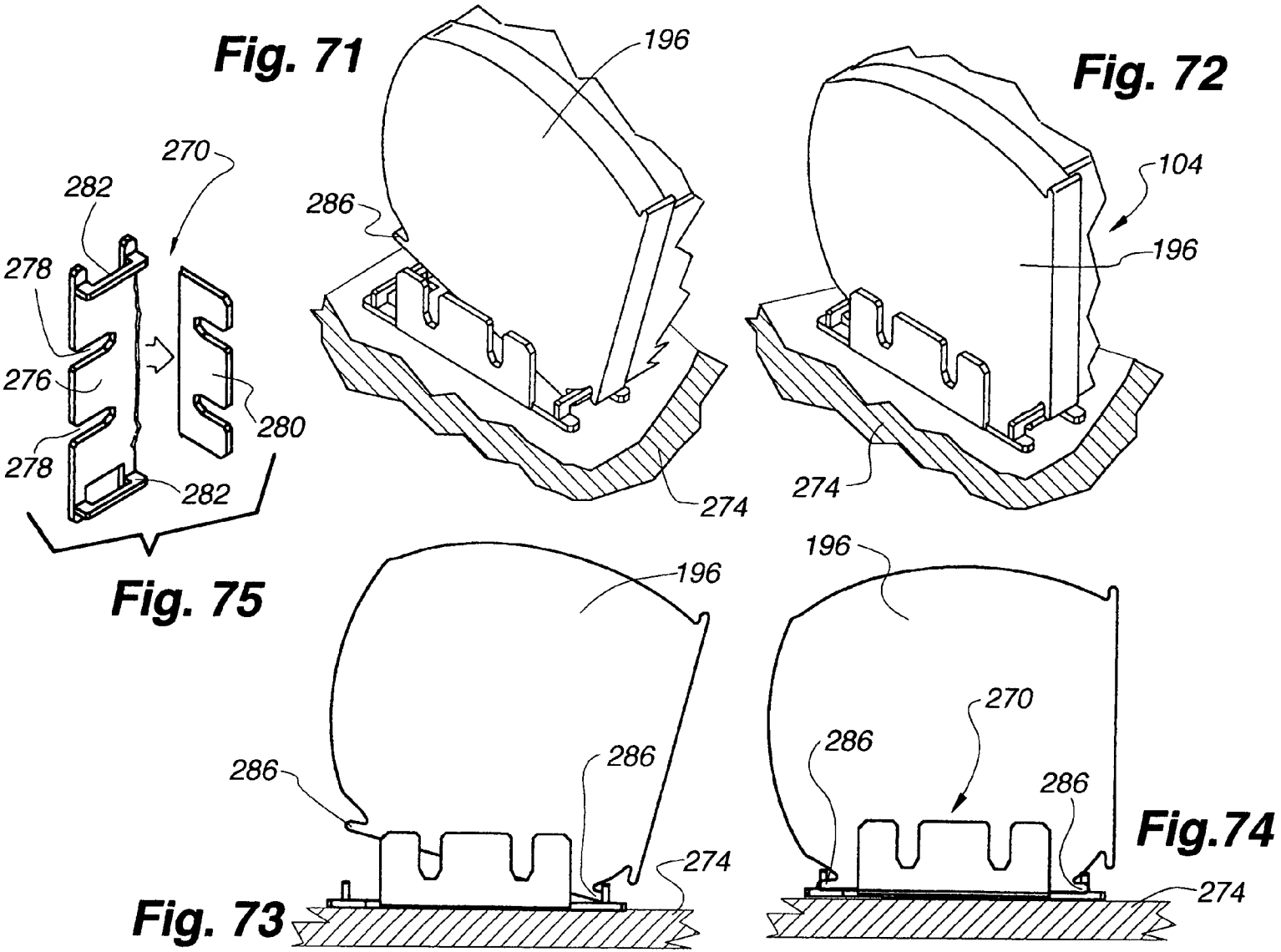
FIG. 71 is a fragmentary isometric of the end cap of the bottom rail partially connected to the bracket of FIGS. 64 and 65 with the brackets mounted on a bottom horizontal frame member of an architectural opening.
FIG. 72 is a fragmentary isometric showing the end cap of the bottom rail fully mounted on the bracket of FIGS. 64 and 65 on a bottom horizontal frame member of the architectural opening.
FIG. 73 is a fragmentary end elevation illustrating the end cap of the bottom rail and the bracket in their relative positions of FIG. 71.
FIG. 74 is a fragmentary end elevation of the end cap of the bottom rail and the bracket in their relative positions of FIG. 72.
FIG. 75 is an isometric view of the bracket of FIGS. 64 and 65 with one leg of the bracket being severed.

With reference to FIGS. 71–75, it will be appreciated that the same bracket 270 has been mounted on the bottom wall 274 of the architectural opening, but in this case, ribs 286 at the front and back of the bottom edge of the end caps are inserted into the catches 282 similarly to the procedure followed when the bracket was mounted on the side wall 272. FIG. 75 illustrates the fact that the upstanding flange 280, if not wanted or desired for any reason, can be removed and is provided with a weakened line of connection 288 to the base 276 for easy manual separation.

An alternative embodiment to that previously described is illustrated in FIGS. 79–92. In this embodiment, there are numerous parts that are identical to those previously described and, accordingly, will be accorded identical reference numerals with a prime suffix. As is probably appreciated by reference to FIG. 79, this embodiment of the covering of the invention again includes an intermediate rail control system and a counterbalance system 112' for operating the bottom rail 104'. The control system again has a control cord 110' passing around a pulley 122' and a drive shaft 124' through a two-way clutch 126' wherein the drive shaft has mounted thereon a spool 130' with two identified areas for wrapping lift cords associated with the intermediate rail 106'. The spool is mounted on a threaded bearing shaft 148' so that as it rotates, it shifts or slides linearly along the drive shaft whereby each lift cord 128*a*' and 128*b*' is helically wrapped dependably and uniformly on its associated portion of the intermediate rail spool 130'. The intermediate rail lift cords are strung differently in that a lift cord coming off the intermediate rail spool passes over a guide pulley 176' and is wrapped around the friction pin 142*r*' at the rear edge of the intermediate rail before passing forwardly and around the friction pin 142*f*' at the front edge of the intermediate rail from which the cord again passes upwardly and is anchored with an anchor 131' to the headrail. It has been found with this arrangement that when the intermediate rail is lifted, it rises in a generally horizontal plane or open position and therefore is matingly nestable in the headrail 102' as seen in FIG. 85.

Figure 85:
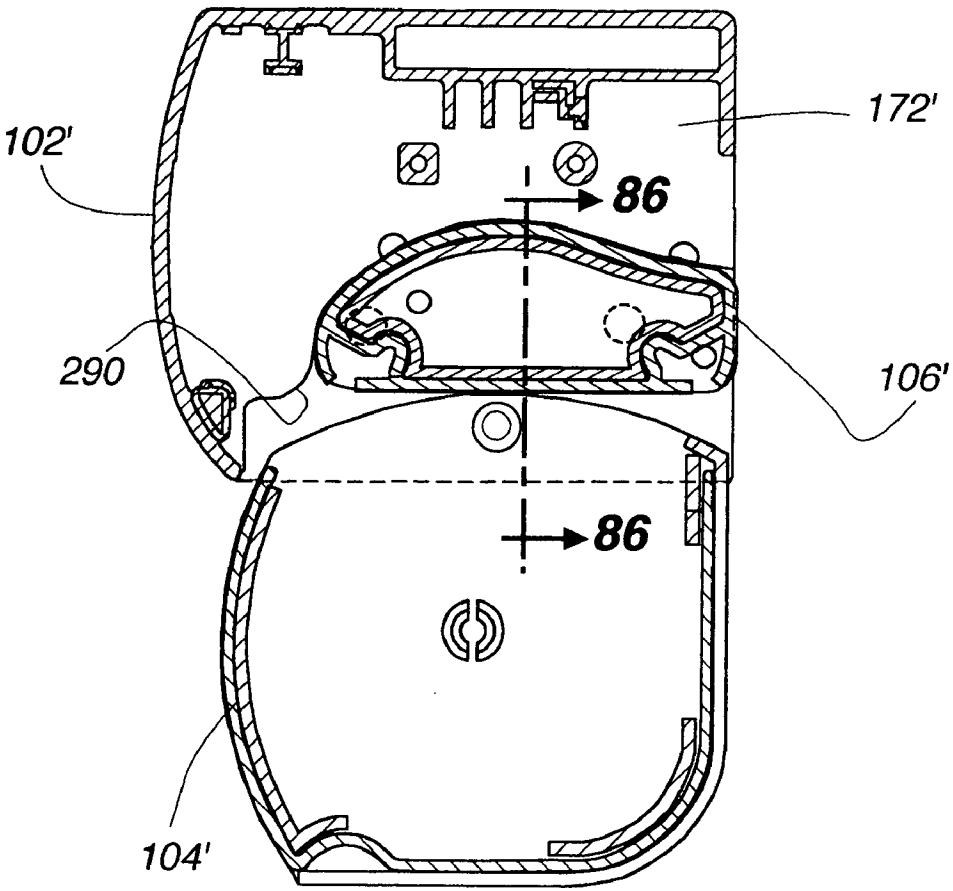
FIG. 85 is an enlarged section taken along line 85—85 of FIG. 83.
Figure 87:
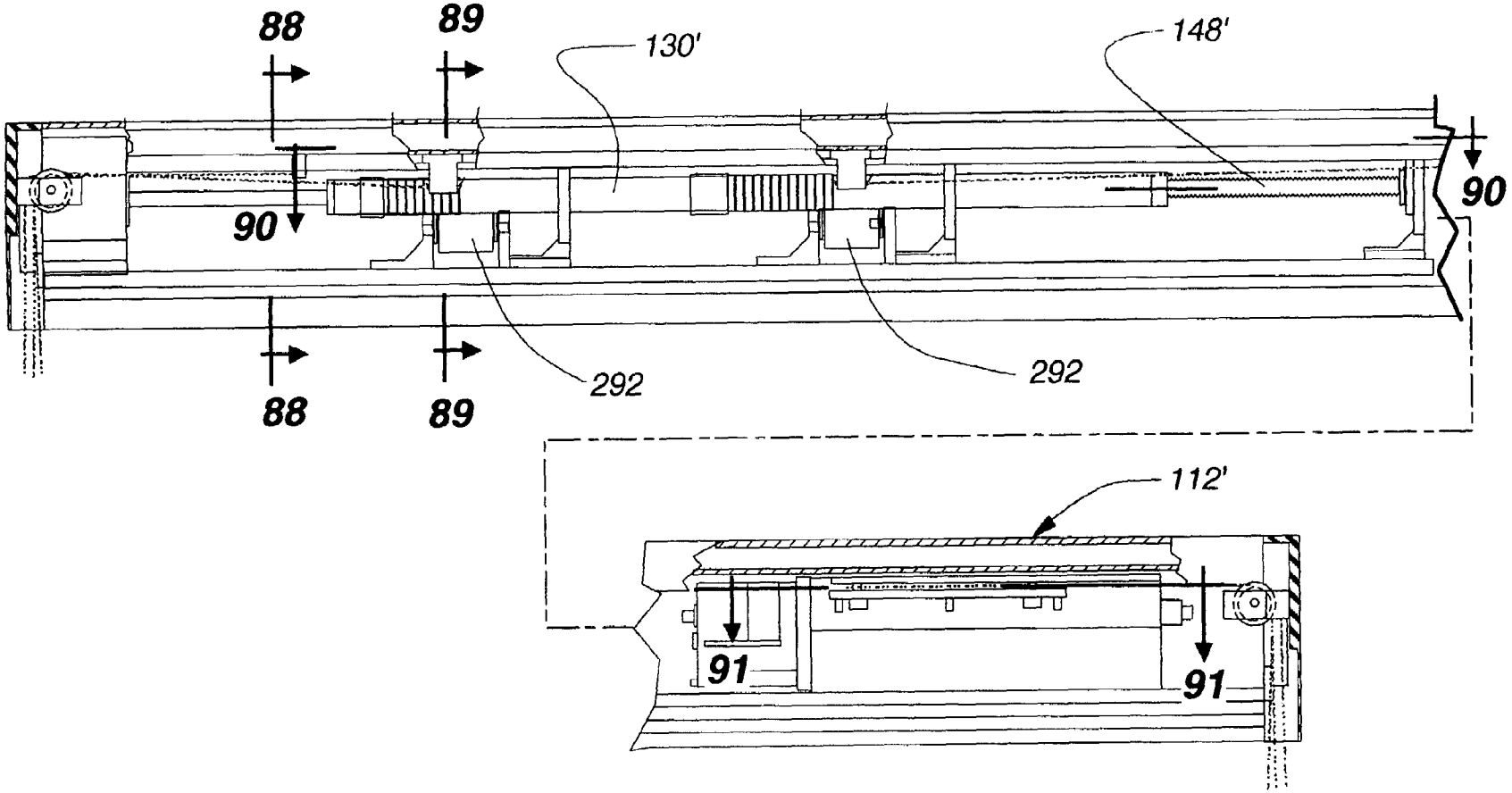
FIG. 87 is an enlarged fragmentary section taken along line 87—87 of FIG. 81.
Figure 88:
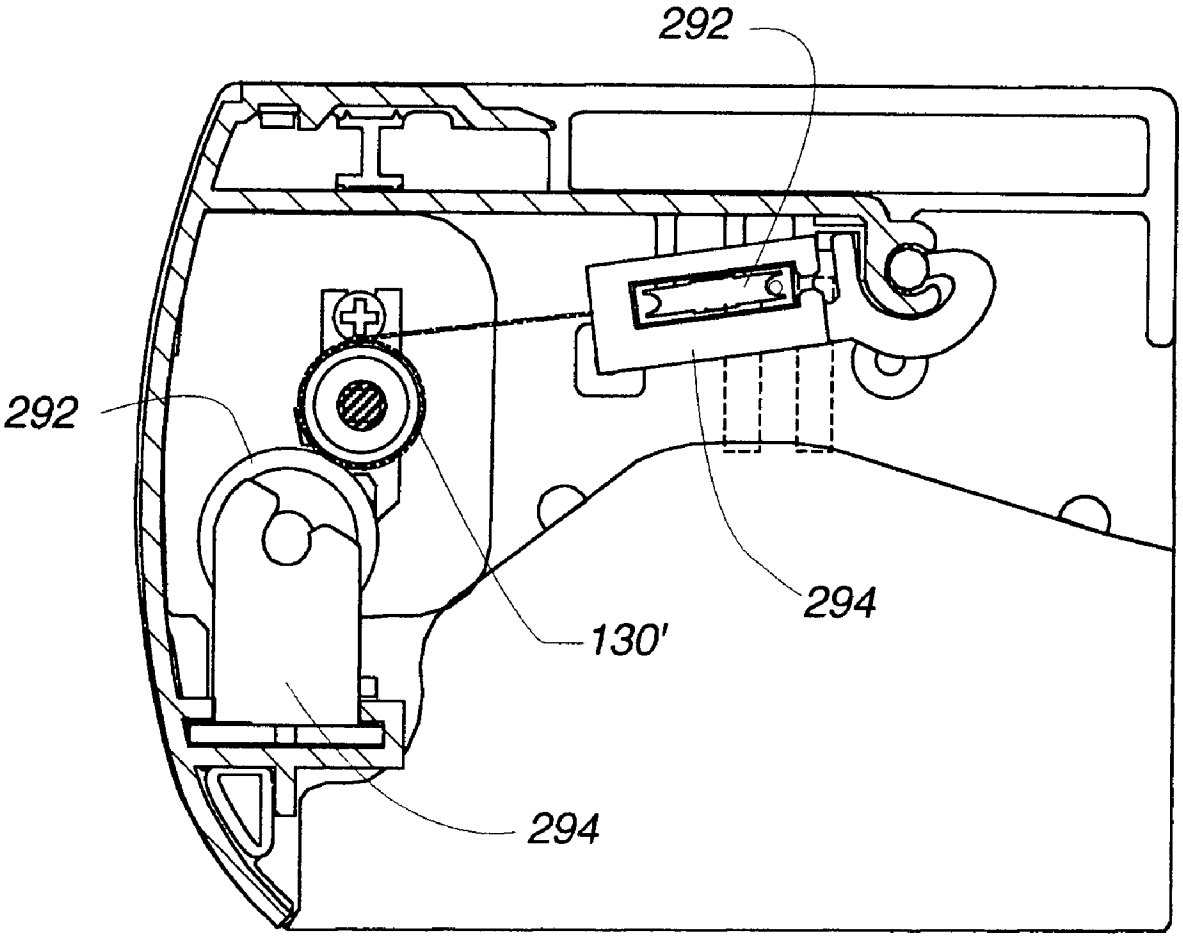
FIG. 88 is an enlarged section taken along line 88—88 of FIG. 87.
Figure 90:
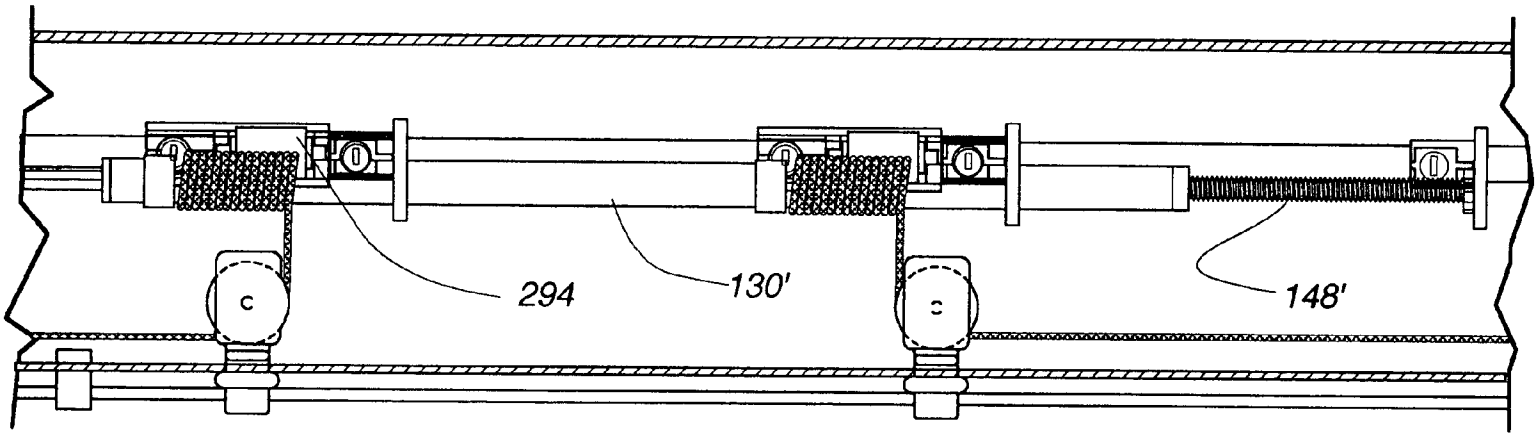
FIG. 90 is an enlarged fragmentary section taken along line 90—90 of FIG. 87.
Figure 89:
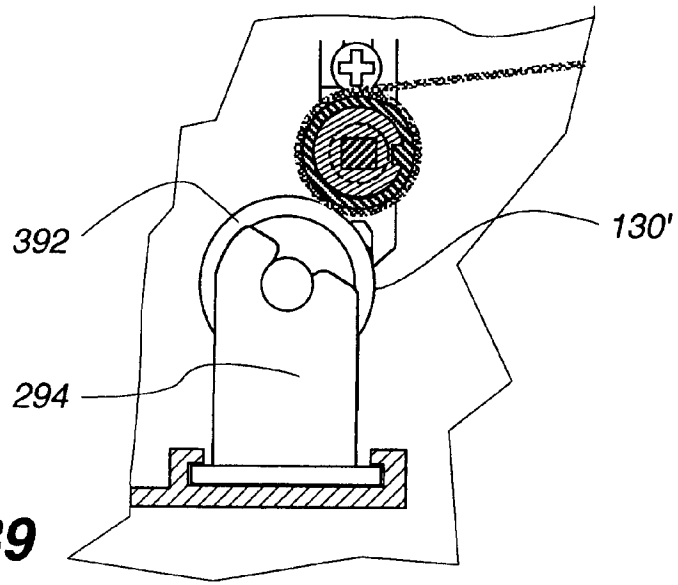
FIG. 89 is an enlarged fragmentary section taken along line 89—89 of FIG. 87.
Figure 91:
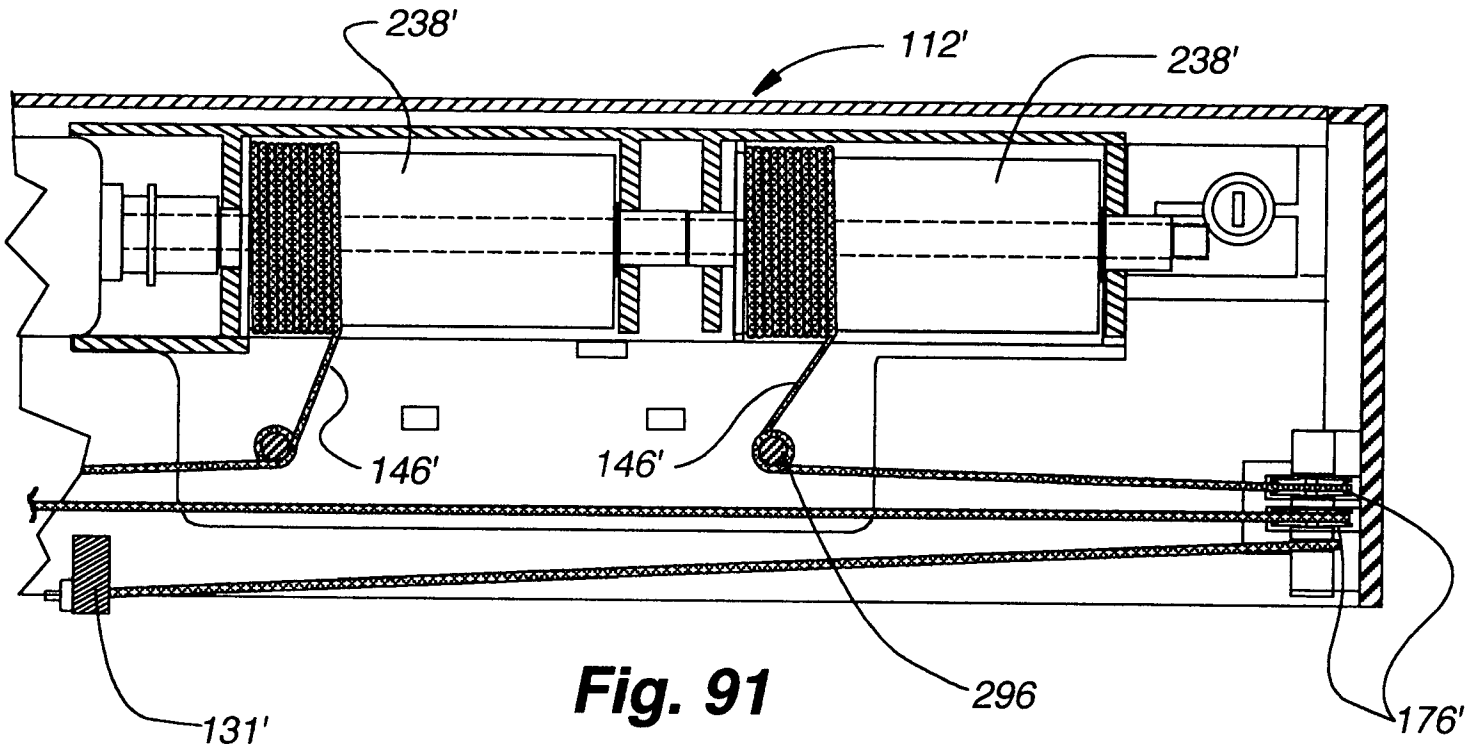
FIG. 91 is an enlarged fragmentary section taken along line 91—91 of FIG. 87.
Figure 92:
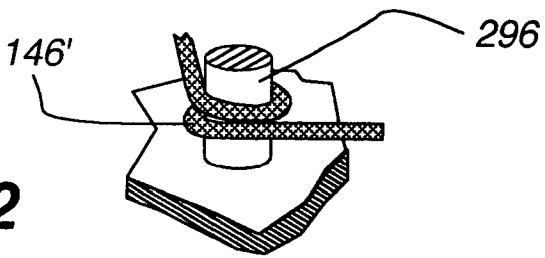
FIG. 92 is an enlarged fragmentary isometric showing a lift cord associated with the bottom rail of the embodiment of FIG. 19 passing around a friction pin.

As will be appreciated in FIG. 85, the end caps 172' for the headrail 102' have a rib 290 formed therein that matches the upper contour of the intermediate rail 106' so that when the intermediate rail is fully lifted it is confined and concealed within the headrail. Similarly, when the bottom rail 104' is fully lifted adjacent to the fully lifted intermediate rail, it abuts the bottom surface of the intermediate rail as seen in FIG. 85 and is partially received within the open bottom of the headrail.

In this embodiment of the invention, an alternative system is used for preventing entanglement of the intermediate rail lift cords 128*a*' and 128*b*'. Rather than the pawl brake described previously, a pair of rollers 292 are mounted adjacent to the spool 130' with the rollers remaining in engagement with the lift cords so that should slack occur in the lift cords, they will be retained on the spool by the pressure applied thereto by the rollers. As is probably best seen in FIGS. 88, 89 and 90, the rollers are mounted on independent brackets 294 so as to engage the spool from the underside.

Figure 79:
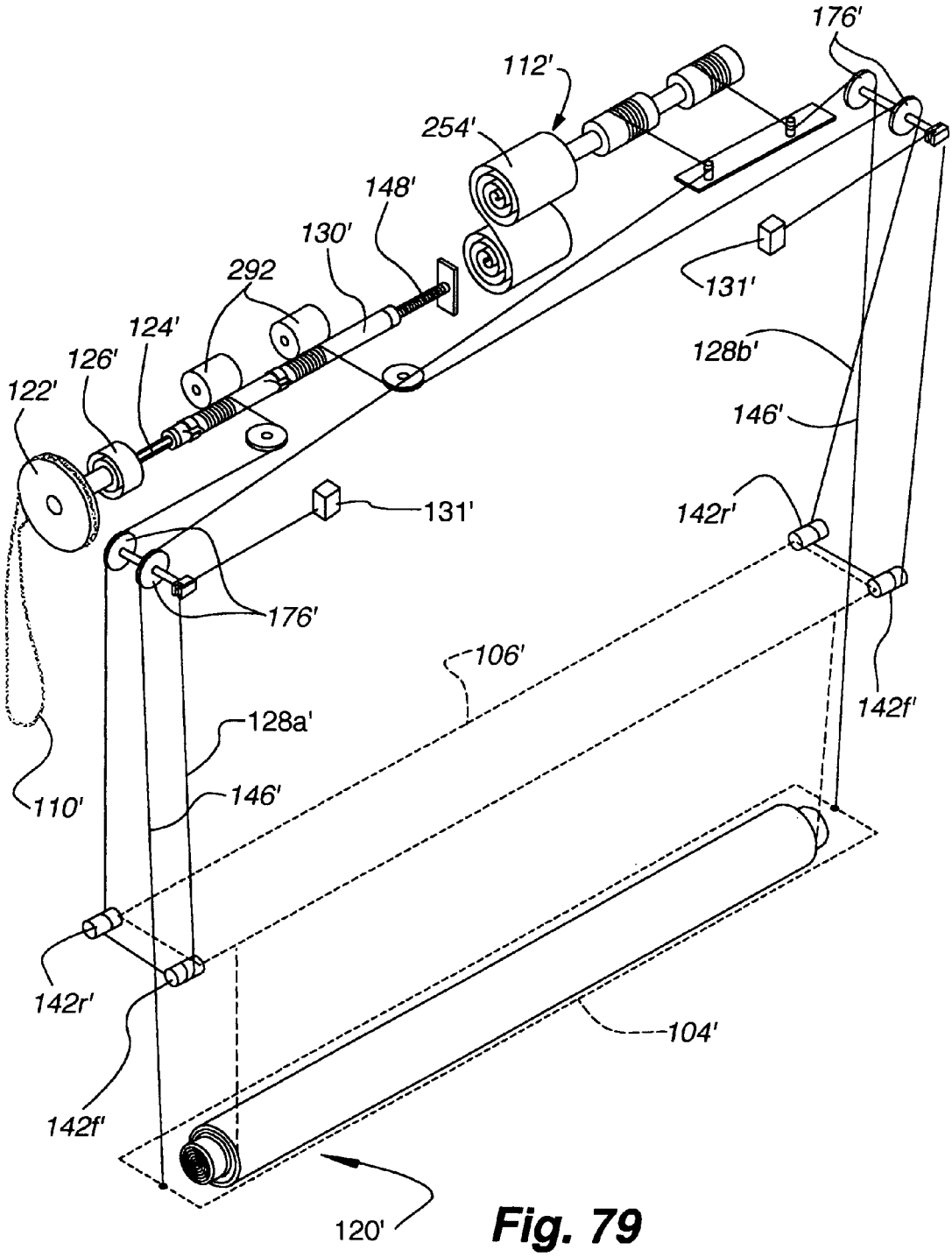
FIG. 79 is a diagrammatic isometric illustrating another alternative embodiment of the present invention.

The counterbalance system 112' is very similar to the counterbalance system in the previously described embodiment and includes a pair of spools 238' biased in a counterclockwise direction as viewed in FIG. 79 so as to offset the weight of the bottom rail 104' such that it can be positioned at any location within the architectural opening. In this embodiment, the bottom rail lift cords 146' pass from their associated spools around a single guide pin 296 before passing over a guide pulley 176' at the ends of the headrail 102' and downwardly for connection to the bottom rail. The number of guide pins utilized to guide the lift cords has a bearing on the smoothness with which the system operates and, accordingly, the number of pins is an option.

Figure 80:
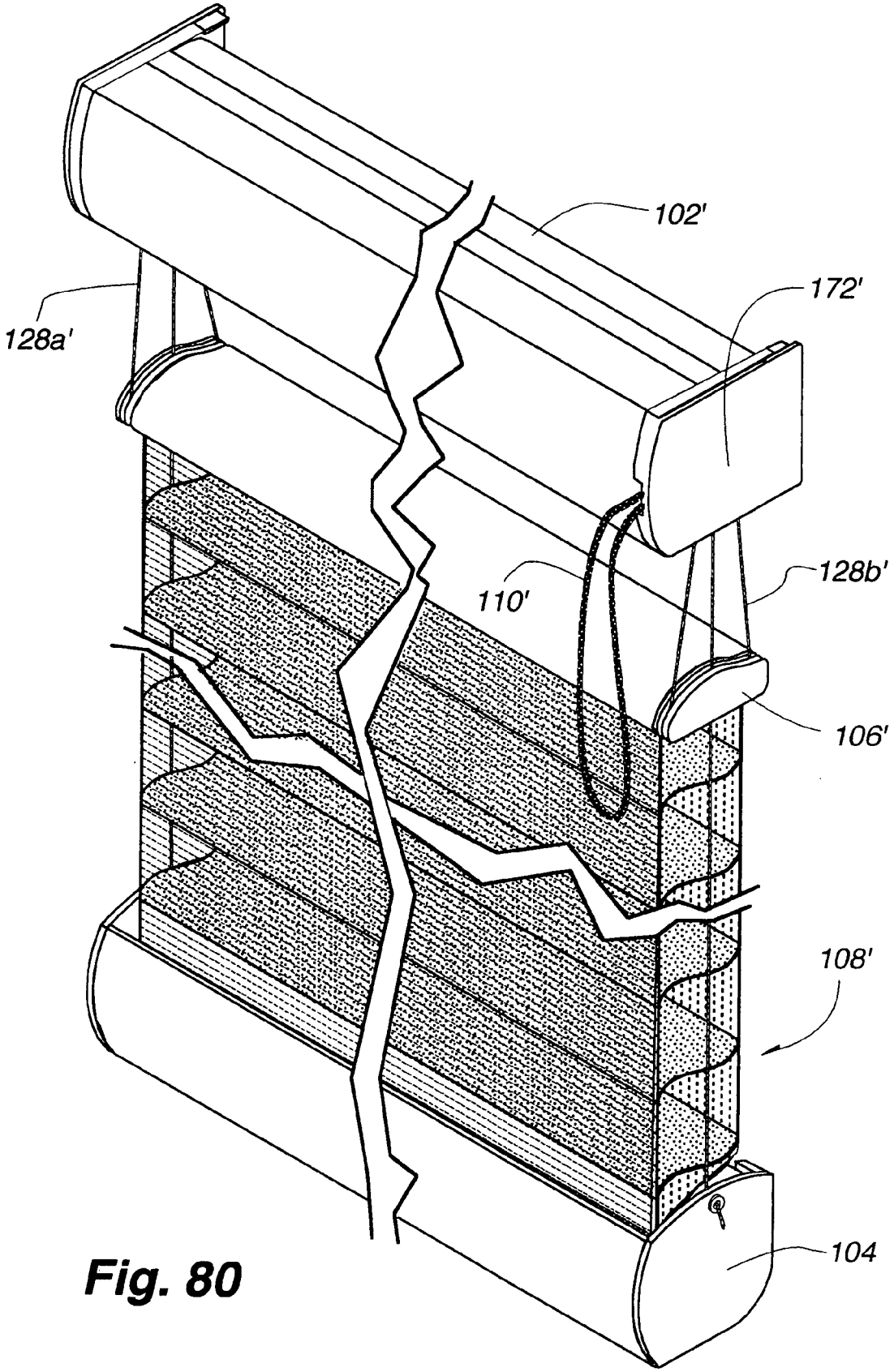
FIG. 80 is an isometric view of the alternative embodiment of FIG. 79 showing the bottom rail in its lowermost position, and the intermediate rail at an intermediate location, and the slats in an open position.
Figure 81:
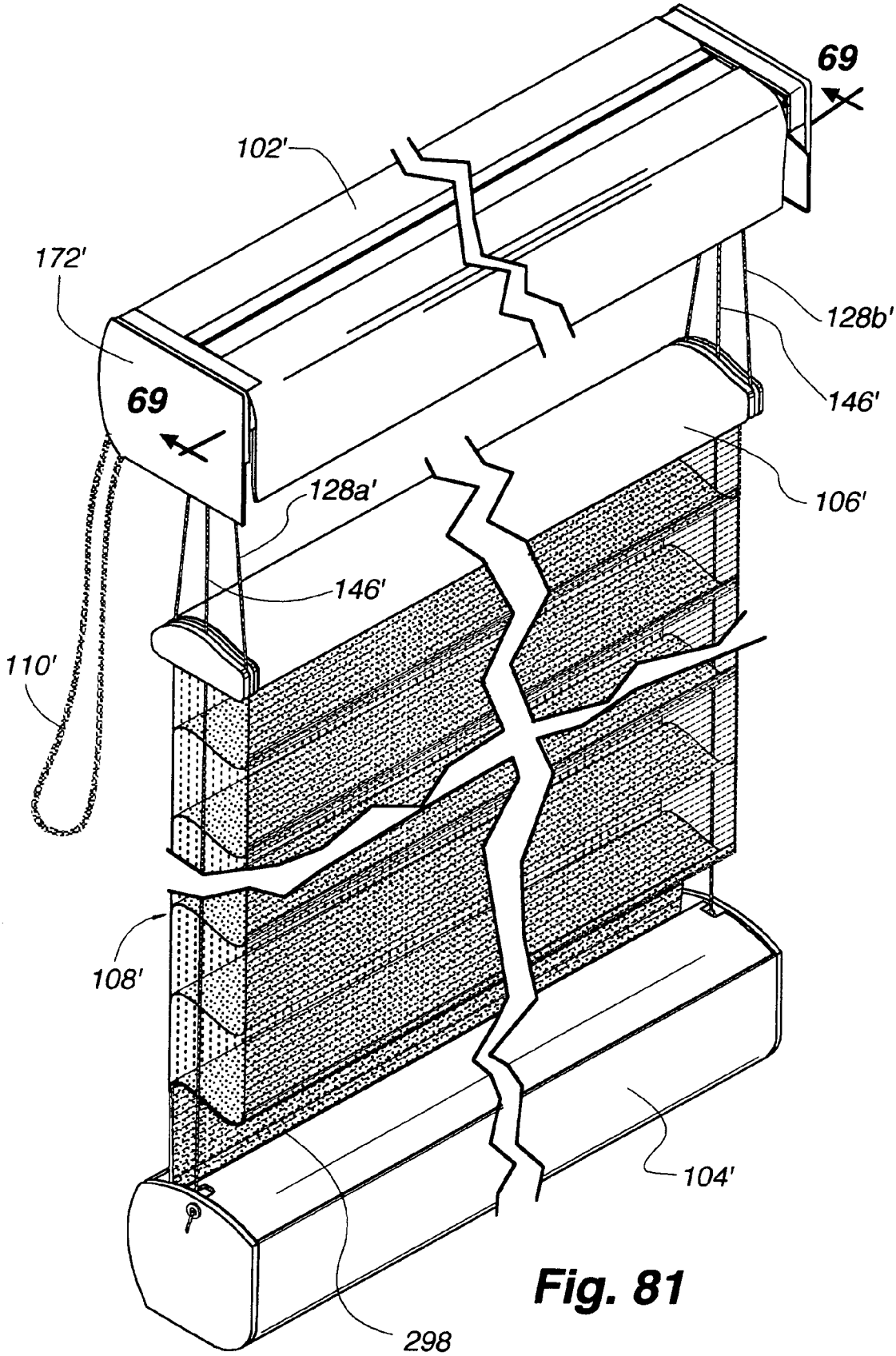
FIG. 81 is a fragmentary isometric similar to FIG. 80 showing the back side of the covering.
Figure 82:
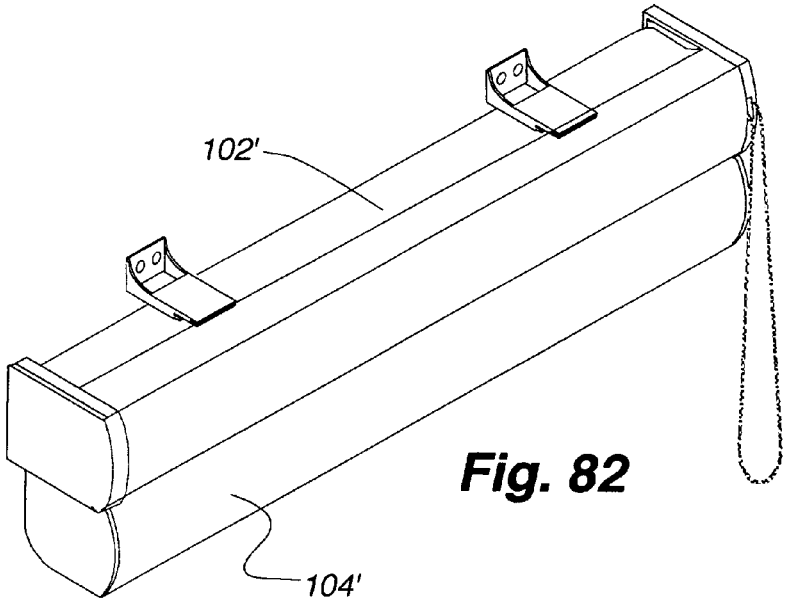
FIG. 82 is an isometric showing the covering of FIG. 79 in a fully retracted position.
Figure 83:
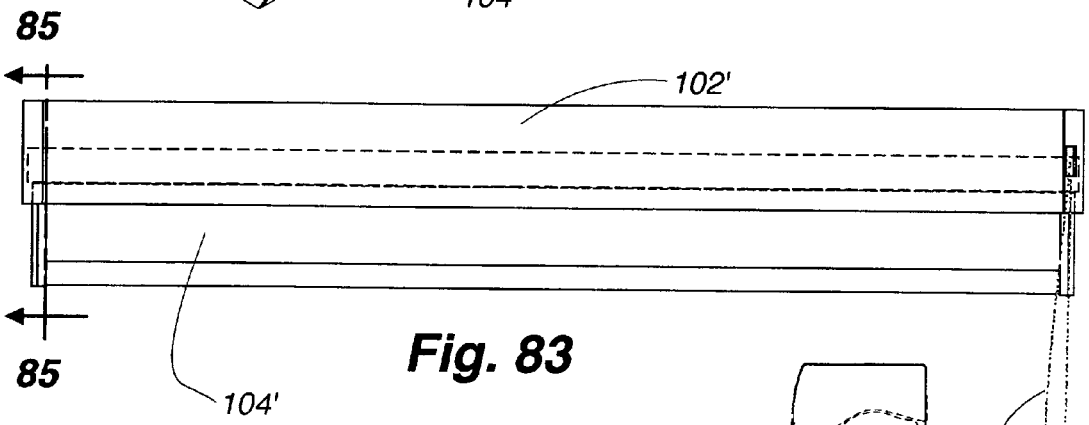
FIG. 83 is an enlarged front elevation of the covering shown in FIG. 82.
Figure 84:
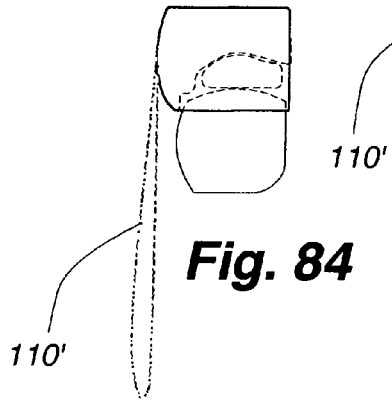
FIG. 84 is a right end elevation of the covering shown in FIG. 82.
Figure 86:
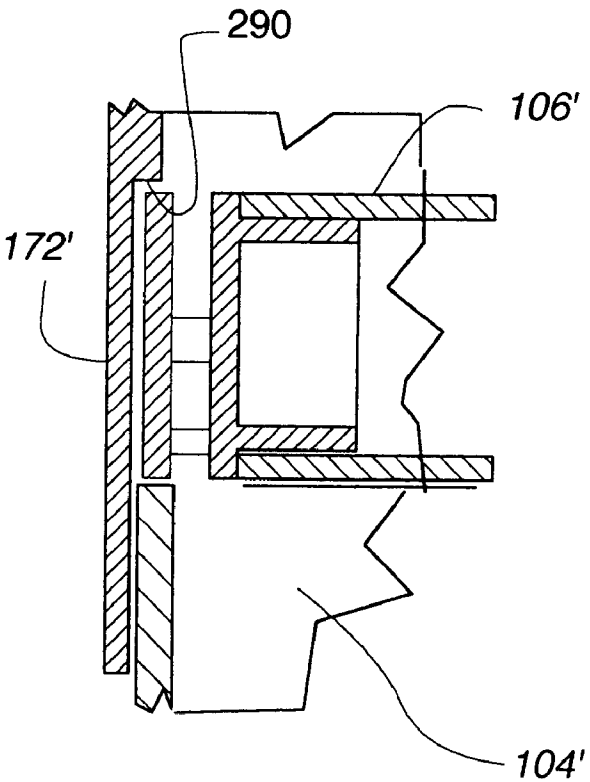
FIG. 86 is an enlarged fragmentary section taken along line 86—86 of FIG. 85.

As best seen in FIG. 81, the top of the bottom rail 104' in this embodiment is partially enclosed so as to define a slot 298 along one side through which the fabric structure can be fed onto a roller 120' within the bottom rail that is identical to the roller described in connection with the first embodiment. In FIG. 81, the fabric structure 108' is illustrated coming out of the bottom rail while the intermediate rail is being lifted. FIG. 80 illustrates the fabric sheet being fed into the bottom rail as the intermediate rail is being lowered. As will be appreciated in both instances, the slats 118' are in an open position when the intermediate rail is raised or lowered but pass to a closed position as the fabric structure is fed through the relatively narrow slot 298 into the bottom rail and onto the roller.

As with the first described embodiment, the covering is very versatile so that the intermediate rail 106' can be raised or lowered through manipulation of the control cord 110' and retained in any position by the double clutch 126' but by a reverse movement of the control cord, the vanes can be tilted between open and closed positions. Also, the bottom rail 104' can be simply lifted with the constant tension spring 254' offsetting the weight of the bottom rail so that it is easily movable up or down and will retain any position in which it is placed by the constant force applied thereto by the constant tension spring.

Although the present invention has been described with a certain degree of particularity, it is understood that the present disclosure has been made by way of example, and changes in detail or structure may be made without departing from the spirit of the invention as defined in the appended claims.

What is claimed is:

1. A covering for an architectural opening comprising:

a headrail, a bottom rail, an intermediate rail, blind material interconnecting said bottom and intermediate rails, said blind material having a plurality of horizontally disposed slats that are pivotal about longitudinal axes when said blind material is moved between open and closed positions, a control system in said headrail operably connected to said intermediate rail to raise and lower said intermediate rail relative to said headrail, and a counterbalanced system operably interconnecting said headrail and bottom rail to selectively permit movement and positioning of said bottom rail relative to said headrail whereby the spacing between said intermediate rail and said bottom rail is adjustable to extend or retract said blind material, and wherein said counterbalanced system includes a spring and a lift cord system, said lift cord system interconnecting said bottom rail with said spring such that said spring substantially offsets the weight of said bottom rail so that said bottom rail can be movably positioned at any selected position across said architectural opening.

2. The covering of claim 1 wherein said lift cord system includes one or more cords and at least one spool around which said one or more cords can be wrapped, said one or more cords interconnecting said spool and said bottom rail, said spring biasing said spool in a rotative direction to counterbalance the bias placed on said spool by the weight of said bottom rail.

3. The covering of claim 2 wherein there are a pair of spools and a pair of cords, each cord interconnecting a spool with one end of said bottom rail such that the ends of the bottom rail move vertically in unison as the cords are wrapped onto or off of said spools.

4. The covering of claim 2 or 3 further including a fixed pin associated with each spool and each cord, and wherein said cord is at least partially wrapped around said pin between said spool and said bottom rail.

5. The covering of claim 4 wherein there are a plurality of said pins associated with each cord and each spool.

6. A covering for an architectural opening comprising:

a headrail, a bottom rail, an intermediate rail, blind material interconnecting said bottom and intermediate rails, said blind material having a plurality of horizontally disposed slats that are pivotal about longitudinal axes when said blind material is moved between open and closed positions, a control system in said headrail operable connected to said intermediate rail to raise and lower said intermediate rail relative to said headrail, and a counterbalanced system operably interconnecting said headrail and bottom rail to selectively permit movement and positioning of said bottom rail relative to said headrail whereby the spacing between said intermediate rail and said bottom rail is adjustable to extend or retract said blind material, and wherein said intermediate rail has opposite longitudinal edges and wherein said control system includes at least one cord of a second lift cord system and at least one spool around which said at least one cord can be wrapped and unwrapped, an operating system for selectively rotating said spool, said at least one cord further being operatively connected to said opposite longitudinal edges of said intermediate rail such that manipulation of said at least one cord causes said intermediate rail to (1) pivot about a horizontal longitudinal axis and (2) be raised or lowered within said architectural opening.

7. The covering of claim 6 further including a releasable brake for selectively preventing rotation of said spool.

8. The covering of claim 7 wherein said brake includes a trigger arm for sensing tension in said cord and wherein said trigger arm is operative to release said brake or set said brake dependent on the tension in said cord.

9. The covering of claim 8 wherein said spool is mounted for reversible rotation about an axis of rotation and further including a system for moving said spool linearly along said axis of rotation upon rotative movement of said spool.

10. The covering of claim 9 wherein said system for moving said spool linearly includes a threaded rod.

11. The covering of claim 6 wherein rotation of said spool in one direction causes said intermediate rail to pivot in one direction and be raised in said architectural opening and rotation of said spool in an opposite direction causes said intermediate rail to pivot in an opposite direction and be lowered in said architectural opening.

12. The covering of claim 6 or 7 further including a two-way clutch to selectively prevent rotation of said spool in either direction until said operating system is operated to rotate said spool.

13. The covering of claim 6, 8, 9, 11 or 12 wherein said intermediate rail has opposite ends, and there are two cords with each cord operatively connected to an opposite end of said intermediate rail.

14. The covering of claim 13 further including a pair of pins at each end of said intermediate rail with one of said pins being associated with one longitudinal edge of said intermediate rail and the other of said pins being associated with the other longitudinal edge of said intermediate rail, and wherein each cord is wrapped around each pin at its associated end of the intermediate rail.

15. The covering of claim 6 further including at least one roller for compressing said cord onto said spool.

16. The covering of claim 14 wherein said one cord has two ends with one end operatively anchored in a static position to said headrail and the other end anchored to said spool, and further wherein said cord as it passes from said spool to said static anchored position is just wrapped around said one pin and then around said other of said pins.

17. The covering of claim 14 wherein said one cord has two ends with one end operatively anchored in a static position to said headrail and the other end anchored to said spool, and further wherein said cord as it passes from said spool to said static anchored position is first wrapped around said other of said pins and then around said one pin.

* * * * *